US007955768B2

(12) United States Patent
Tada et al.

(10) Patent No.: US 7,955,768 B2
(45) Date of Patent: Jun. 7, 2011

(54) ELECTROPHOTOGRAPHIC PHOTOCONDUCTOR AND METHOD FOR PRODUCING THE SAME, IMAGE FORMING APPARATUS, AND PROCESS CARTRIDGE

(75) Inventors: Hiromi Tada, Numazu (JP); Nozomu Tamoto, Numazu (JP); Katsuichi Ohta, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 352 days.

(21) Appl. No.: 11/852,708

(22) Filed: Sep. 10, 2007

(65) Prior Publication Data

US 2009/0035017 A1 Feb. 5, 2009

(30) Foreign Application Priority Data

Sep. 11, 2006 (JP) ..... 2006-246167
Jul. 27, 2007 (JP) ..... 2007-196598

(51) Int. Cl.
*G03G 5/05* (2006.01)

(52) U.S. Cl. ..... 430/58.05; 430/58.35; 430/58.65

(58) Field of Classification Search ..... 430/58.05, 430/58.35, 58.65
See application file for complete search history.

(56) References Cited

U.S. PATENT DOCUMENTS 4,390,608 A 6/1983 Hashimoto et al.
5,453,344 A * 9/1995 Malhotra et al. ..... 430/58.8
5,853,934 A * 12/1998 Watanabe et al. ..... 430/58.35
6,861,188 B2 3/2005 Ikegami et al.
6,899,983 B2 5/2005 Tamoto et al.
6,936,388 B2 8/2005 Suzuki et al.
7,018,755 B2 3/2006 Ikegami et al.
7,160,658 B2 1/2007 Suzuki et al.
7,251,437 B2 7/2007 Tamoto et al.
7,381,511 B2 * 6/2008 Ikegami et al. ..... 430/58.85
7,642,029 B2 * 1/2010 Horgan et al. ..... 430/58.8
2002/0028400 A1 3/2002 Shimada et al.
2003/0059694 A1 * 3/2003 Tomiuchi et al. ..... 430/59.6

(Continued)

FOREIGN PATENT DOCUMENTS

EP 1 698 943 A1 9/2006

(Continued)

*Primary Examiner* — Hoa V Le

(74) *Attorney, Agent, or Firm* — Oblon, Spivak, McClelland, Maier & Neustadt, L.L.P.

(57) ABSTRACT

There is provided an electrophotographic photoconductor containing a conductive substrate, and a photosensitive layer, disposed thereon, containing a charge transporting material having a triarylamine structure represented by General Formula 1, and wherein the photosensitive layer satisfies Mathematical Formula 1 when peak heights in raman scattering spectra of the triarylamine structure are measured at a wavenumber of 1,324±2 $cm^{-1}$ by a confocal raman spectroscopy using z-polarized light:

General Formula 1 where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1$$ Mathematical Formula 1 where $I_{(inside)}$ represents the peak height in of the raman scattering spectrum obtained at a depth of 5 μm or more from the photosensitive layer surface and $I_{(surface)}$ represents the peak height in the raman scattering spectrum obtained at a depth of less than 5 μm from the photosensitive layer surface.

17 Claims, 9 Drawing Sheets

U.S. PATENT DOCUMENTS

| | | | | |
|---|---|---|---|---|
| 2004/0091801 | A1* | 5/2004 | Joo et al. | 430/58.65 |
| 2004/0170911 | A1* | 9/2004 | Shimada et al. | 430/74 |
| 2005/0008957 | A1 | 1/2005 | Ikegami et al. | |
| 2005/0069797 | A1 | 3/2005 | Niimi et al. | |
| 2005/0175911 | A1 | 8/2005 | Tamoto et al. | |
| 2005/0260511 | A1* | 11/2005 | Kunieda et al. | 430/58.8 |
| 2006/0057479 | A1 | 3/2006 | Niimi et al. | |
| 2006/0177749 | A1 | 8/2006 | Tamoto et al. | |
| 2006/0197823 | A1 | 9/2006 | Ohta et al. | |
| 2007/0009818 | A1 | 1/2007 | Yanagawa et al. | |
| 2007/0059619 | A1 | 3/2007 | Shimoyama et al. | |
| 2007/0172749 | A1* | 7/2007 | Carmichael et al. | 430/58.8 |
| 2007/0269729 | A1 | 11/2007 | Ikuno et al. | |
| 2008/0069588 | A1 | 3/2008 | Inaba et al. | |

FOREIGN PATENT DOCUMENTS

| | | |
|---|---|---|
| JP | 61-124952 | 6/1986 |
| JP | 5-49233 | 7/1993 |
| JP | 9-114114 | 5/1997 |
| JP | 9-132777 | 5/1997 |
| JP | 10-20536 | 1/1998 |
| JP | 10-133404 | 5/1998 |
| JP | 11-87064 | 3/1999 |
| JP | 11-305464 | 11/1999 |
| JP | 11-338171 | 12/1999 |
| JP | 3045764 | 3/2000 |
| JP | 2000-347432 | 12/2000 |
| JP | 2001-302578 | 10/2001 |
| JP | 2001-348351 | 12/2001 |
| JP | 2003-73382 | 3/2003 |

* cited by examiner

ELECTROPHOTOGRAPHIC PHOTOCONDUCTOR AND METHOD FOR PRODUCING THE SAME, IMAGE FORMING APPARATUS, AND PROCESS CARTRIDGE

BACKGROUND OF THE INVENTION

1. Field of the Invention

The present invention relates to an electrophotographic photoconductor having a high resolution and photosensitivity, low residual potential and excellent electrostatic property and a method for producing the electrophotographic photoconductor, and an image forming apparatus and a process cartridge used for the image forming apparatus by using the electrophotographic photoconductor.

2. Description of the Related Art

In recent years, image forming apparatuses such as laser printers and digital copiers using an electrophotographic system, provide an image with improved image quality and stability and are broadly used. Recently, speeded-up, downsized, and full-colored image forming apparatuses are rapidly developed, and an electrophotographic photoconductor (hereinafter, referred to as a photoconductor) used for the image forming apparatuses, is needed to improve further carrier mobility and photosensitivity, and reduce residual potential.

The electrophotographic photoconductor used in the image forming apparatuses, which uses organic photosensitive materials, are commonly generally applied in terms of cost, productivity, environmental safety and the like. In terms of a layer configuration, the electrophotographic photoconductors are broadly classified into a single layer photoconductor having charge generating ability and charge transporting ability in a single layer, and a laminated photoconductor having layers functionally separated into a charge generating layer having charge generating ability and charge transporting layer having charge transporting ability. The latter is generally used in terms of the electrostatic stability and durability.

A mechanism of forming a latent electrostatic image in the laminated photoconductor is that the photoconductor is charged and irradiated with light, in which the light passes through the charge transporting layer and is absorbed by the charge generating material in the charge generating layer so as to generate charge. The generated charge are injected into the charge transporting layer at an interface between the charge generating layer and the charge transporting layer, and move in the charge transporting layer by electric field, reach the photoconductor surface, and neutralize surface charge imparted by charging so as to form the latent electrostatic image.

In the laminated organic photoconductor, the reduction of resolution, photosensitivity, and charge mobility, and rise of residual potential are recognized as big problems for improving image quality and speeding-up the image forming apparatus.

The reduction of the resolution may be caused by that the charge are horizontally diffused to the substrate.

Additionally, the reduction of photosensitivity and the charge mobility and rise of the residual potential may be caused by that the charge are trapped in a process of moving by hopping in the charge transporting material.

To solve these problems, the following conventional arts are known: for example, crystal materials having charge transporting ability (Japanese Patent Application Laid-Open (JP-A) Nos. 9-132777, 2001-348351, 2001-302578, 2000-347432, 11-305464, 11-087064, 2003-073382, and 11-338171), organic magnetic materials (Japanese Patent (JP-B) No. 3045764), and polysilanes (JP-A Nos. 10-133404 and 9-114114) used as a charge transporting material, and these orientation are controlled to improve resolution and photosensitivity.

The charge transporting material may be oriented by magnetic field, electric field, rubbing process, vapor deposition and the like. However, the charge transporting materials used for these conventional arts do not satisfy electrophotographic property, and have not been practically applied.

Moreover, in addition to the above objects, the following techniques are known in a field of the electrophotographic photoconductor: a magnetic material contained in a surface layer is oriented for the purpose of improving wear resistance (JP-A No. 10-020536 and Japanese Patent Application Publication (JP-B) No. 5-049233); and a magnetic powder in the undercoat layer is oriented by magnetic field for the purpose of improving a smoothing property of an undercoat layer (JP-A No. 61-124952).

However, these techniques may be effective for improving the wear resistance and smoothing property of the undercoat layer, but not actually effective for essential properties for improving image quality of the image forming apparatus, such as resolution, sensitivity, residual potential, and mobility, these are rather sacrificed.

BRIEF SUMMARY OF THE INVENTION

The present invention has been accomplished in view of the foregoing circumstances, and an object of the present invention is to solve the above-problems in the prior art and to achieve the following object. Specifically, the object of the present invention is to provide an electrophotographic photoconductor suppressing charge spread and charge retention while charge move by hopping in a photosensitive layer, having high resolution and photosensitivity, and low residual potential and a method for producing the electrophotographic photoconductor.

Another object of the present invention is to provide an image forming apparatus, which is capable of high-speed printing, full-color printing or both of them, and realizes downsizing thereof along with the downsized photoconductor and improved image quality, and is to provide a process cartridge used for the image forming apparatus by using the electrophotographic photoconductor.

To solve the above problems, the inventors of the present invention have keenly examined and found that charge smoothly move by hopping, charge spread in a direction parallel to the substrate is suppressed, photosensitivity and resolution are improved, and residual potential is reduced by controlling the orientation of a charge transporting material in a charge transporting layer containing the charge transporting material having a triarylamine structure. Moreover, the inventors have found that the orientation process by magnetic field is effective for controlling the orientation of the charge transporting material.

The present invention has been accomplished in view of the foregoing circumstances, and the above-problems in the prior art are solved as follows:

An electrophotographic photoconductor of the present invention contains a conductive substrate, and a photosensitive layer, wherein the photosensitive layer is disposed on the conductive substrate and contains a charge transporting material having a triarylamine structure represented by General Formula 1, and when peak heights in raman scattering spectra of the triarylamine structure are measured at a wavenumber of 1,324±2 $cm^{-1}$ by a confocal raman spectroscopy using z-polarized light, the photosensitive layer satisfies Mathematical Formula 1:

General Formula 1

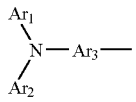

where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1 \quad \text{Mathematical Formula 1}$$

where $I_{(inside)}$ represents the peak height in the raman scattering spectrum obtained by measuring at a depth of 5 μm or more from a surface of the photosensitive layer and $I_{(surface)}$ represents the peak height in the raman scattering spectrum obtained by measuring at a depth of less than 5 μm from the surface of the photosensitive layer.

An electrophotographic photoconductor of the present invention contains a conductive substrate, and a photosensitive layer, wherein the photosensitive layer is disposed on the conductive substrate and comprises a charge transporting material having a triarylamine structure represented by General Formula 1, and the electrophotographic photoconductor is produced by applying magnetic field thereto, while a coating liquid for the photosensitive layer is coated, and/or after the photosensitive layer is cured:

General Formula 1

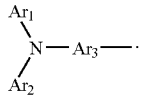

A method for producing an electrophotographic photoconductor of the present invention contains applying magnetic field to the electrophotographic photoconductor, while a coating liquid for a photosensitive layer is coated, and/or after the photosensitive layer is cured, wherein the electrophotographic photoconductor contains a conductive substrate and a photosensitive layer, wherein the photosensitive layer is disposed on the conductive substrate and contains a charge transporting material having a triarylamine structure represented by General Formula 1:

General Formula 1

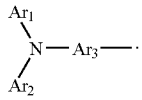

An image forming apparatus containing an electrophotographic photoconductor, a charging unit, an image exposing unit, a developing unit and a transferring unit, wherein the electrophotographic photoconductor contains a conductive substrate, and a photosensitive layer, wherein the photosensitive layer is disposed on the conductive substrate and contains a charge transporting material having a triarylamine structure represented by General Formula 1, and when peak heights in raman scattering spectra of the triarylamine structure are measured at a wavenumber of 1,324±2 $cm^{-1}$ by a confocal raman spectroscopy using z-polarized light, the photosensitive layer satisfies Mathematical Formula 1:

General Formula 1

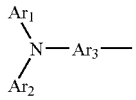

where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1 \quad \text{Mathematical Formula 1}$$

where $I_{(inside)}$ represents the peak height in the raman scattering spectrum obtained by measuring at a depth of 5 μm or more from a surface of the photosensitive layer and $I_{(surface)}$ represents the peak height in the raman scattering spectrum obtained by measuring a depth of less than 5 μm from the surface of the photosensitive layer, wherein the electrophotographic photoconductor is produced by applying magnetic field to the electrophotographic photoconductor, while a coating liquid for the photosensitive layer is coated, and/or after the photosensitive layer is cured.

The image forming apparatus of the present invention containing an electrophotographic photoconductor, a charging unit, an image exposing unit, a developing unit, a transferring unit, wherein the image forming apparatus is a tandem image forming apparatus containing a plurality of the electrophotographic photoconductors correspond to a plurality of the developing units in which toners of different colors are respectively supplied, and each of the electrophotographic photoconductor contains a conductive substrate, and a photosensitive layer, wherein the photosensitive layer is disposed on the conductive substrate and contains a charge transporting material having a triarylamine structure represented by General Formula 1, and when peak heights in raman scattering spectra of the triarylamine structure are measured at a wavenumber of 1,324±2 $cm^{-1}$ by a confocal raman spectroscopy using z-polarized light, the photosensitive layer satisfies Mathematical Formula 1:

General Formula 1

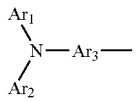

where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1 \quad \text{Mathematical Formula 1}$$

where $I_{(inside)}$ represents the peak height in the raman scattering spectrum obtained by measuring at a depth of 5 μm or more from a surface of the photosensitive layer and $I_{(surface)}$ represents the peak height in the raman scattering spectrum obtained by measuring at a depth of less than 5 μm from the surface of the photosensitive layer.

A process cartridge used in the present invention containing an electrophotographic photoconductor and at least one of a charging unit, an image exposing unit, a developing unit, a transferring unit, and a cleaning unit, wherein the process cartridge is integrated with the electrophotographic photoconductor and at least one of the charging unit, the image exposing unit, the developing unit, the transferring unit, and the cleaning unit, wherein the process cartridge is detachably attached to an image forming apparatus, and the electrophotographic photoconductor contains a conductive substrate, and a photosensitive layer, wherein the photosensitive layer is disposed on the conductive substrate and contains a charge transporting material having a triarylamine structure represented by General Formula 1, and when peak heights in raman scattering spectra of the triarylamine structure are measured at a wavenumber of 1,324±2 $cm^{-1}$ by a confocal raman spectroscopy using z-polarized light, the photosensitive layer satisfies Mathematical Formula 1:

General Formula 1

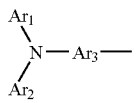

where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1 \quad \text{Mathematical Formula 1}$$

where $I_{(inside)}$ represents the peak height in the raman scattering spectrum obtained by measuring at a depth of 5 μm or more from a surface of the photosensitive layer and $I_{(surface)}$ represents the peak height in the raman scattering spectrum obtained by measuring at a depth of less than 5 μm from the surface of the photosensitive layer, wherein the electrophotographic photoconductor is produced by applying magnetic field to the electrophotographic photoconductor, while a coating liquid for the photosensitive layer is coated, and/or after the photosensitive layer is cured.

DETAILED DESCRIPTION OF THE INVENTION

Figure 1:
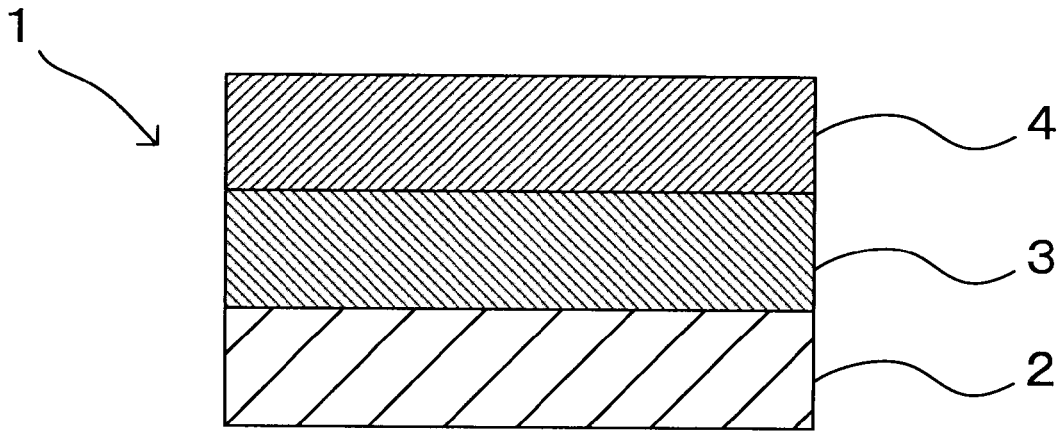
FIG. 1 shows an example of a layer configuration of an electrophotographic photoconductor of the present invention.

With reference to the drawings, embodiments of the present invention will be explained in details, hereinbelow.

In conventional photoconductors, as the thickness of the charge transporting layer is thicker, it is likely to reduce the resolution and increase the residual potential. It has been a problem on establishing both of high durability and high quality image.

However, it has been found that these problems are solved by improving orientation of the charge transporting material having a triarylamine structure, and both of the high durability and high quality image of the photoconductor could have been established.

The orientation of the charge transporting material is improved by using a coating liquid for the photosensitive layer containing a charge a transporting material having a triarylamine structure and applying magnetic field to the photoconductor at least any of during and after coating the coating liquid for the photosensitive layer.

The reason for the orientation of the charge transporting material having a triarylamine structure can be controlled by applying the magnetic field may be considered as follows:

Generally, examples of materials having a magnetic material include transition metal elements and rare-earth elements. These elements having 3d orbital or 4d orbital which is not filled to the maximum and unpaired electrons perform orbital motion while rotating about its axis. According to the motion, a spin angular momentum and orbit angular momentum contributing a magnetic moment exhibits characteristics of a magnet in an atom or ion.

It has been considered that most organic compounds present in nature do not significantly exhibit magnetic properties, because they do not have unpaired electrons causing the magnetic properties.

However, the organic molecules having unpaired electron spins may have magnetic properties, and the orientation can be improved by the magnetic field.

In the present invention, it has been found that the orientation of the triarylamine and the photoconductor property are changed when the magnetic field is applied to the photoconductor containing the triarylamine as the charge transporting material.

The triarylamine has excellent charge transporting ability due to II electron delocalization.

An electron spin in P orbit in a nitrogen atom, particularly, a II electron spin with high delocalization may contribute to the magnetic properties in an organic molecule. Thus, the orientation of the triarylamine may be controlled under the magnetic field.

In the compounds having high charge transporting ability selected from triarylamines, such as the stilbenes, distyrylbenzenes, aminobiphenyls, benzidines, II conjugation may be spread in a longitudinal direction of molecules, and the longitudinal direction of the molecules may be likely to be parallel oriented to a magnetic line of force in the magnetic field.

Therefore, when the magnetic field is applied by a magnetic line of force in a direction vertical to the substrate in the present invention, the longitudinal direction of the charge transporting material may be vertically oriented to the substrate.

In the present invention, a Z axis direction of the charge transporting material, specifically, the vertical orientation to the substrate is controlled, so that the charge transporting ability is improved in the direction of the layer thickness in the photosensitive layer. This may be resulted from the following reasons:

Generally, it is known that the charge moving in a molecule is fairly faster than the charge moving between molecules when the charge moves by hopping in organic molecules.

Therefore, it is ideal that the charge moving between the charge transporting materials is reduced as small as possible, when charge moves across the charge transporting layer, and the direction of charge movement in the molecules of the charge transporting material may be preferably oriented in the direction of the layer thickness of the charge transporting layer.

When the stilbenes, distyrylbenzenes, aminobiphenyls and benzidines are used as the charge transporting material, particularly advantageously used in the present invention, the longitudinal direction of the charge transporting material is oriented in the direction of the layer thickness of the photosensitive layer to thereby yielding excellent photoconductor property.

The photoconductor of the present invention is characterized by that the charge transporting material is highly oriented inside the photosensitive layer.

In a conventional photoconductor without orientation process, the orientation of the charge transporting material inside the photosensitive layer differs a little from that on the surface of the photosensitive layer, but it is confirmed that, in the photosensitive layer of the present invention, the charge transporting material inside the photosensitive layer is oriented higher than that on the surface of the photosensitive layer.

The reasons for these are not clear, but the following reasons are considered: it may be possibly difficult to control the orientation on the surface of the photosensitive layer compared to that inside the photosensitive layer because the surface thereof is externally influenced; and upon orientation process, the molecules are easily oriented inside the photosensitive layer because they have higher fluidity compared to that on the surface of the photosensitive layer.

The charge transporting ability in the direction of the layer thickness of the photosensitive layer may largely depend on the orientation of the charge transporting material inside the photosensitive layer. In the photoconductor of the present invention, the orientation of the charge transporting material on the surface of the photosensitive layer is not largely different from that in the conventional photoconductor, but the orientation of the charge transporting material inside the photosensitive layer in the photoconductor of the present invention is obviously higher than that in the conventional photoconductor, and then the photoconductor of the present invention may exhibit better photoconductor property than the conventional photoconductor.

<Evaluation Method of Orientation>

Next, an evaluation method of the orientation of the charge transporting material in the present invention will be explained.

As the evaluation method of the orientation of the charge transporting material, a confocal raman spectroscopic measurement is used. The raman spectroscopic measurement is conventionally known as a method for evaluating an orientation, in which a raman activity can be obtained when a polarization direction of a material and a polarization direction of a laser is identical. As a confocal raman spectroscopic device, RAMAN-11 by nanophoton corp. may be used. A z-polarization device, Zpol by nanophoton corp. is set in the confocal raman spectroscopic device, and raman scattering light is detected by irradiating z-polarized laser light to evaluate an orientation of molecules in a direction vertical to the substrate.

The laser has a light intensity of 5 mW before passing though the z-polarization device and a excitation wavelength of 532 nm, an objective lens of 100× (a numerical aperture NA of 0.9), and a spectrograph slit width of 120 μm are used for the measurement.

In this measuring method, an incident laser light intensity is attenuated to be an actually measured laser light intensity because the z-polarization device is set.

In order to evaluate the orientation on the surface of the photosensitive layer and inside the photosensitive layer, the laser light is focused on a depth of less than 5 μm from the surface of the photosensitive layer and on a depth of 5 μm or more from the surface of the photosensitive layer, and then the raman scattering intensities of respective triarylamine structures are compared.

The raman scattering intensities of the surface of the photosensitive layer difficulty affected by the orientation process is compared with that of inside the photosensitive layer effectively affected by the orientation process to clarify presence or absence of the effect of the orientation process.

In this measuring method, a resolution in a depth direction is estimated to be 5 μm, when the orientation in a depth of less than 5 μm from the surface of the photosensitive layer (area from the surface to a depth of less than 5 μm in the photosensitive layer) is evaluated, the orientation is measured by focusing the laser light on the surface of the photosensitive layer (a depth of 0 μm).

Meanwhile, when an orientation in a depth of 5 μm or more from the surface of the photosensitive layer is measured, the orientation is measured by focusing the laser light, for example, on a depth of 10 μm from the surface of the photosensitive layer.

The orientation is evaluated by comparing peak heights in the raman scattering spectra of the triarylamine. The peak heights in the raman scattering spectra are obtained by subtracting an average value of the raman scattering intensities of triarylamine at the wavenumber of 1,356±2 $cm^{-1}$ where no peak is observed from a maximum of the raman scattering intensities of triarylamine at the wavenumber of 1,324±2 $cm^{-1}$. And then, the orientation of the charge transporting material having a triarylamine structure is evaluated from a ratio "ϵ" of $I_{(inside)}$ to $I_{(surface)}$, $\epsilon = I_{(inside)}/I_{(surface)}$, where $I_{(inside)}$ represents the peak height in the raman scattering spectrum obtained by measuring at a depth of 5 μm or more from the surface of the photosensitive layer and $I_{(surface)}$ represents the peak height in the raman scattering spectrum obtained by measuring a depth of less than 5 μm from the surface of the photosensitive layer.

The conventional photoconductor has the ratio ϵ of 1.00 or less, and the orientation of the charge transporting material having a triarylamine structure in a direction vertical to the substrate hardly differs between the surface of the photosensitive layer and the inside the photosensitive layer.

However, the photoconductor of the present invention has the photosensitive layer, in which the charge transporting material having a triarylamine structure inside the photosensitive layer is oriented higher than that on the surface of the photosensitive layer, and the ratio ϵ of 1.1 or more.

The photoconductor having the ratio ϵ of 1.1 or more clearly obtains advantageous effects such as reduction of the residual potential, and improvement of dot reproducibility and mobility. The photoconductor having a ratio ϵ of 1.3 or more further remarkably obtains these effects.

Because the charge transporting material having a triarylamine structure is highly oriented in a direction of the layer thickness inside the photosensitive layer, it is considered that the charge transporting ability is high in the photosensitive layer, and then the effect such as reduction of the residual potential, improvement of the mobility can be obtained, and additionally the improvement of the dot reproducibility can be obtained due to suppressing the charge diffusion.

The higher the orientation of the charge transporting material in a direction vertical to the substrate, the higher the charge transporting ability may become. Thus, the larger the ratio ϵ is, the better the charge transporting ability may improve.

Hereinafter, a method for producing a photosensitive layer which controls the orientation of the charge transporting material having a triarylamine structure will be explained in detail.

The electrophotographic photoconductor of the present invention can be obtained by applying the magnetic field to the electrophotographic photoconductor either during or after the formation of the photosensitive layer containing the charge transporting material having a triarylamine structure.

A coating liquid for the photosensitive layer is started to be coated, and then either during or after the formation of the photosensitive layer containing the charge transporting material having a triarylamine structure, the magnetic field can be applied at any time, and is preferably applied to the electrophotographic photoconductor either while the coating liquid for the photosensitive layer is coated or immediately after the coating liquid for the photosensitive layer is coated and before cured. This is because, the charge transporting material having a triarylamine structure easily moves before the photosensitive layer is cured. In the present invention, "cured" means that the layer does not stick to a finger when it is touched with the finger.

In this case, the magnetic field is preferably applied to the photoconductor when the coating liquid is started to be coated. However, the magnetic field is effectively applied to the photoconductor even immediately after the coating liquid for the photosensitive layer is coated and before cured. In order to stably keep the orientation condition, the magnetic field is preferably applied to the photoconductor until the solvent contained in the photosensitive layer is evaporated, and cured.

The orientation of the charge transporting material having a triarylamine structure may be changed, when the photosensitive layer is heated and dried. Thus, the magnetic field is applied to the photoconductor while the photosensitive layer is heated and dried, and the magnetic field is preferably kept to be applied to the photoconductor while naturally cooled to a room temperature.

Meanwhile, in case that the application of the magnetic field is stopped before the layer is cured, the magnetic field is applied after the layer is cured, and the magnetic field is not applied when heated and dried, the effect of applying the magnetic field can be recognized, but the effect is likely to be slightly poor.

Therefore, in the present invention, the magnetic field is particularly preferably kept to be applied to the photoconductor while the coating liquid for the photosensitive layer is started to be coated, heated and dried, and then cooled to a room temperature in terms of orientation. However, the magnetic field is preferably kept to be applied to the photoconductor at least from immediately after the coating liquid for the photosensitive layer is coated and before cured, via heated and dried, to cured. Advantageous effects can be obtained from both of them.

An effective intensity of the magnetic field is not particularly provided because it depends on the easiness of orientation of the material which is controlled to be oriented. The magnetic field used for the charge transporting material having a triarylamine structure represented by the General Formula 1 has an intensity of 5 tesla or more, and more preferably has an intensity of 8 tesla, in order to exhibit a sufficient advantageous effect. The magnetic field having higher intensity is preferred.

The directions of applying the magnetic field are vertical and horizontal to a substrate, and either can be selected depending on a molecular structure. When the charge transporting materials which are advantageously used in the present invention as described above, such as stilbenes, distyrylbenzenes, aminobiphenyls and benzidines, are used, the magnetic field is preferably applied in the direction vertical to the substrate of the photoconductor.

Hereinafter, the photoconductor of the present invention will be explained with reference to the drawings.

As shown in FIG. 1, a photoconductor 1 of the present invention has a configuration that a charge generating layer 3 primarily containing a charge generating material and a charge transporting layer 4 primarily containing a charge transporting material are disposed on a conductive substrate 2.

Figure 2:
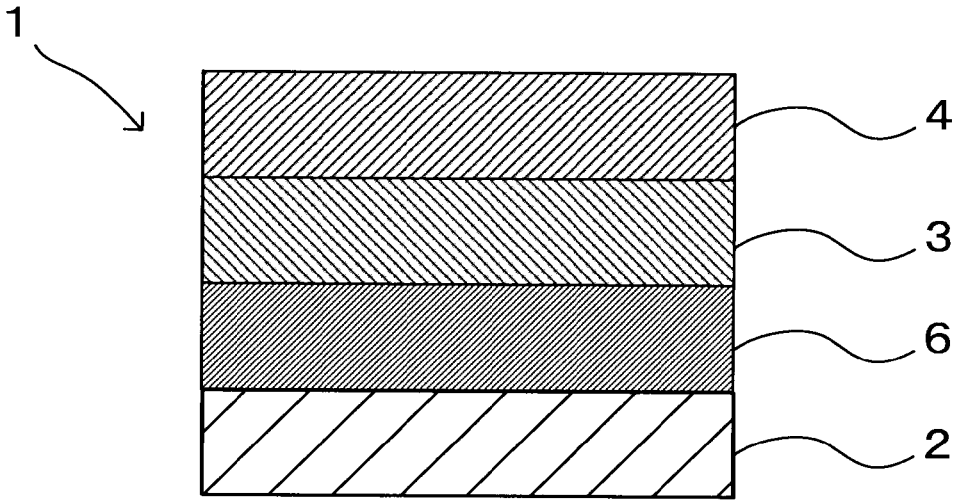
FIG. 2 shows another example of a layer configuration of an electrophotographic photoconductor of the present invention.

As shown in FIG. 2, in the photoconductor 1 of the present invention, an undercoat layer 6 or an interlayer may be formed between the conductive substrate 2 and the charge generating layer 3.

Figure 3:
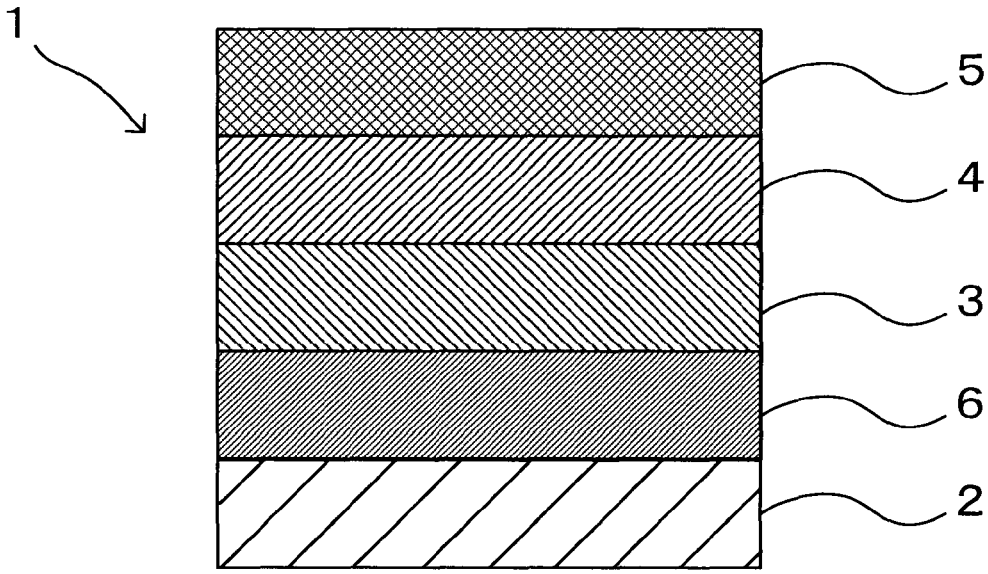
FIG. 3 shows a still another example of a layer configuration of an electrophotographic photoconductor of the present invention.

As shown in FIG. 3, in the photoconductor 1 of the present invention, a protective layer 5 may be formed on the charge transporting layer 4.

Figure 4:
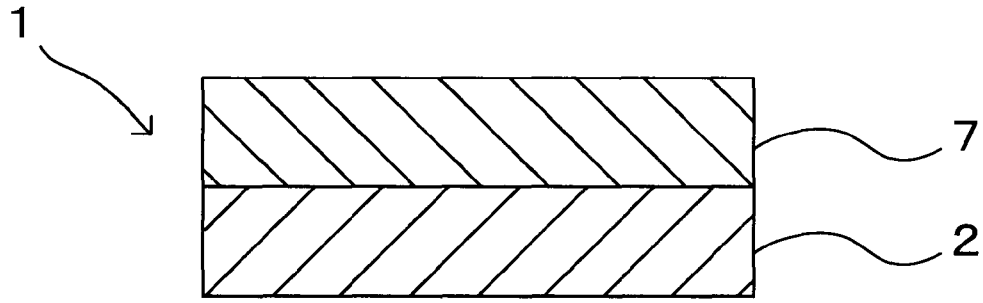
FIG. 4 shows a further still another example of a layer configuration of an electrophotographic photoconductor of the present invention.

As shown in FIG. 4, the photoconductor 1 of the present invention may be formed in a single layer photoconductor having a photosensitive layer 7 of a single layer, which contains a charge generating material and a charge transporting material, disposed on the conductive substrate 2.

The conductive substrate may be a film-shaped or cylindrically-shaped plastic or paper covered with a conducting material having a volume resistivity of $10^{10}$ Ω·cm or less, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing, cut, and surface-treated such as super-finished and polished. Additionally, an endless belt and endless stainless belt are used for the conductive substrate.

In addition, a conductive powder may also be dispersed in the binder resin and coated on the substrate, and used as the conductive substrate of the present invention.

Examples of the conductive powders include carbon black, acetylene black, metal powders such as aluminum, nickel, iron, nichrome, copper, zinc and silver, and a metal oxide powders such as conductive tin oxide and ITO.

The binder resin used together may also include thermoplastic resins, thermosetting resins or photosetting resins such as a polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyd resin. Such a conductive layer can be provided by dispersing the conductive powders and the binder resin in a suitable solvent, for example, tetrahydrofuran, dichloromethane, methyl ethyl ketone or toluene and then coating on the substrate.

A conductive layer disposed on a suitable cylindrical substrate by a heat-shrinkable tubing containing the conductive powder in a material such as polyvinyl chloride, polypropylene, polyester, polystyrene, polyvinylidene chloride, polyethylene, chlorinated rubber or polytetrafluoroethylene fluoro-resin, can also be used as the conductive substrate of the present invention.

Next, the photosensitive layer will be explained.

The photosensitive layer having a laminate structure contains at least the charge generating layer and the charge transporting layer disposed in this order.

The charge generating layer is a layer which contains the charge generating material. The known charge generating materials can be used for the charge generating layer, and examples thereof include azo pigments such as monoazo pigments, diazo pigments, asymmetric disazo pigments, triazo pigments; phthalocyanine pigments such as titanyl phthalocyanine, copper phthalocyanine, vanadyl phthalocyanine, hydroxyl gallium phthalocyanine, nonmetalphthalocyanine; perylene pigments, perinone pigments, indigo pigments, pyrrolopyrrole pigments, anthraquinone pigments, quinacridone pigments, quinone condensation polycyclic compounds and squarylium pigments. These charge generating materials may be used alone, or in combination of two or more.

Examples of the binder resins used for the charge generating layer include a polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinyl benzal, polyester, phenoxy resin, vinyl chloride-vinyl acetate copolymer, polyvinyl acetate, polyphenylene oxide, polyamide, polyvinyl pyridine, cellulose resin, casein, polyvinyl alcohol, and polyvinyl pyrrolidone. The amount of the binder resin is preferably from 0 part by mass to 500 parts by mass, and preferably from 10 parts by mass to 300 parts by mass on the basis of 100 parts by mass of the charge generating material.

The charge generating layer is formed by dispersing the charge generating material together with the binder resin if necessary in a suitable solvent using known dispersing methods such as a ball mill, attritor or sand mill, or by ultrasonic waves, coating this on the conductive substrate, undercoat layer or interlayer, and drying. The binder resin may be added either before or after dispersing the charge generating material.

Examples of the solvents for forming the charge generating layer include generally used organic solvents such as isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Of these, ketone solvents, ester solvents and ether solvents are preferably used. These solvents may be used alone, or in combination of two or more.

A coating liquid for forming the charge generating layer may primarily contain the charge generating material, solvent and binder resin, but it may also contain any other additives such as an sensitizer, a dispersant, a surfactant, silicone oil and the like.

Examples of the methods for forming the charge generating layer using the coating liquid include known methods such as impregnation coating, spray coating, bead coating, nozzle coating, spinner coating and ring coating.

The charge generating layer preferably has a thickness of 0.01 μm to 5 μm, and more preferably 0.1 μm to 2 μm. After the charge generating layer is formed, it is heated and dried by an oven and the like. The drying temperature of the charge generating layer in the present invention is preferably 50° C. to 160° C., and more preferably 80° C. to 140° C.

The charge transporting layer can be formed by dispersing and dissolving the charge transporting material having a triarylamine structure and a binder resin in a suitable solvent, and applying magnetic field to the photoconductor during or after coating the solution.

Selecting from the charge transporting material having a triarylamine structure used in the present invention, examples of stilbenes, distyrylbenzenes, aminobiphenyls and benzidines, which are particularly effectively used, will be explained as follows:

<Charge Transporting Material having a Stilbene Structure>

Examples of charge transporting materials having a stilbene structure are represented by the following General Formulas 2 to 4:

General Formula 2

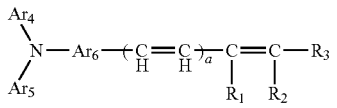

where "a" is an integer of 0 or 1, $Ar_4$, $Ar_5$ and $Ar_6$ are substituted or unsubstituted aromatic hydrocarbon groups, $Ar_4$ and $Ar_5$, $Ar_5$ and $Ar_6$, and $Ar_6$ and $Ar_4$ are optionally combined to form heterocyclic rings, respectively, $R_1$, $R_2$ and $R_3$ are hydrogen atoms, substituted or unsubstituted alkyl groups having 1 to 4 carbon atoms, or substituted or unsubstituted aromatic hydrocarbon groups, and $R_1$, $R_2$ and $R_3$ are either directly bonded to a carbon atom, or bonded via an alkylene group or hetero atom to a carbon atom.

General Formula 3

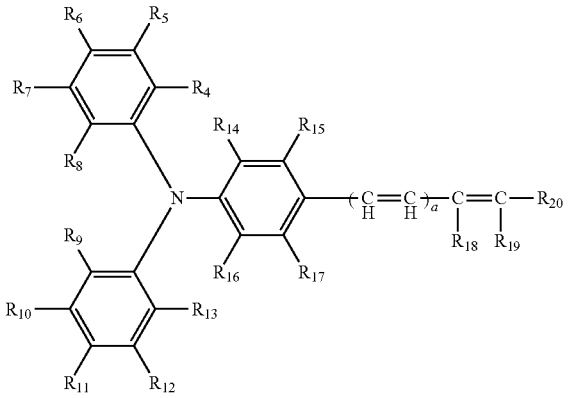

where, "a" is an integer of 0 or 1, $R_4$ to $R_{20}$ are hydrogen atoms, substituted or unsubstituted alkyl groups having 1 to 4 carbon atoms, or substituted or unsubstituted aromatic hydrocarbon groups, $R_4$ to $R_{17}$, $R_{11}$ and $R_{20}$ are optionally bonded with an adjacent substituent to form heterocyclic rings, and $R_4$ to $R_{20}$ are either directly bonded to a carbon atom, or bonded via an alkylene group or hetero atom to a carbon atom.

General Formula 4

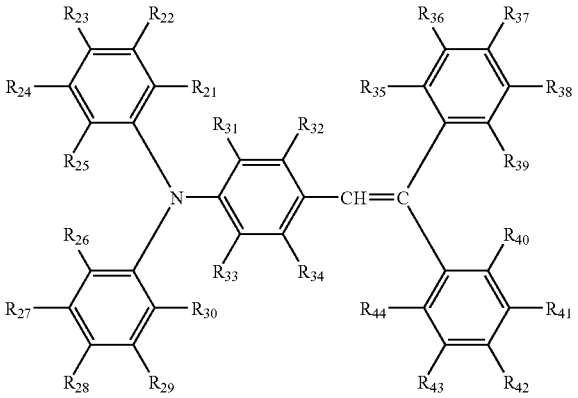

where $R_{21}$ to $R_{44}$ are hydrogen atoms, substituted or unsubstituted alkyl groups having 1 to 4 carbon atoms, or substituted or unsubstituted aromatic hydrocarbon groups, $R_{21}$ to $R_{44}$ are optionally bonded with an adjacent substituent to form heterocyclic rings, and $R_{21}$ to $R_{44}$ are either directly bonded to a carbon atom, or bonded via an alkylene group or hetero atom to a carbon atom.

Examples of charge generating materials having a distyrylbenzene structure used in the present invention are represented by the following General Formulas 5 and 7:

General Formula 5

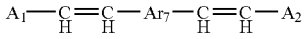

where $Ar_7$ is a substituted or unsubstituted aromatic hydrocarbon group, and $Ar_1$ and $Ar_2$ are represented by the following General Formula 6, and are either identical or different:

General Formula 6

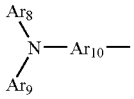

where $Ar_8$, $Ar_9$ and $Ar_{10}$ are substituted or unsubstituted aromatic hydrocarbon groups, and $Ar_8$ and $Ar_9$, $Ar_9$ and $Ar_{10}$, and $Ar_{10}$ and $Ar_8$ are optionally combined to form heterocyclic rings, respectively.

General Formula 7

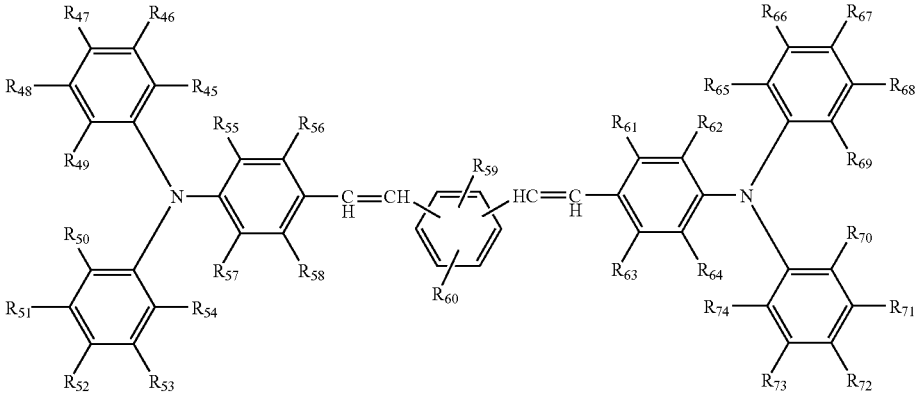

where $R_{45}$ to $R_{74}$ are hydrogen atoms, substituted or unsubstituted alkyl groups having 1 to 4 carbon atoms, or substituted or unsubstituted aromatic hydrocarbon groups, and, $R_{45}$ to $R_{74}$ are optionally bonded with an adjacent substituent to form heterocyclic rings, and $R_{45}$ to $R_{74}$ are optionally directly bonded to a carbon atom, or bonded via an alkylene group or hetero atom to a carbon atom.

Examples of charge generating materials having an aminobiphenyl structure used in the present invention are represented by the following General Formulas 8 and 9:

General Formula 8

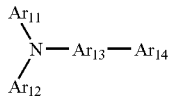

where $Ar_{11}$, $Ar_{12}$, $Ar_{13}$ and $Ar_{14}$ are substituted or unsubstituted aromatic hydrocarbon groups, and $Ar_{11}$ to $Ar_{14}$ are optionally bonded with an adjacent substituent to form heterocyclic rings.

General Formula 9

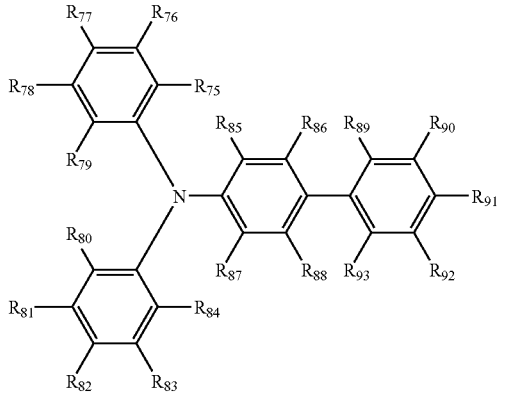

where $R_{75}$ to $R_{93}$ are hydrogen atoms, substituted or unsubstituted alkyl groups having 1 to 4 carbon atoms, or substituted or unsubstituted aromatic hydrocarbon groups, $R_{75}$ to $R_{93}$ are optionally bonded with an adjacent substituent to form heterocyclic rings, and $R_{75}$ to $R_{93}$ are optionally directly bonded to a carbon atom, or bonded via an alkylene group or hetero atom to a carbon atom.

Examples of charge generating materials having a benzidine structure used in the present invention are represented by the following General Formulas 10 and 11:

General Formula 10

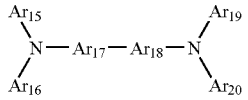

where $Ar_{15}$ to $Ar_{20}$ are substituted or unsubstituted aromatic hydrocarbon groups, and $Ar_{15}$ to $Ar_{20}$ are optionally bonded with an adjacent substituent to form heterocyclic rings.

General Formula 11

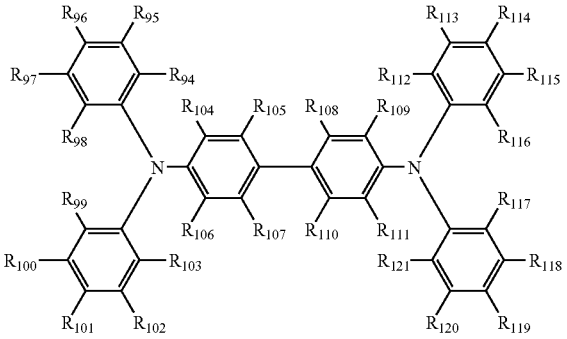

$R_{94}$ to $R_{121}$ hydrogen atoms, substituted or unsubstituted alkyl groups having 1 to 4 carbon atoms, or substituted or unsubstituted aromatic hydrocarbon groups, $R_{94}$ to $R_{121}$ are optionally bonded with an adjacent substituent to form a heterocyclic ring, and $R_{94}$ to $R_{121}$ are optionally directly bonded to a carbon atom, or bonded via an alkylene group or hetero atom to a carbon atom.

For the above alkyl group, it preferably has 1 to 4 carbon atoms, and examples thereof include a methyl group, ethyl group, propyl group, and butyl group. Examples of the aromatic hydrocarbon groups include a phenyl group, naphthyl group, anthryl group, phenanthryl group, pyrenyl group, thiophenyl group, furyl group, pyridyl group, quinolyl group, benzoquinolyl group, Carbazolyl group, phenothiazinyl group, benzofuryl group, benzothiophenyl group, dibenzofuryl group and dibenzothiophenyl group. The above groups may be substituted by the following substituents, for example, halogen atoms such as a fluorine, chlorine, bromine and iodine; alkyl groups such as a methyl group, ethyl group, propyl group and butyl group; aryl groups such as a phenyl group, naphthyl group, anthryl group and pyrenyl group; aralkyl groups such as a benzyl group, phenyl group, naphthylmethyl group, furfuryl group and thienyl group; alkoxy groups such as a methoxy group, ethoxy group and propoxy group; aryloxy groups such as a phenoxy group and naphthoxy group; substituted amino groups such as a dimethylamino group, diethylamino group, dibenzylamino group, diphenylamino group; arylvinyl groups such as a styryl group and naphthylvinyl group; nitro groups, cyano groups, hydroxyl groups and the like. Examples of the hetero atoms include an oxygen atom and sulfur atom.

Specific examples of the stilbenes are as follows:

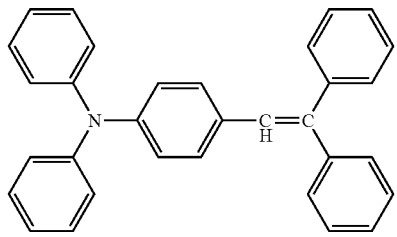

-continued
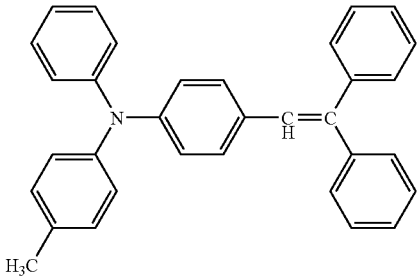
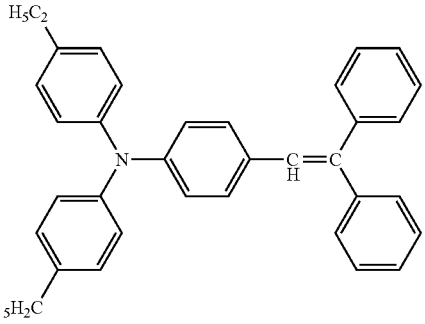
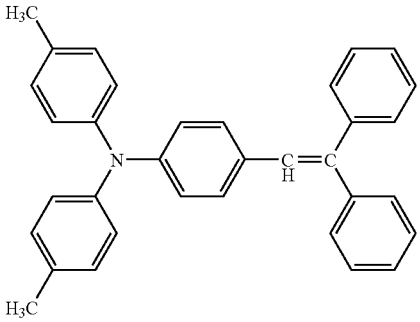
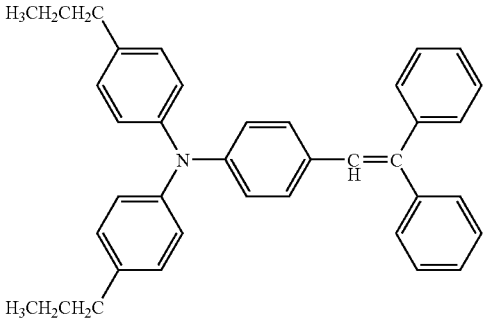
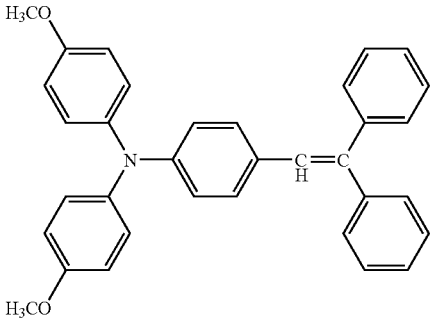
-continued
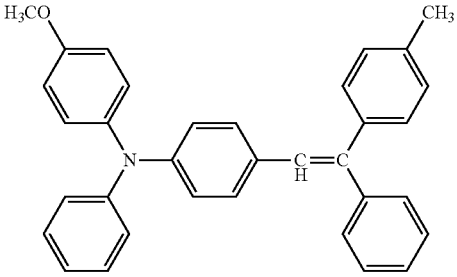
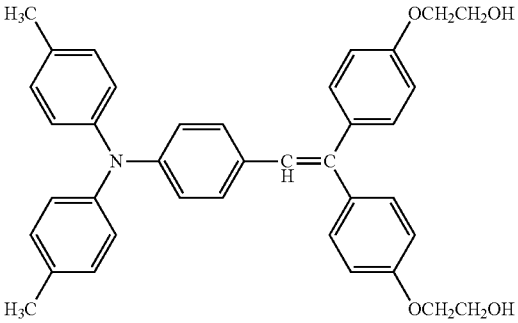
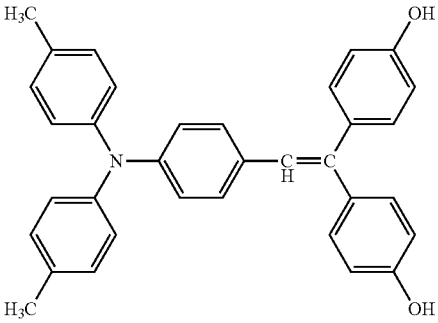
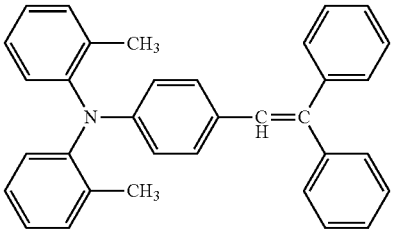
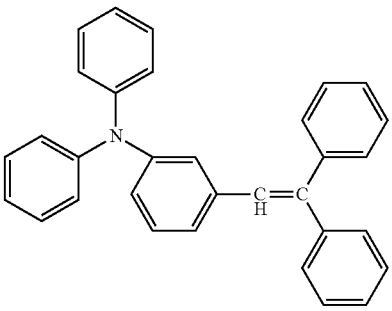

-continued
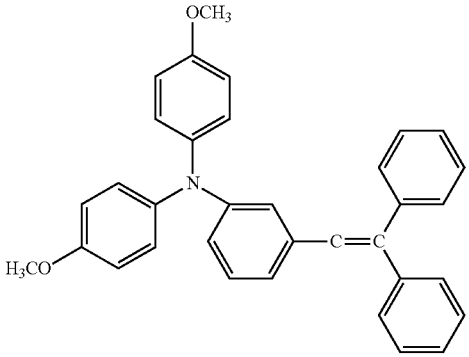
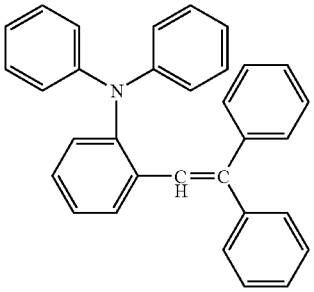
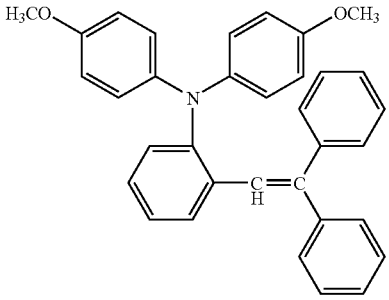
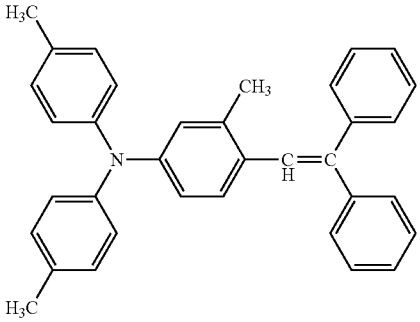
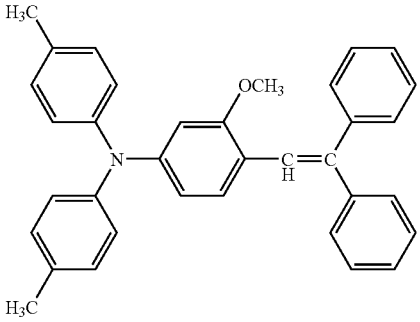
-continued
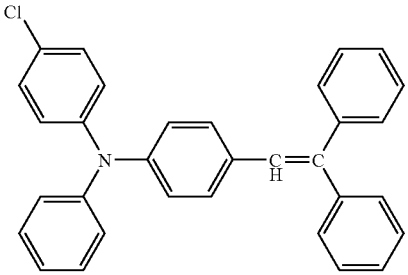
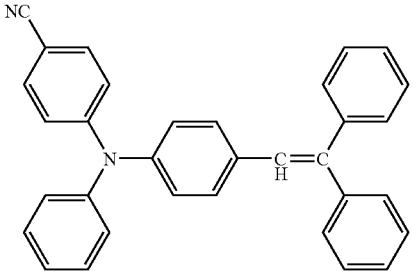
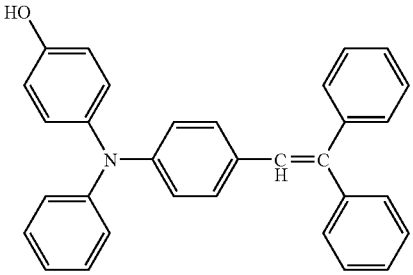
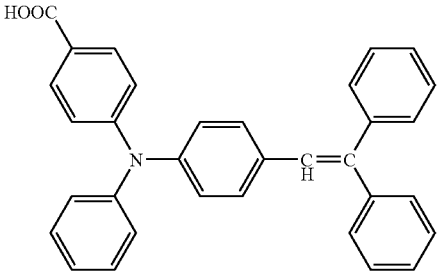
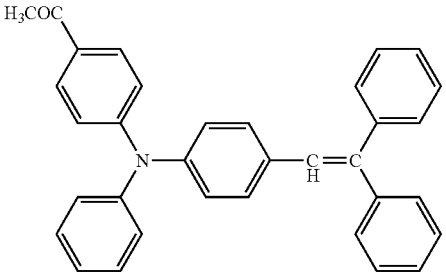
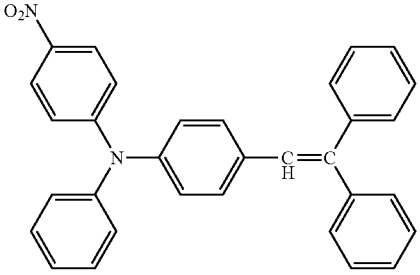

-continued
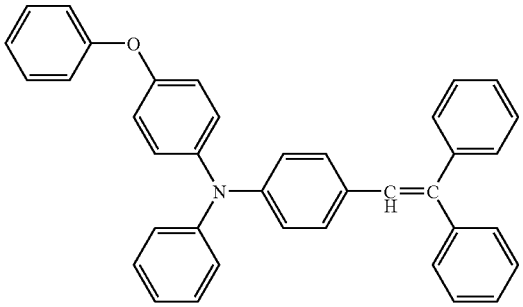
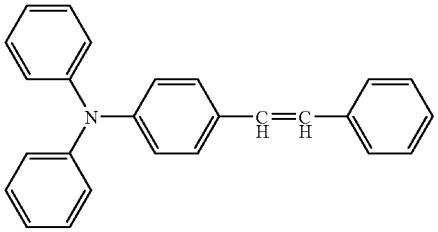
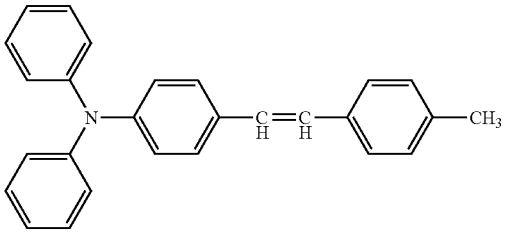
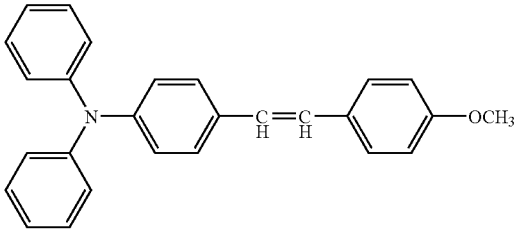
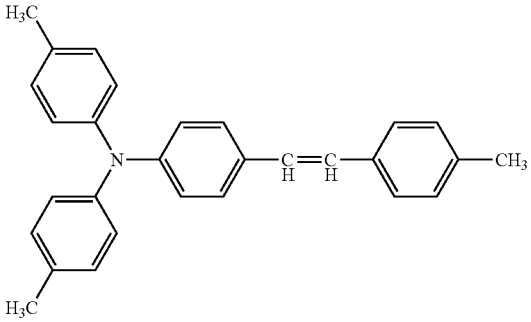
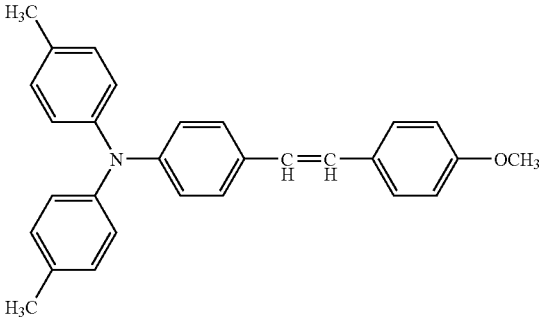
-continued
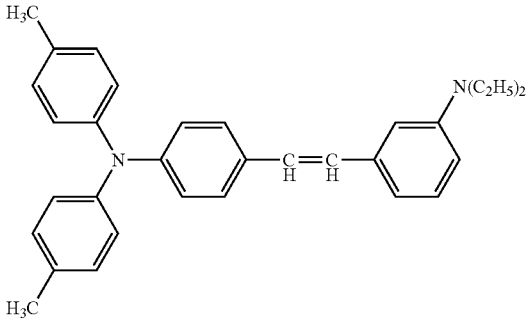
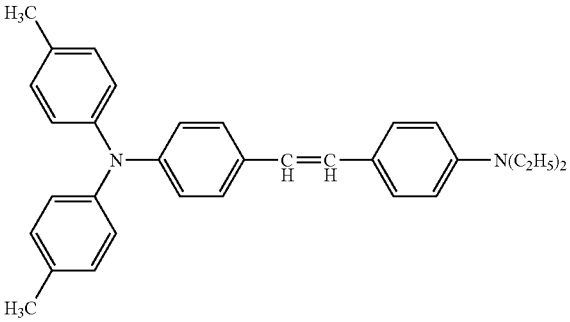
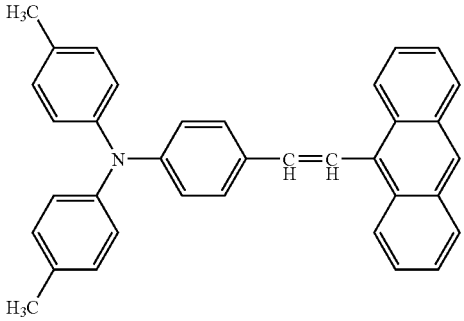
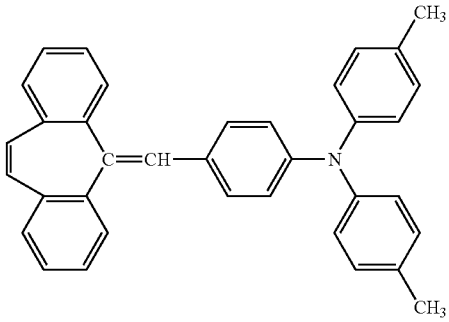
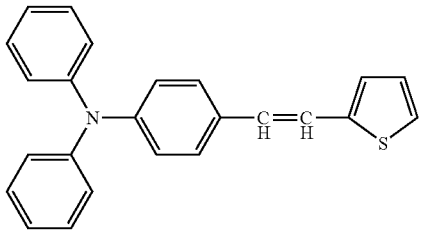

-continued
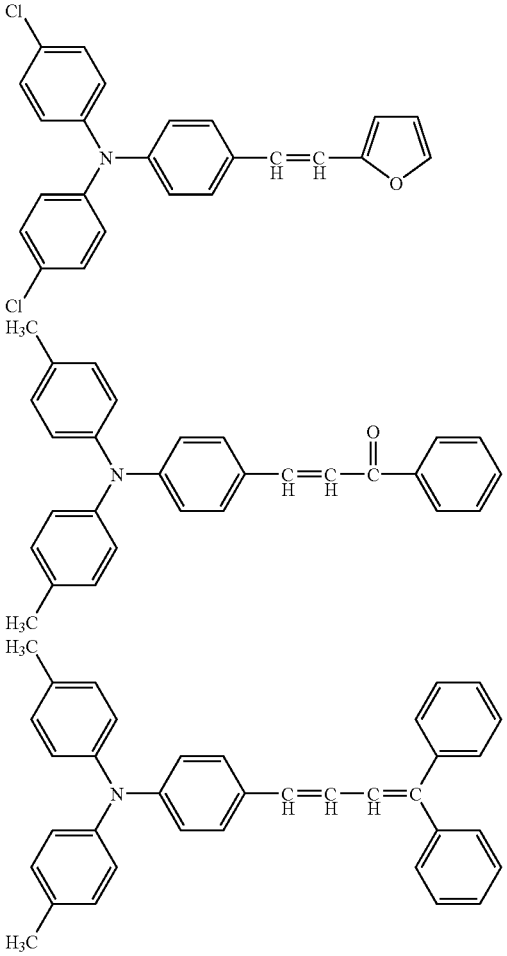
-continued
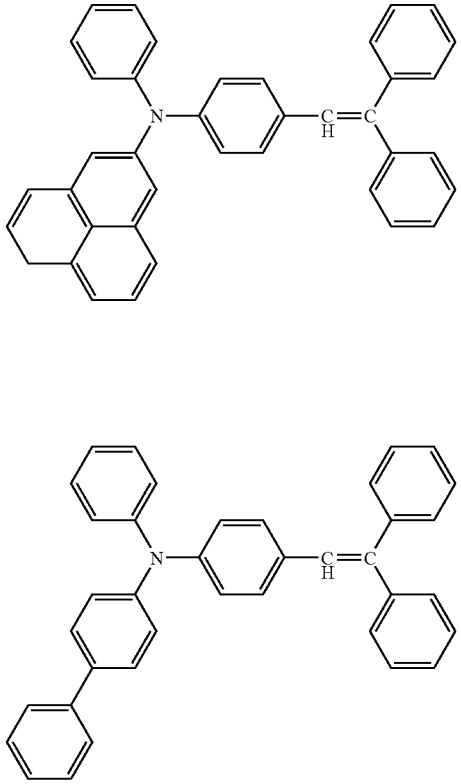
Specific examples of the distyrylbenzenes are as follows:
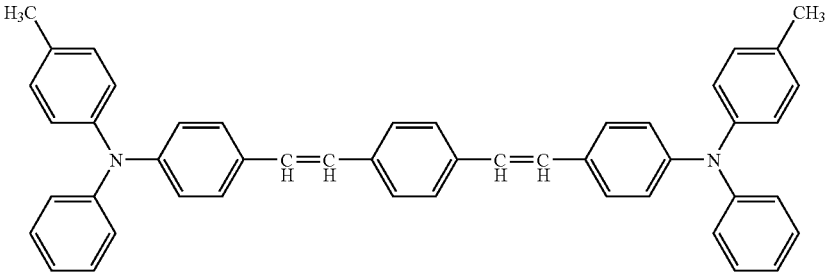
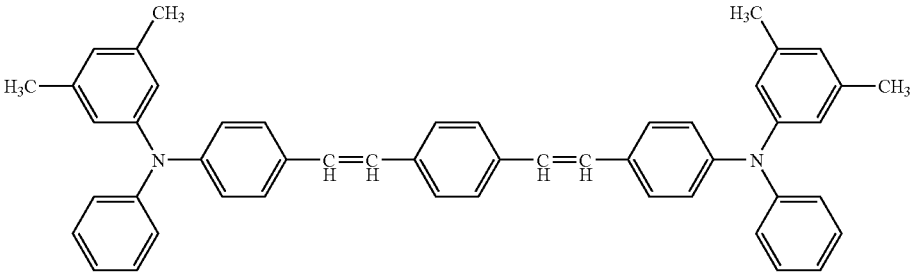

-continued
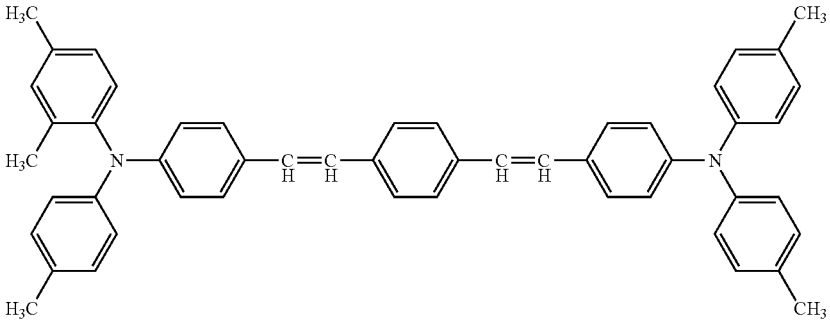
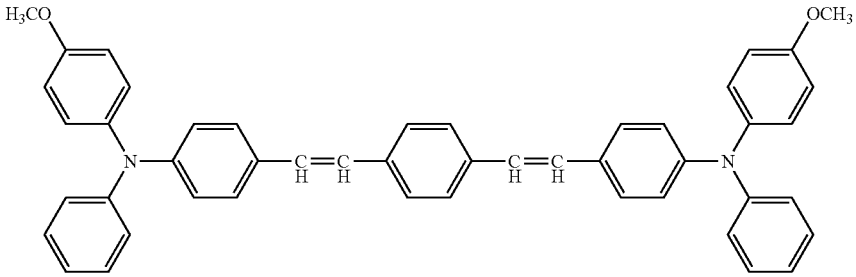
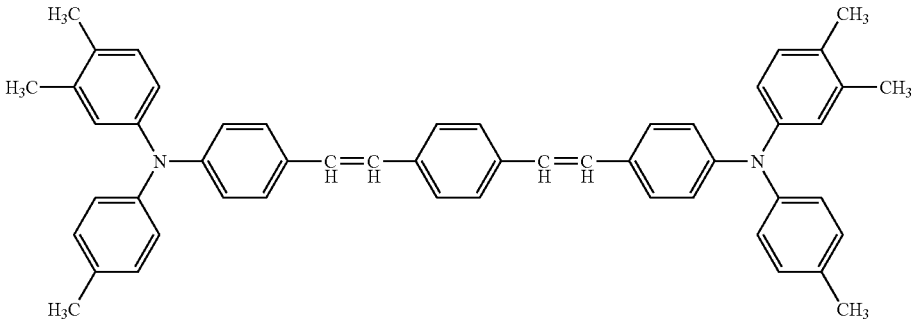
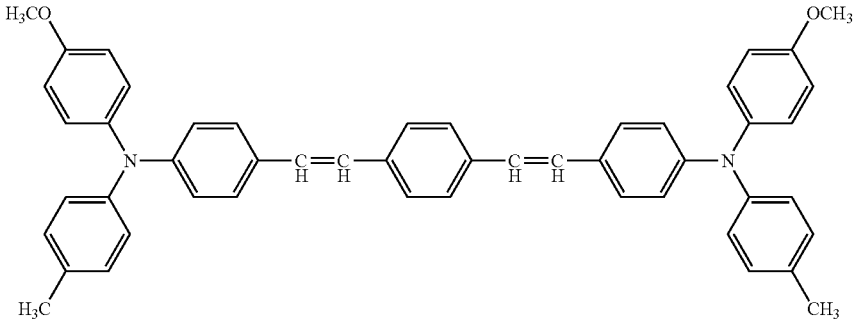
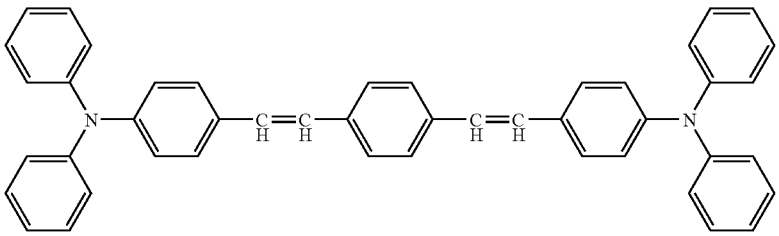
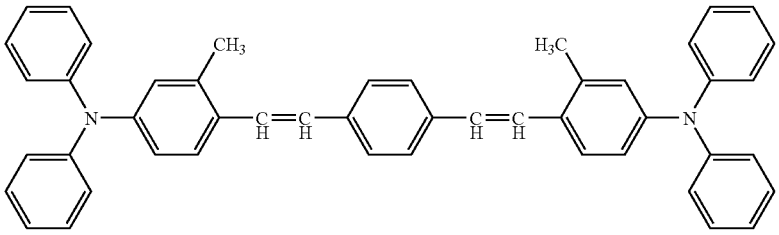

-continued
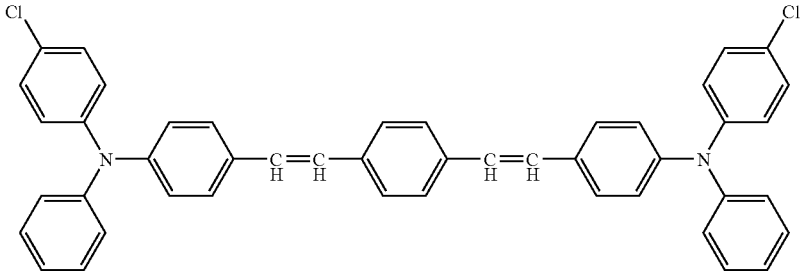
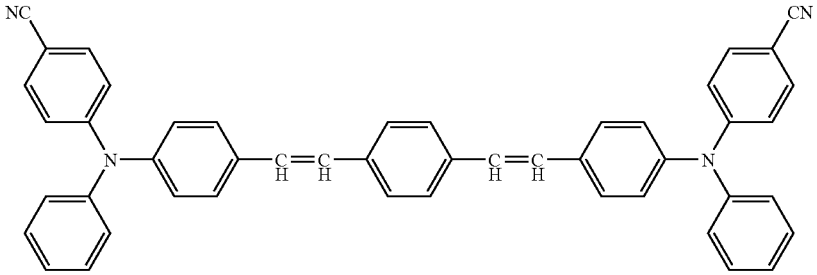
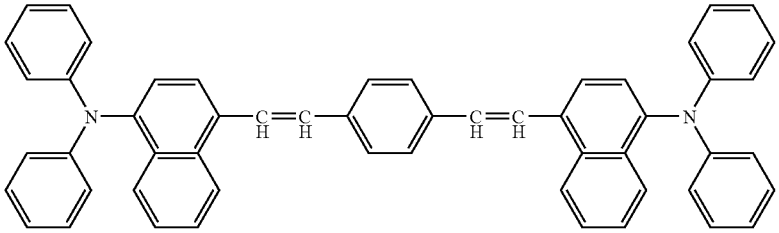
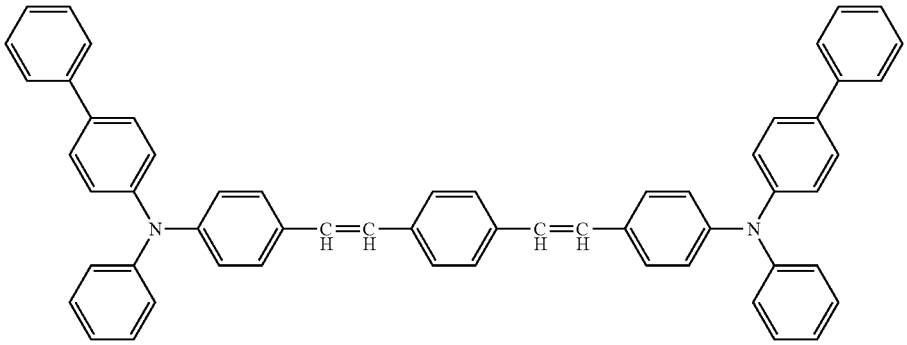
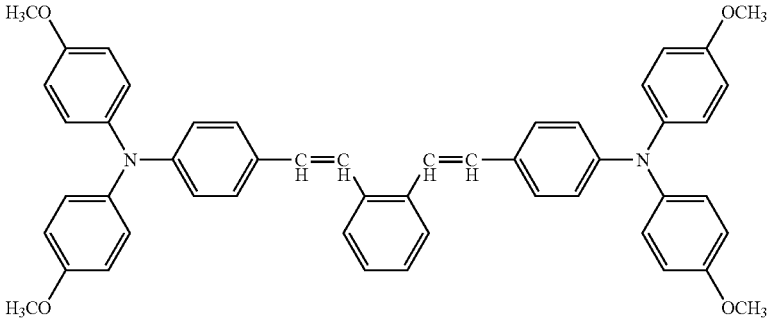

-continued
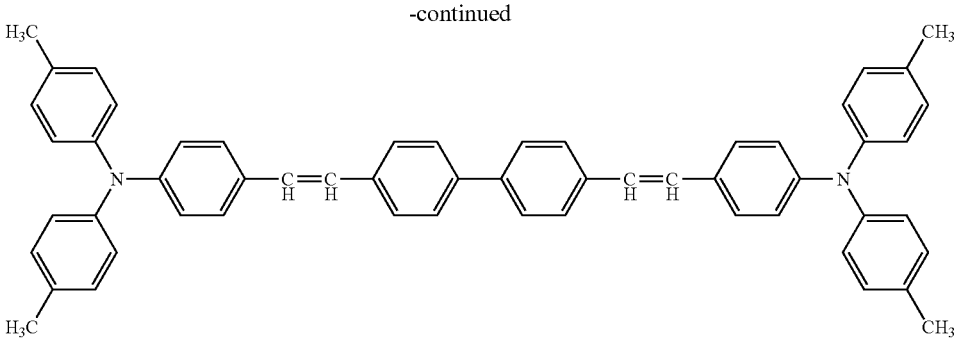
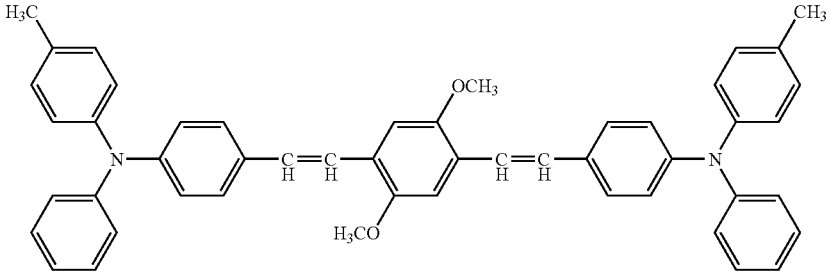
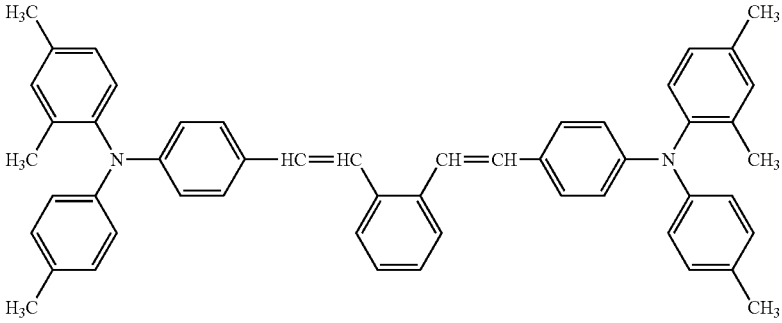
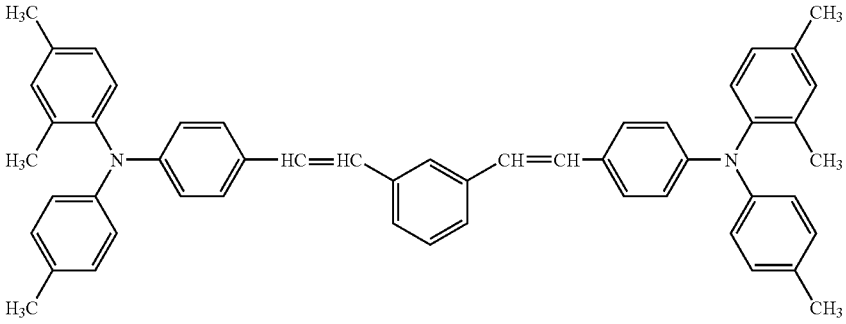
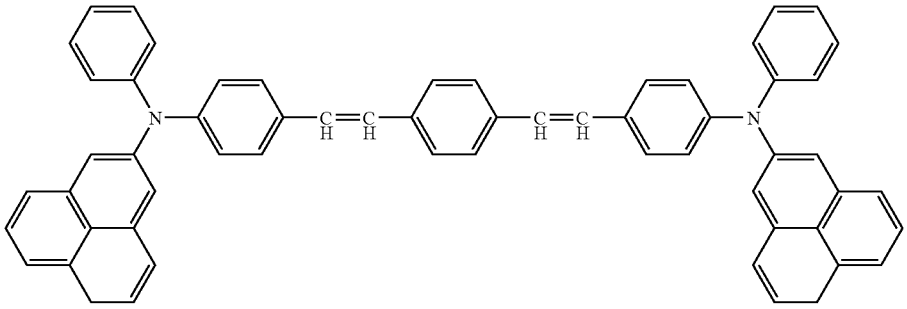

Specific examples of the aminobiphenyls are as follows:
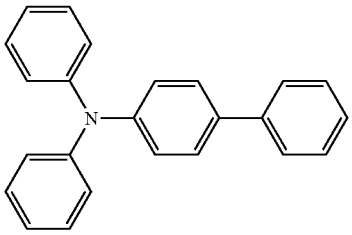
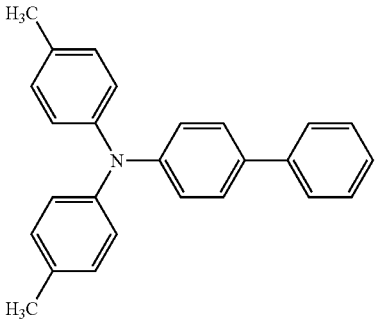
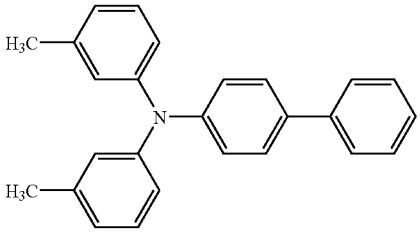
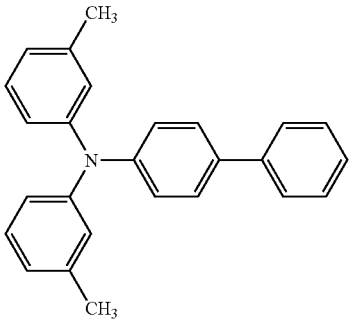
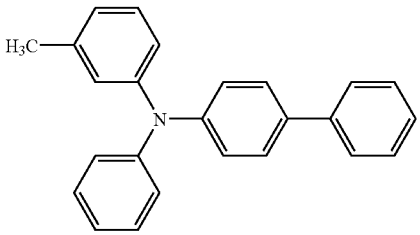
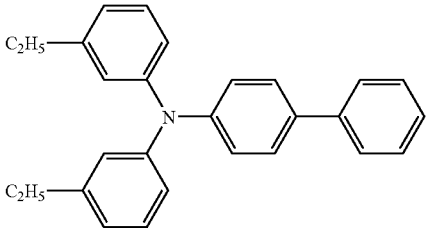
-continued
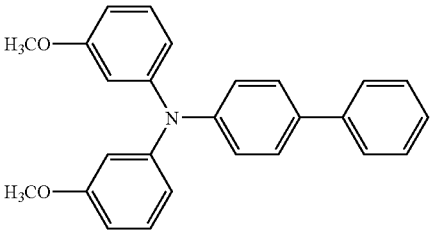
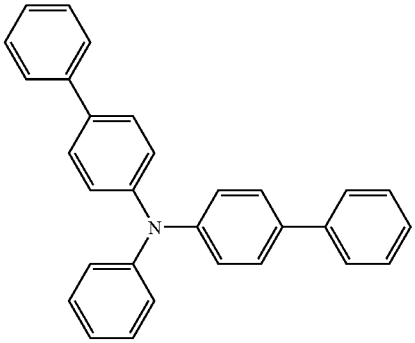
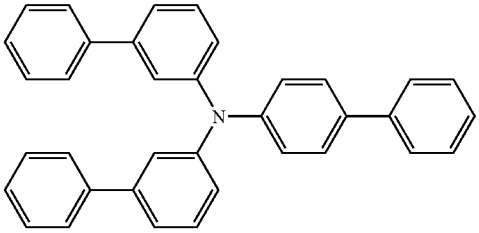
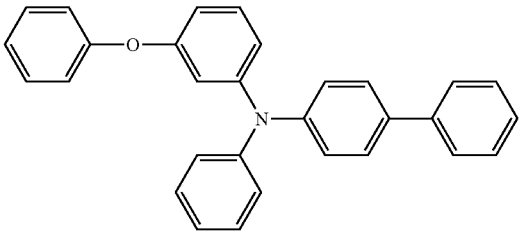
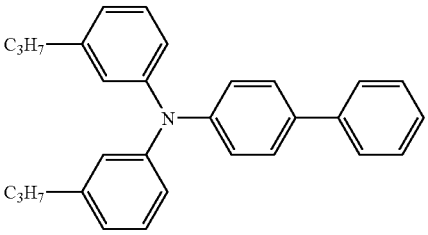
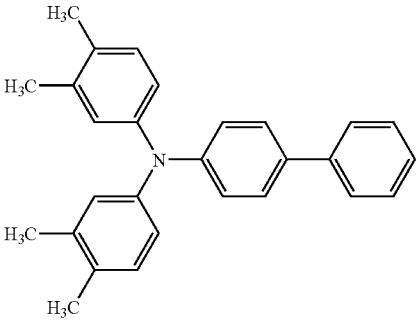

-continued
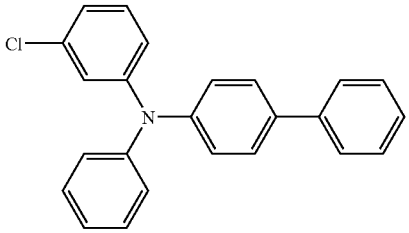
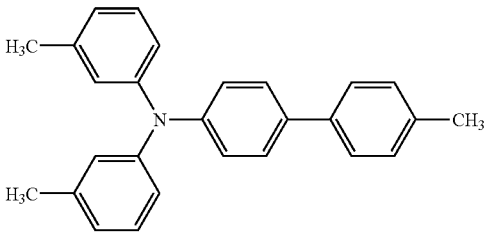
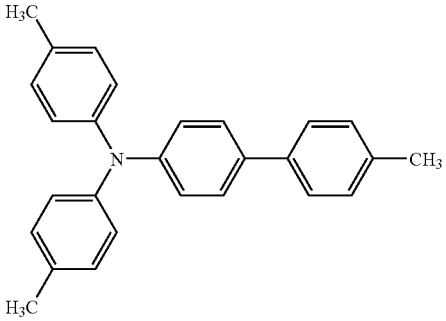
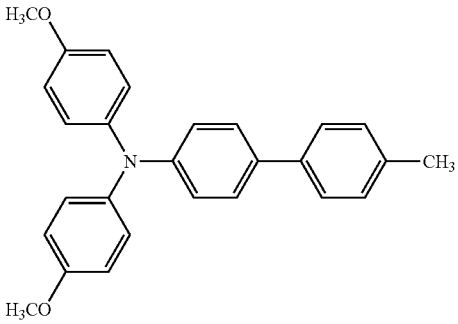
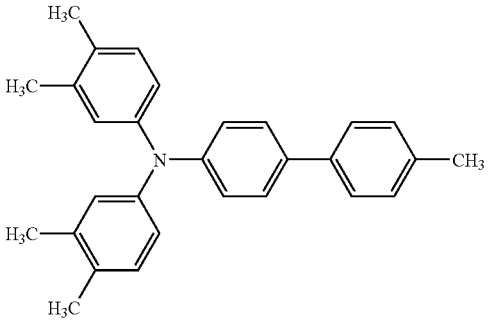
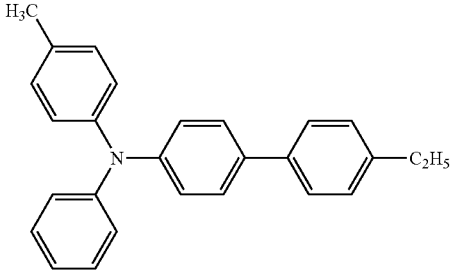
-continued
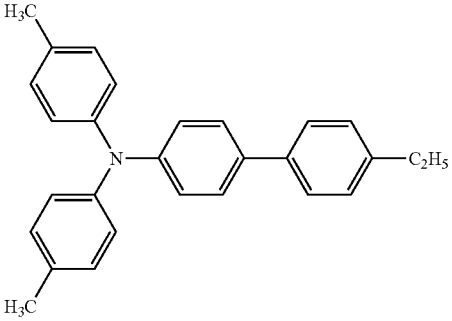
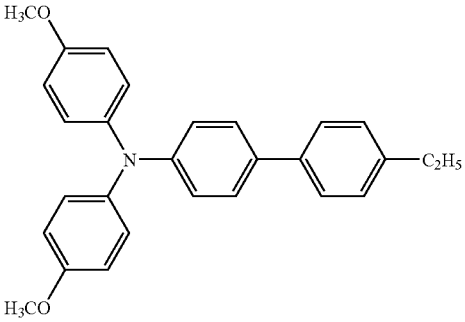
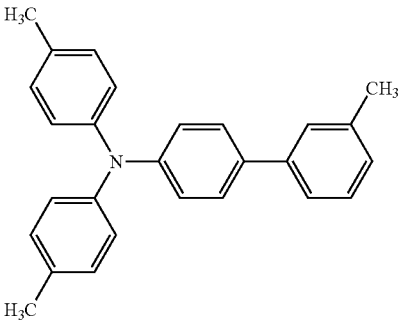
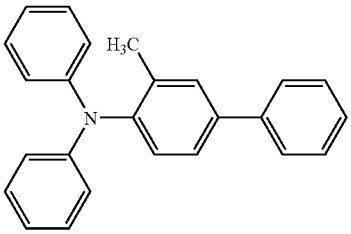
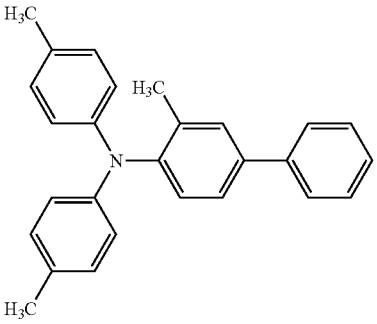

-continued
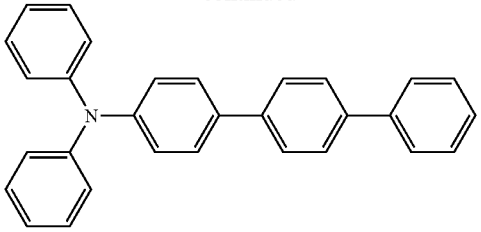
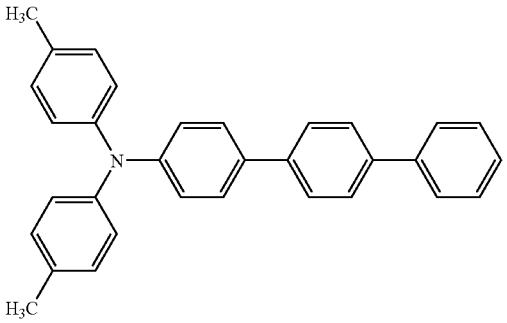
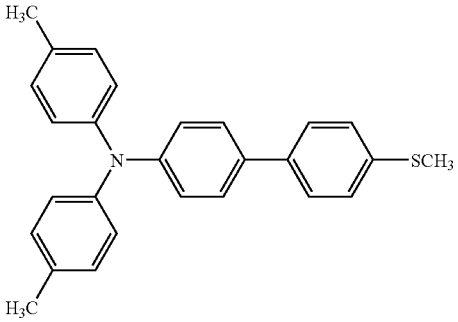
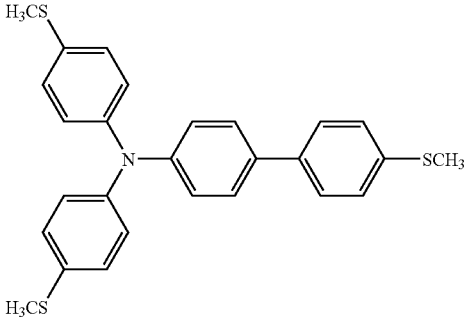
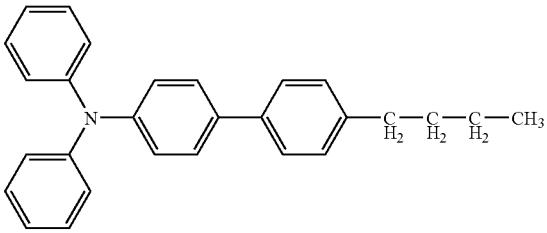
-continued
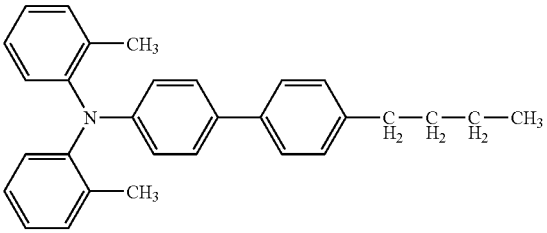
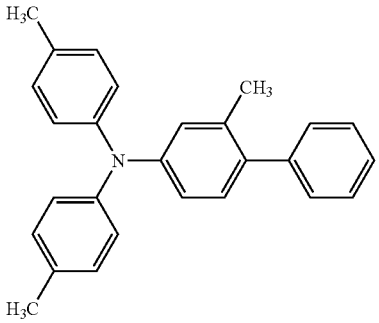
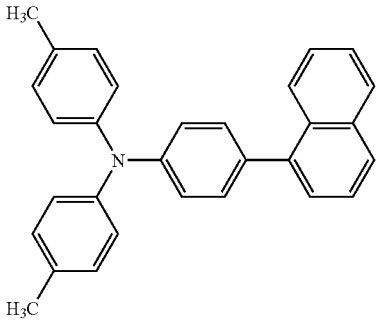
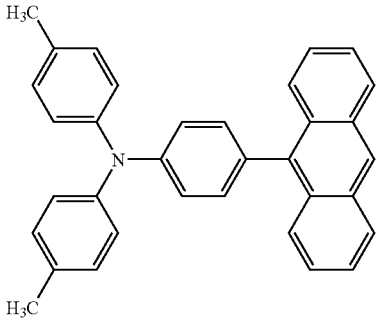
Specific examples of the benzidines are as follows:
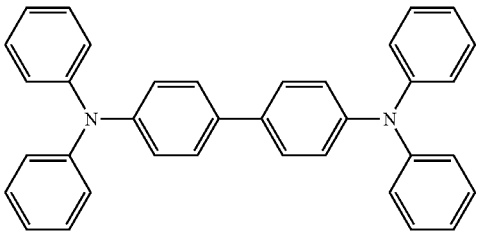
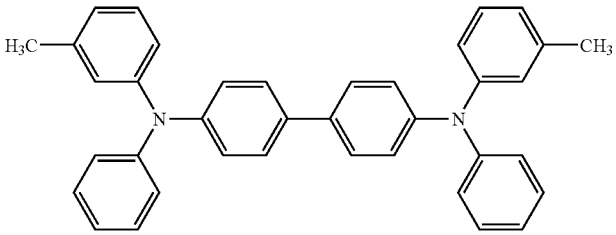

-continued
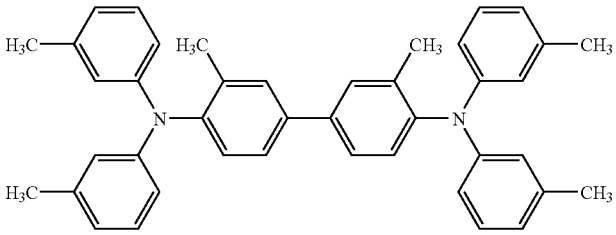
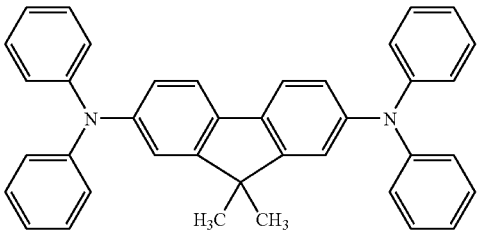
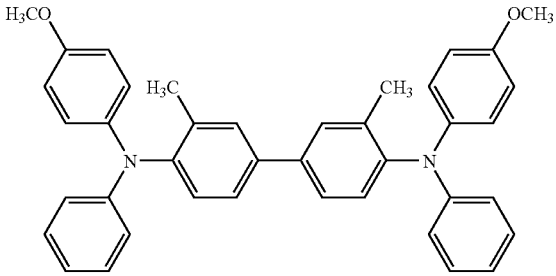
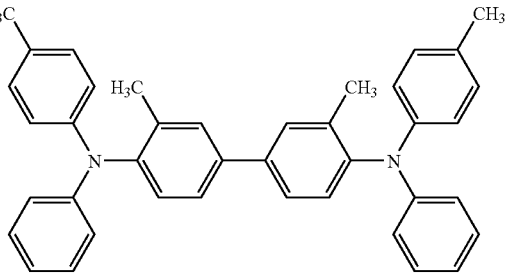
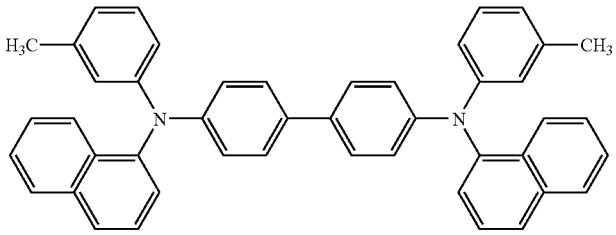
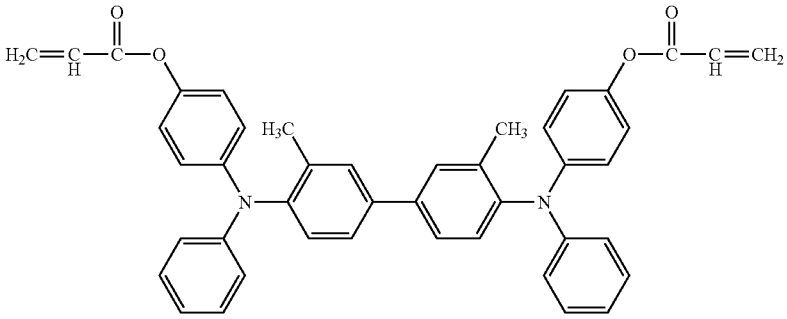
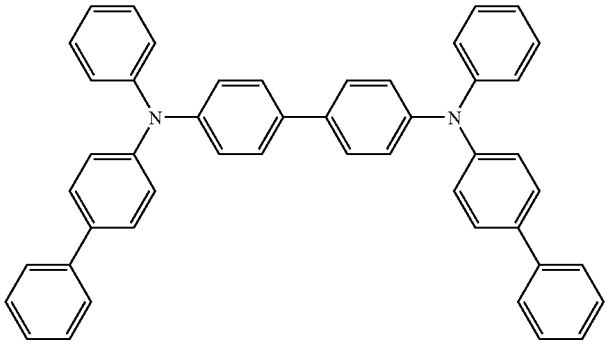
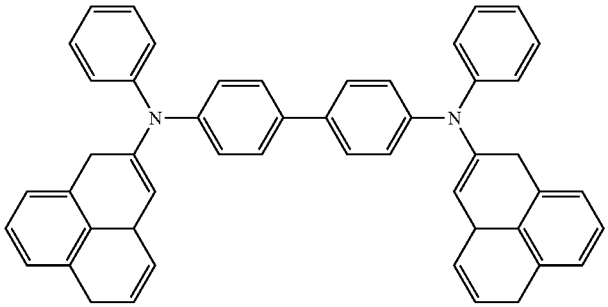

-continued

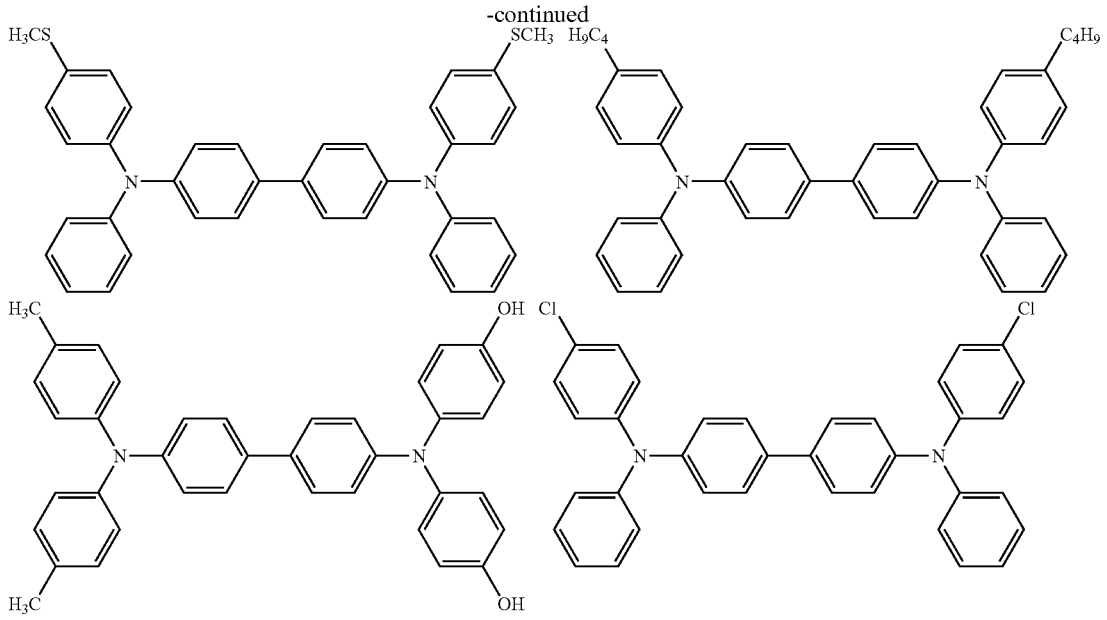

These charge transporting materials are conventionally known ones, and the stilbene compounds are disclosed in Japanese Patent Application Publication (JP-B) Nos. 03-39306 and 63-19867, the distyrylbenzene compounds are disclosed in Japanese Patent Application Laid-Open (JP-A) No. 50-16538 and Japanese Patent (JP-B) No. 2552695, the aminobiphenyl compounds are disclosed in JP-B No. 2753582, and the benzidine compounds are disclosed in JP-B No. 58-32372.

Examples of the binder resins used for forming the charge transporting layer include thermoplastic or thermosetting resins such as a polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyd resin.

Examples of the solvent used for forming the charge transporting layer include tetrahydrofuran, dioxane, toluene, cyclohexanone, methyl ethyl ketone, xylene, acetone, diethyl ether and methyl ethyl ketone. These solvents may be used alone, or in combination of two or more.

When the magnetic field is applied to the photoconductor after the coating liquid for the charge transporting layer is coated, the charge transporting layer preferably contains large amount of residual solvent using a low volatile solvent. This is because the layer having the higher fluidity may be effective when the magnetic field is applied to the photoconductor.

The charge transporting layer preferably has a thickness of 15 μm to 50 μm, and more preferably 20 μm to 30 μm.

Next, the photoconductor layer having a single layer configuration will be explained.

The photoconductor is achieved to contain the charge generating ability and charge transporting ability in a single layer by dispersing and dissolving the above-described charge generating material and charge transporting material in the binder resin.

The charge generating material, charge transporting material and binder resin are dispersed and dissolved in solvents such as tetrahydrofuran, dioxane, dichloroethane, methyl ethyl ketone, cyclohexane, cyclohexanone, toluene, xylene and coated by known methods such as impregnation coating, spray coating, bead coating, or ring coating so as to form the photosensitive layer. In the present invention, the magnetic field is applied to the photoconductor either during or after formation of the photosensitive layer.

The charge generating material preferably contains a positive hole transport material and an electron transport material. If required, a plasticizer, levelling agent and antioxidant can be also added.

As for the charge generating materials, charge transporting materials, binder resins, organic solvents and various additives used in the photosensitive layer of single layer, any materials contained in the above-described charge generating layer and charge transporting layer can be used.

For the binder resin, the binder resins exemplified in the charge generating layer may be mixed in addition to the binder resins exemplified in the charge transporting layer. The amount of the charge generating material is preferably 5 parts by mass to 40 parts by mass, and more preferably 10 parts by mass to 30 parts by mass on the basis of 100 parts by mass of the binder resin. The amount of the charge transporting material is preferably 0 part by mass to 190 parts by mass, and more preferably 50 parts by mass to 150 parts by mass. The photosensitive layer preferably has a thickness of 5 parts by mass to 40 parts by mass, and more preferably 10 parts by mass to 30 parts by mass.

In the present invention, the protective layer may be disposed on the outermost surface layer of the photoconductor to improve wear resistance. Examples of the protective layers include a polymer charge transporting material protective layer in which a charge transport component and a binder component are polymerized, and a filler-dispersed protective layer containing fillers, and a cured protective layer. Any known protective layers may be used in the present invention.

In the photoconductor of the present invention, the undercoat layer can be disposed between the conductive substrate and the charge generating layer. The undercoat layer generally primarily contains a resin, and the resin having high solvent resistance to common organic solvents is preferably used, considering a photosensitive layer is formed by coating the solvent thereon.

Examples of the resins include water-soluble resins such as polyvinyl alcohol, casein, sodium polyacrylate, alcohol-soluble resins such as copolymer nylon and methoxymethylated nylon, and curing resins which form a three-dimensional network such as polyurethane, melamine resins, phenol resins, alkyd-melamine resins, isocyanate and epoxy resins. Also, metal oxide fine powder pigments such as titanium oxide, silica, alumina, zirconium oxide, tin oxide or indium oxide may be also added to the undercoat layer to prevent Moire patterns, and to reduce residual potential.

The undercoat layers can be formed using a suitable solvent and coating method as the above-mentioned photosensitive layer.

Additionally, a silane coupling agent, titanium coupling agent, chromium coupling agent and the like can be used as the undercoat layer used in the present invention.

$Al_2O_3$ prepared by anodic oxidation, organic materials such as polyparaxylylene (parylene) and inorganic materials such as $SiO_2$, $SnO_2$, $TiO_2$, ITO, $CeO_2$ prepared by the vacuum thin film-forming method, can be used for the undercoat layer of the present invention. Other known materials may also be used. The undercoat layer preferably has a thickness of 0 μm to 10 μm, and more preferably 2 μm to 6 μm.

In the photoconductor of the present invention, an interlayer can be disposed between the conductive substrate and the undercoat layer, or between the undercoat layer and the charge generating layer.

The interlayer generally contains a binder resin. Examples of the binder resins include polyamide, alcohol-soluble nylon, water-soluble polyvinyl butyral, polyvinyl butyral and polyvinyl alcohol. The interlayer may be formed by any of the coating methods generally used as described above. The interlayer preferably has a thickness of 0.05 μm to 2 μm.

In the present invention, to improve environmental resistance and in particular to prevent reduction of sensitivity and increase of residual potential, an antioxidant, a plasticizer, a lubricant, an ultraviolet absorber, a low molecular mass charge transporting material and a levelling agent can be added to at least one selected from the charge generating layer, charge transporting layer, undercoat layer, protective layer and interlayer. Examples of materials of these compounds are given below.

Examples of the antioxidants which may be added to each layer are as follows, but not limited thereto:

(a) Phenol Compounds 2,6-di-t-butyl-p-cresol, butylated hydroxyanisole, 26-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl) butylic acid]glycol ester and tocopherols.

(b) Paraphenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine.

(c) Hydroquinones 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone and 2-(2-octadecenyl-5-methyl hydroquinone.

(d) Organosulfur Compounds

Dilauryl-3,3'-thiodipropionate, distearyl-3,3'-thiodipropionate and ditetradecyl-3,3'-thiodipropionate.

(e) Organophosphorus Compounds

Triphenylphosphine, tri(nonylphenyl)phosphine, tri(dinonylphenyl)phosphine, tricresylphosphine and tri(2,4-dibutylphenoxy)phosphine.

Examples of the plasticizers which may be added to each layer are as follows, but not limited thereto:

(a) Phosphate Plasticizers

Triphenyl phosphate, tricresyl phosphate, trioctyl phosphate, octyldiphenyl phosphate, trichlorethyl phosphate, cresyldiphenyl phosphate, tributyl phosphate, tri-2-ethylhexyl phosphate and triphenyl phosphate.

(b) Phthalate Ester Plasticizers

Dimethyl phthalate, diethyl phthalate, diisobutyl phthalate, dibutyl phthalate, diheptyl phthalate, di-2-ethyl hexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloctyl phthalate, octyldecyl phthalate, dibutyl fumarate and dioctyl fumarate.

(c) Aromatic Carboxylic Acid Ester Plasticizers

Trioctyl trimellitate, tri-n-octyl trimellitate and octyl oxybenzoate.

(d) Aliphatic Dibasic Acid Ester Plasticizers

Dibutyl adipate, di-n-hexyl adipate, di-2-ethylhexyl adipate, di-n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate and di-n-octyl tetrahydrophthalate.

(e) Fatty Acid Ester Derivatives

Butyl oleate, glycerol monochrome oleate, acetyl methyl ricinoleate, pentaerythritol ester, dipentaerythritol hexaester, triacetin and tributylene.

(f) Oxyacid Ester Plasticizers

Acetyl methyl ricinoleate, acetyl butyl ricinoleate, butyl phthalyl butyl glycolate and acetyl tributyl citrate.

(g) Epoxy Plasticizers

Epoxidized soybean oil, epoxidized flaxseed oil, epoxy butyl stearate, epoxy decyl stearate, epoxy octyl stearate, epoxy benzyl stearate, epoxy dioctyl hexahydrophthalate and epoxy didecyl hexahydrophthalate.

(h) Dihydric Alcohol Ester Plasticizers

Diethylene glycol dibenzoate and triethylene glycol di-2-ethyl butyrate.

(i) Chlorine-Containing Plasticizers

Chlorinated paraffin, chlorinated diphenyl, chlorinated methyl fatty acids and methoxychlorinated methyl fatty acids.

(j) Polyester Plasticizers

Polypropylene adipate, polypropylene sebacate, polyester and acetylated polyester.

(k) Sulfonic Acid Derivatives p-toluenesulfonamide, o-toluenesulfonamide, p-toluene sulfone ethylamide, o-toluene sulfone ethyl amide, toluene sulfone-N-ethylamide and p-toluene sulfone-N-cyclohexylamide.

(l) Citric Acid Derivatives

Triethyl citrate, acetyl triethyl citrate, tributyl citrate, acetyl tributyl citrate, acetyl tri-2-ethylhexyl citrate and acetyl n-octyldecyl citrate.

(m) Other

Terphenyl, partially hydrated terphenyl, camphor, 2-nitrodiphenyl, dinonylnaphthalene and methyl abietate.

Examples of the lubricants which may be added to each layer are as follows, but not limited thereto:

(a) Hydrocarbon Compounds

Liquid paraffin, paraffin wax, micro wax and low polymer polyethylene.

(b) Fatty Acid Compounds

Lauric acid, myristic acid, palmitic acid, stearic acid, arachidic acid and behenic acid.

(c) Fatty Acid Amide Compounds

Stearyl amides, palmityl amides, olein amides, methylene bis-stearyl amides and ethylene bis-stearoamides.

(d) Ester Compounds

Lower alcohol esters of fatty acids, polyhydric alcohol esters of fatty acids and fatty acid polyglycol esters.

(e) Alcohol Compounds

Cetyl alcohol, stearyl alcohol, ethylene glycol, polyethylene glycol and polyglycerol.

(f) Metal Soaps

Lead stearate, stearic acid cadmium, barium stearate, calcium stearate, zinc stearate and magnesium stearate.

(g) Natural Wax

Carnauba wax, candelilla wax, beeswax, spermaceti wax, Chinese wax and montan wax.

(h) Other

Silicone compounds and fluorine compounds.

Examples of the ultraviolet absorbers which may be added to each layer are as follows, but not limited thereto:

(a) Benzophenones 2-hydroxybenzophenone, 2,4-dihydroxybenzophenone, 2,2',4-trihydroxybenzophenone, 2,2'4,4'-tetrahydroxybenzophenone and 2,2'-dihydroxy-4-methoxybenzophenone.

(b) Salicylates

Phenylsalicylate, 2,4-di-t-butylphenyl and 3,5-di-t-butyl-4-hydroxybenzoate.

(c) Benzotriazoles (2'-hydroxyphenyl)benzotriazole, (2'-hydroxy-5'-methylphenyl)benzotriazole, (2'-hydroxy-5'-methylphenyl)benzotriazole and (2'-hydroxy-3'-tert-butyl-5'-methylphenyl)-5-chlorobenzotriazole.

(d) Cyanoacrylates

Ethyl-2-cyano-3,3-diphenylacrylate and methyl-2-carbomethoxy-3-(p-methoxy) acrylate.

(e) Quenchers (Metal Complexes)

Nickel (2,2'-thiobis(4-t-octyl)phenolate), nickel dibutyl dithiocarbamate, nickel dibutyl dithiocarbamate and cobalt dicyclohexyldithiophosphate.

(f) HALS (Hindered Amines)

Bis-(2,2,6,6-tetramethyl-4-piperidyl) sebacate, bis-(12,2,6,6-pentamethyl-4-piperidyl) sebacate, 1-[2-[3-(3,5-di-t-butyl-4-hydroxyphenyl) propionyloxy]ethyl]-4-[3-(3,5-di-t-butyl-4-hydroxyphenyl) propionyloxy]-2,2,6,6-tetramethylpyridine, 8-benzyl-7,7,9,9-tetramethyl-3-octyl-1,3,8-triazaspiro[4,5]undecane-2,4-dione and 4-benzoyl oxy-2,2,6,6-tetramethyl piperidine.

Hereinafter, the electrophotographic method and image forming apparatus of the present invention will be explained in details with reference to the drawings.

Figure 5:
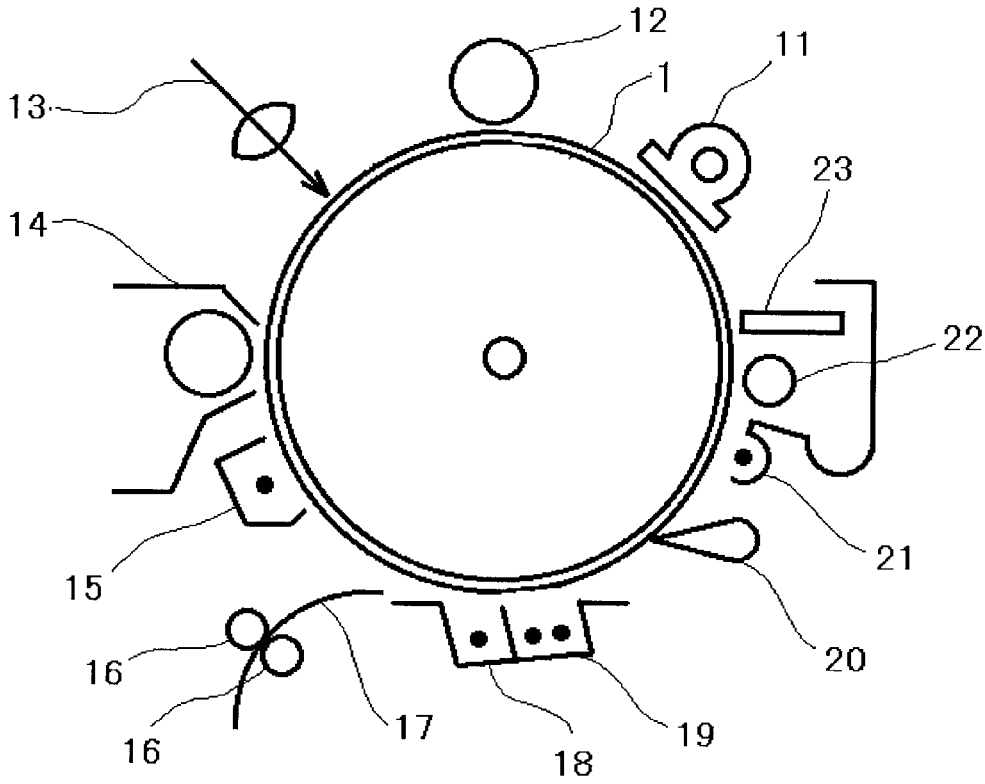
FIG. 5 is a view for illustrating an example of an electrophotographic process and an image forming apparatus of the present invention.

FIG. 5 is a schematic diagram showing the electrophotographic process and image forming apparatus of the present invention, and the following examples are also within the scope of the present invention.

As shown in FIG. 5, a photoconductor 1 is drum-shaped, and may also be sheet-shaped or endless belt shaped. Any known chargers such as a corotron, a scorotron, a solid state charger, and a roller or brush-like charging unit can be used for a charger 12, a pre-transferring charger 15, a transferring charger 18, a separation charger 19 and a pre-cleaning charger 21.

Examples of the charging systems include a non-contact charging system such as corona charging, and a contact charging system using a roller or brush. Both systems can be effectively used in the present invention. Particularly, a charging roller can significantly reduce amount of ozone generation compared to a corotron and scorotron, and is effectively used in stability and prevention of image deterioration when the photoconductor is repeatedly used.

However, as the photoconductor contacts the charging roller, the charging roller is contaminated by repeated use, and then it causes the photoconductor to promote generation of an abnormal image and poor wear resistance.

Particularly, the photoconductor is not easily refaced, specifically, filming on the photoconductor surface is not easily removed, when the photoconductor having high wear resistance is used. Thus, it is necessary to reduce the contamination of the charging roller.

Figure 6:
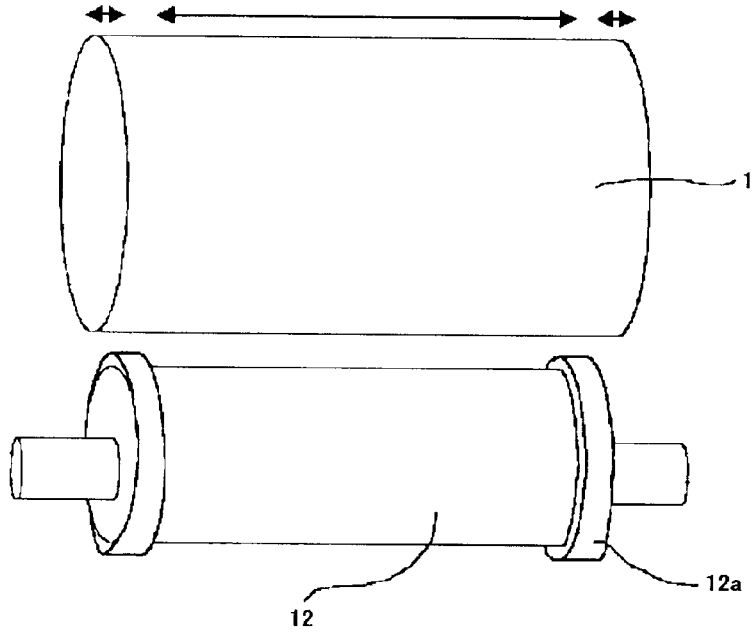
FIG. 6 is another view for illustrating an example of an electrophotographic process and an image forming apparatus of the present invention.

As shown in FIG. 6, a gap forming member 12*a* is disposed on a charger (charging roller) 12, in which a metal shaft is included and is closely arranged to a photoconductor 1 via a gap. As a result, the contaminant is not easily adhered to the charging roller or easily removed, so that the influence of the contaminant can be reduced. In this case, the gap between the photoconductor and the charging roller is preferably smaller, for example, preferably 100 μm or less, and more preferably 50 μm or less. A long two-headed arrow located in the center indicates an image-forming area, and two short two-headed arrows located at ends indicate non image-forming areas.

However, the charging roller adopting the noncontact system brings to uneven discharge, and the photoconductor may be unstably charged. An alternate current component is superposed on a direct current component so as to maintain the charge stability, and then the influences of ozone, charge property and contamination of the charging roller can be simultaneously reduced.

As for light sources such as an image exposing unit 13 and a charge-eliminating lamp 11, light emitters such as a fluorescent lamp, tungsten lamp, halogen lamp, mercury lamp, sodium lamp, light emitting diode (LED), semiconductor laser (LD), and electro luminescence (EL) may be employed. Of these, the semiconductor laser (LD) and light emitting diode (LED) are mainly used.

In order to irradiate light only at the desired spectral region, filters such as a sharply cutting filter, bandpass filter, near-infrared cutting filter, dichroicfilter, interference filter, and conversion filter for color temperature may be employed.

The light source irradiates the photoconductor 1 for providing a transfer step, charge-eliminating step, cleaning step or pre-exposing step and other steps in conjunction with light irradiation. However, the exposing the photoconductor 1 in the charge-eliminating step causes large fatigue effect in the photoconductor 1, and the charge reduction and rise of the residual electric potential may occur.

Therefore, the charge is eliminated not by exposing but by applying a reverse bias in the charging step or cleaning step, it is effectively used in terms of improving durability of the photoconductor.

When a positive charge is applied to the photoconductor 1 and image exposure is performed, a positive latent electrostatic image will be formed on the photoconductor surface. If the latent image is developed with a toner (charge detecting particles) of negative polarity, a positive image will be obtained, and a negative image will be obtained if the latent image is developed with a toner of positive polarity. On the other hand, when a negative charge is applied to the photoconductor 1 and image exposure is performed, a negative latent electrostatic image will be formed on the photoconductor surface. If the latent image is developed with a toner (charge detecting particles) of positive polarity, a positive image will be obtained, and a negative image will be obtained if the latent image is developed with a toner of negative polarity. The known methods are applied for the developing unit and the known methods are also used for the charge-eliminating unit.

For the transferring unit, known chargers can be generally used. As shown in FIG. 5, a combination of the transferring charger 18 and the separation charger 19 can be effectively used.

A toner image is directly transferred from the photoconductor to a paper by means of the transferring unit, however, in the present invention, it is more preferred that an intermediate transfer system in which a toner image on the photoconductor is once transferred to an intermediate transferring medium, and then transferred from the intermediate transferring medium to a paper in terms of improving the durability and image quality of the photoconductor.

Among the contaminant adhered to the photoconductor surface, electric discharge materials generated by charging, external additives contained in a toner and the like are affected by humidity, thereby causing an abnormal image. Additionally, paper powders are one of a material causing the abnormal image, and adhere to the photoconductor, causing that the wear resistance may be decreased and the uneven wear may occur as well as the abnormal image may easily occur. Therefore, the photoconductor is preferably configured not to directly contact the paper in terms of improving an image quality.

The intermediate transferring system is particularly useful for an image forming apparatus capable of full-color printing. A plurality of toner images once formed on the intermediate transferring medium, and then transferred to a paper simultaneously. Consequently, the prevention of color shift is easily controlled, and an image quality is effectively improved.

However, the durability of the photoconductor is a big issue because the intermediate transferring system needs to scan 4 times to obtain a sheet of a full-color image.

The photoconductor of the present invention can be easily, particularly effectively used and useful in combination with the image forming apparatus of the intermediate transferring system, because an image blur is not easily generated even without a drum heater.

There are various materials and shapes of the intermediate transferring medium, such as drum-shaped, belt-shaped and the like. In the present invention, any of conventional intermediate transferring mediums can be effectively used and useful for improving the durability and the image quality of the photoconductor.

The toners developed on the photoconductor 1 by a developing unit 14, are transferred to a transferring paper 17, but not all of them are transferred, and some toners remain on the photoconductor 1. The toners are removed from the photoconductor 1 by a fur brush 22 and blade 23.

Cleaning may also be performed only by the cleaning brush, or together with the blade. Examples of the cleaning brushes include any of those known such as a fur brush and magnetic fur brush.

Cleaning is a step for cleaning the remaining toners and the like on the photoconductor 1 after transferring as described above. The photoconductor 1 is repeatedly fractioned with the blade 23 or brush 22, and then the wear on the photoconductor 1 is accelerated or photoconductor 1 is scarred, thereby causing the abnormal image.

The photoconductor surface contaminated due to a cleaning failure leads to significant reduction of the life of the photoconductor as well as the generation of the abnormal image. Particularly, in the case of the photoconductor, in which a layer containing fillers is formed on the outermost surface in order to improve the wear resistance, the contaminant adhered on the photoconductor surface is not easily removed, and thereby accelerating the generation of the filming and abnormal image. Therefore, the improvement of the cleaning property of the photoconductor is very useful to improve the durability and image quality of the photoconductor.

As a method for improving cleaning property of the photoconductor, the method of decreasing friction coefficient of the photoconductor surface is known. The method of decreasing friction coefficient of the photoconductor surface is classified into a method of incorporating various lubricants into the photoconductor surface, and a method of externally supplying the lubricants to the photoconductor surface. In the former there is a lot of flexibility in a layout around an engine, the method is advantageously used in a small-diameter photoconductor, but the friction coefficient is significantly increased after repeated use. Thus, there is a problem in stability. Meanwhile, in the latter, a component serving for supplying the lubricant should be equipped, the method is effectively used to improve the durability of the photoconductor because of the high stability of the friction coefficient. Of these, a method of incorporating the lubricant into a developer so as to subject the lubricant to adhering to the photoconductor during developing is very useful to improve the durability and image quality of the photoconductor, because the layout around the engine is not limited, and the effect of the reduction of the friction coefficient of the photoconductor surface is highly kept.

Examples of the lubricants include lubricating liquids such as silicone oil and fluorine oil, various fluorine-containing resins such as PTFE, PFA and PVDF, silicone resins, polyolefin resins, silicone grease, fluorine grease, paraffin wax, fatty acid esters, fatty acid metallic salt such as zinc stearate; lubricating solids and powders such as graphite and molybdenum disulfide. When the lubricant is mixed with a developer, it should be the powder. The zinc stearate hardly adversely affects the developer, and is outstandingly effectively used. When the zinc stearate powder is added to the toner, the amount of the zinc stearate in the toner is preferably 0.01% by mass to 0.5% by mass, and more preferably 0.1% by mass to 0.3% by mass in view of the ratio and the effect on the toner.

The photoconductor of the present invention has the improved charge transporting ability and high sensitivity, and can be applied to a small diameter photoconductor. Therefore, an image forming apparatus and its system, in which the photoconductor is advantageously used, is a so-called tandem image forming apparatus, in which plural photoconductors are equipped corresponding to respective developing units which correspond to plural colors of toners, and perform parallel process. The tandem image forming apparatus contains developing units respectively containing at least four colors of toners of yellow (Y), magenta (M), cyan (C) and black (K), which are necessary for a full-color print, and correspondingly further contains at least four photoconductors corresponding thereto so as to achieve outstandingly higher-speed full-color printing, compared to the conventional full-color image forming apparatus.

Figure 7:
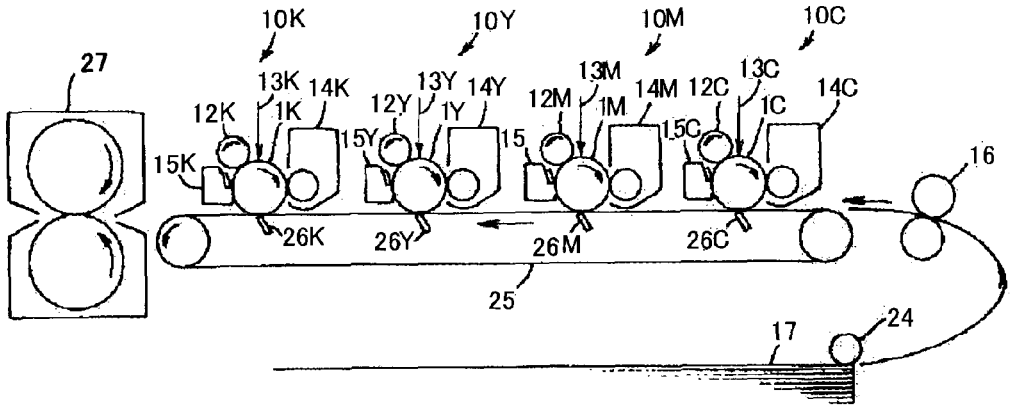
FIG. 7 is still another view for illustrating an example of an electrophotographic process and an image forming apparatus of the present invention.

FIG. 7 is a schematic diagram showing a tandem full-color electrophotographic apparatus, and the modifications described hereinafter are included in the present invention.

In FIG. 7, the photoconductors 1C (cyan), 1M (magenta), 1Y (yellow), and 1K (black) are drum-shaped photoconductors 1. The photoconductors 1C, 1M, 1Y, 1K rotate in the direction indicated by the arrows in FIG. 7, and charging units 12C, 12M, 12Y, 12K, developing units 14C, 14M, 14Y, 14K, and cleaning units 15C, 15M, 15Y, 15K are disposed around the photoconductors 1C, 1M, 1Y, 1K in the order of rotation. The charging units 12C, 12M, 12Y, 12K are arranged to uniformly charge the surfaces of the photoconductors 1.

From the back side of the photoconductors 1 between the charging units 12C, 12M, 12Y, 12K and developing units 14C, 14M, 14Y, 14K, laser lights 13C, 13M, 13Y, 13K are irradiated from exposing units (not shown), thereby latent electrostatic images are formed on photoconductors 1C, 1M, 1Y, 1K.

The four image forming units 10C, 10M, 10Y, 10K, of which the center are photoconductors 1C, 1M, 1Y, 1K respectively, are arranged in parallel along a transfer conveying belt 25 serving as a conveying unit for a transferring paper.

The transfer conveying belt 25 contacts with photoconductors 1C, 1M, 1Y, 1K between the developing units 14C, 14M, 14Y, 14K and the cleaning units 15C, 15M, 15Y, 15K of the respective image forming units 10C, 10M, 10Y, 10K, and transferring brushes 26C, 26M, 26Y, 26K are arranged at the rear side or rear face of the photoconductors 1 side of the transfer conveying belt 25 in order to apply transferring bias. The image forming units 10C, 10M, 10Y, 10K are substantially the same except that the colors in the developing units are different each other.

In the configuration of the color electrophotographic apparatus shown in FIG. 7, the image forming is achieved as follows. At first, photoconductors 1C, 1M, 1Y, 1K are charged by charging members 12C, 12M, 12Y, 12K rotating as the arrow direction, i.e. co-rotating direction with the photoconductors 1 in the respective image forming units 10C, 10M, 10Y, 10K, then the latent electrostatic images of the respective colors are formed by the laser lights 13C, 13M, 13Y, 13K irradiated from the light-exposing part disposed outside of the photoconductors 1 (not shown).

Then, toner images are formed by developing the latent images by developing units 14C, 14M, 14Y, 14K. The developing units 14C, 14M, 14Y, 14K respectively conduct developing by the toner of C (cyan), M (magenta), Y (yellow), K (black), and the toner images of the respective colors formed on the four photoconductors 1C, 1M, 1Y, 1K are superimposed on the transferring paper. The transferring paper 17 is sent from a tray by means of a feeding paper roller 24, is stopped at a moment by means of a pair of resist roller 16, and then is sent to the transfer conveying belt 25 while adjusting a timing with the image forming on the photoconductor. The transferring paper 17 retained on the transfer conveying belt 25 is conveyed, and the toner images of respective colors are transferred on the transferring paper 17 at the contacting site or transferring part with the respective photoconductors 1C, 1M, 1Y, 1K.

The toner images on the photoconductors are transferred on the transferring paper 17 by the electric field formed by the potential difference between the transferring bias applied on transferring brushes 26C, 26M, 26Y, 26K and photoconductors 1C, 1M, 1Y, 1K.

Then, the transferring paper 17 having toner images of four colors superimposed at the four transferring portions is conveyed to a fixing apparatus 27, where the toner is fixed, then the transferring paper 17 is conveyed out to the discharged paper portion (not shown).

The residual toners on the respective photoconductors 1C, 1M, 1Y, 1K, which have not been transferred at the transferring portions, are recovered by the cleaning units 15C, 15M, 15Y, 15K.

As for the image forming units shown in FIG. 7, the color is arranged C (cyan), M (magenta), Y (yellow), K (black) in order from upstream to downstream of the conveying direction of the transferring paper. The order is not necessarily defined as such and may be arranged optionally. In addition, when the prints only with black color are required, the mechanism that the colors other than black (10C, 10M, 10Y) being stopped may be effectively arranged in the present invention.

Further, in FIG. 7 the charging units contacting the photoconductors, but as the charging mechanism shown in FIG. 6, in which a suitable gap (approximately 10 μm to 200 μm) is provided between the charging units and the photoconductors, can reduce the wear in the both, and suppress toner filming on the charging units, thereby advantageously used.

The image forming unit as described above may be fixed in such apparatuses as copiers, facsimile machines, and printers, alternatively, may be detachably mounted thereto in a form of a process cartridge.

Figure 8:
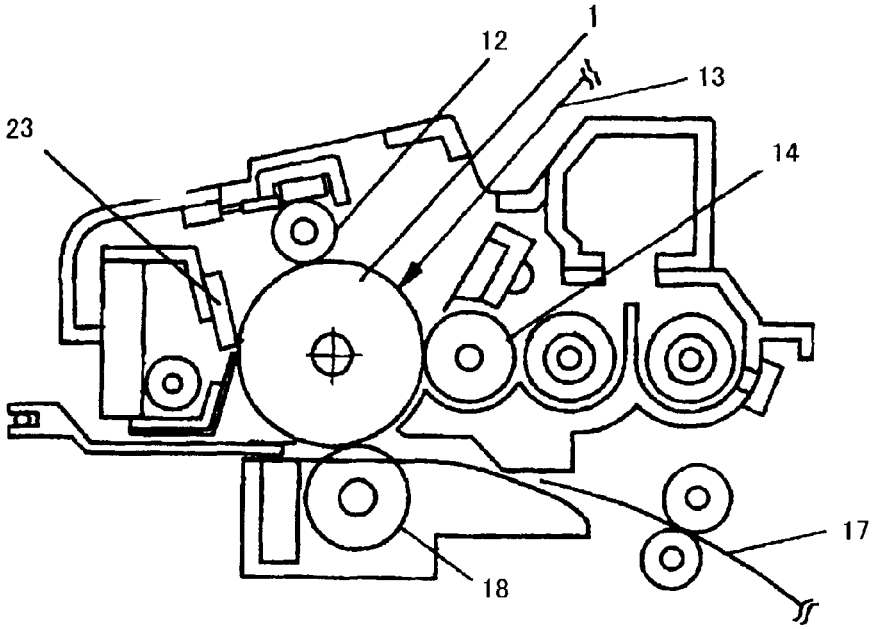
FIG. 8 schematically shows an example of a process cartridge for an image forming apparatus of the present invention.

As shown in FIG. 8, the process cartridge is a device (component), which contains a photoconductor 1, and further contains a charging unit 12, an exposing unit 13, a developing unit 14, a transferring unit 17, a cleaning unit 18, and a charge-eliminating unit.

The above-described tandem image forming apparatus can achieve a high-speed full-color print because of a plurality of toner images are transferred simultaneously.

However, the apparatus becomes larger as it needs at least four photoconductors, and the amount of wear differs in each photoconductor depending on the amount of the toner to be used, and then the color reproducibility is reduced and the abnormal image is generated.

On the contrary, the photoconductor of the present invention attained a high photosensitivity, and small-diameter photoconductor can be applied thereto, and the effect of the rise of the residual potential and poor sensitivity is reduced, so that the variation in the residual potential and sensitivity after repeated use with time is small, even the used frequency of the four photoconductors are different. Thus, a full-color image excellent in color reproducibility can be obtained, even after repeated use for a long time.

The present invention can solve the conventional problems, and provide an electrophotographic photoconductor suppressing charge spread and charge retention while charge moves by hopping in the photosensitive layer, having high resolution and photosensitivity, and low residual potential and a method for producing the electrophotographic photoconductor.

By using the electrophotographic photoconductor, the image forming apparatus attained high-speed print, full-color print or both of them, attained to be downsized and improve image quality according to downsizing the photoconductor, and the process cartridge used for the image forming apparatus can be provided.

EXAMPLES

Hereinafter, with referring to Examples and Comparative Examples, the invention is explained in details and the following Examples and Comparative Examples should not be construed as limiting the scope of the invention. In Examples and Comparative Examples, all part(s) and percentage (%) are expressed by mass-basis unless indicated otherwise.

Example 1

Stilbene

First, a coating liquid for an undercoat layer and a coating liquid for a charge generating layer of the following compositions were coated by immersion coating and dried one by one in an oven to form an undercoat layer of 3.5 μm-thick and a charge generating layer of 0.2 μm-thick on an aluminum cylinder having a circular cross section with a diameter of 30 mm. Specifically, the drying condition of each layer was as follows: the undercoat layer was dried at 130° C. for 20 minutes; and the charge generating layer was dried at 90° C. for 20 minutes.

Figure 9:
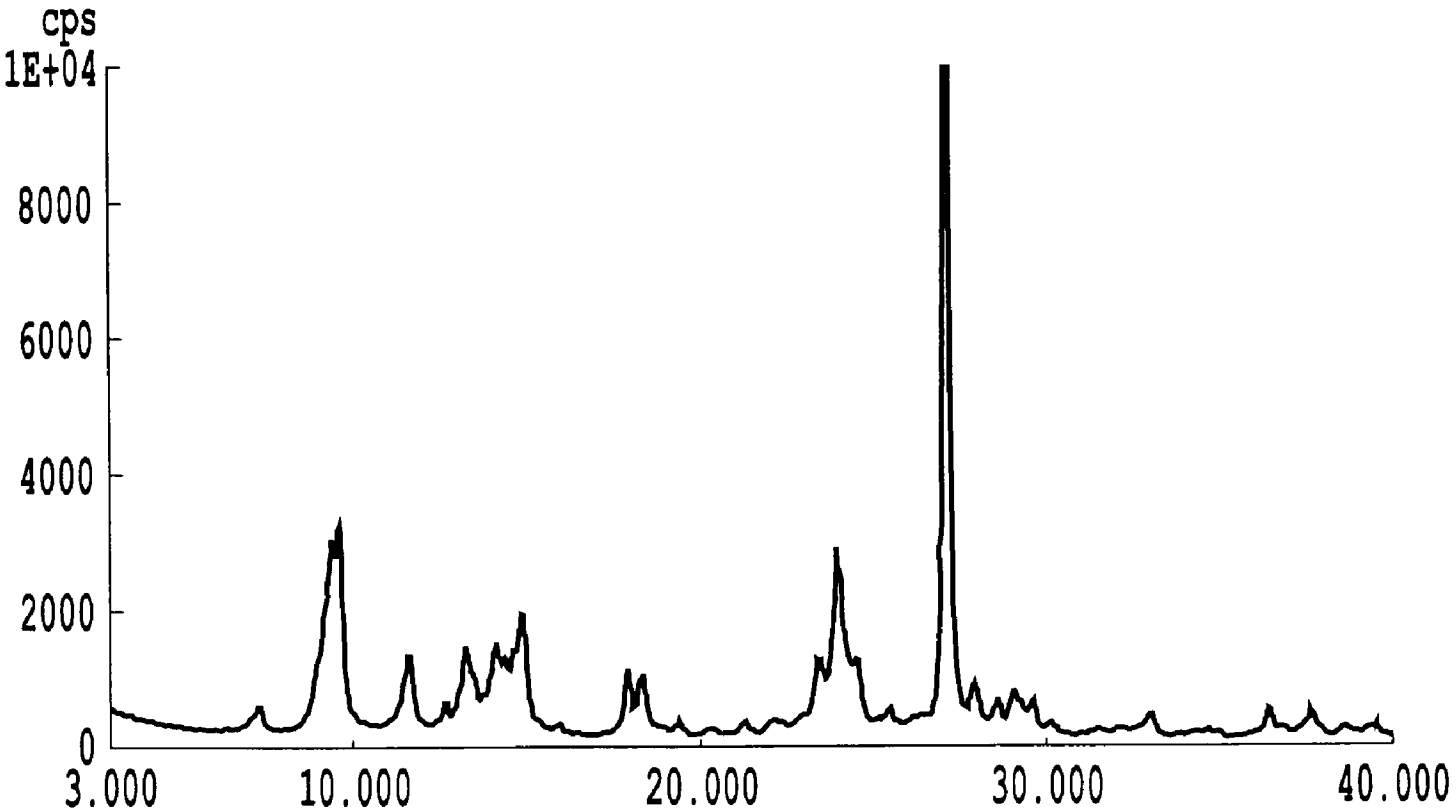
FIG. 9 shows XD spectra of titanyl phthalocyanine used in Examples.

| The composition of the coating liquid for the undercoat layer | |
|---|---|
| Titanium oxide (CR-EL, by Ishihara Sangyo Ltd.) | 50 parts |
| Alkyd resin Bekolite M6401-50, Solid Content: 50% by mass, by Dainippon Ink and Chemicals, Inc. | 14 parts |
| Melamine resin L-145-60, Solid Content: 60% by mass, by Dainippon Ink and Chemicals, Inc. | 8 parts |
| 2-butanone | 120 parts |
| **The composition of the coating liquid for the charge generating layer** | |
| Titanyl phthalocyanine showing an X-ray diffraction spectrum of FIG. 9 | 8 parts |
| Polyvinyl butyral (BX-1, by Sekisui Chemical Co. Ltd.) | 5 parts |
| 2-butanone | 400 parts |

Figure 12:
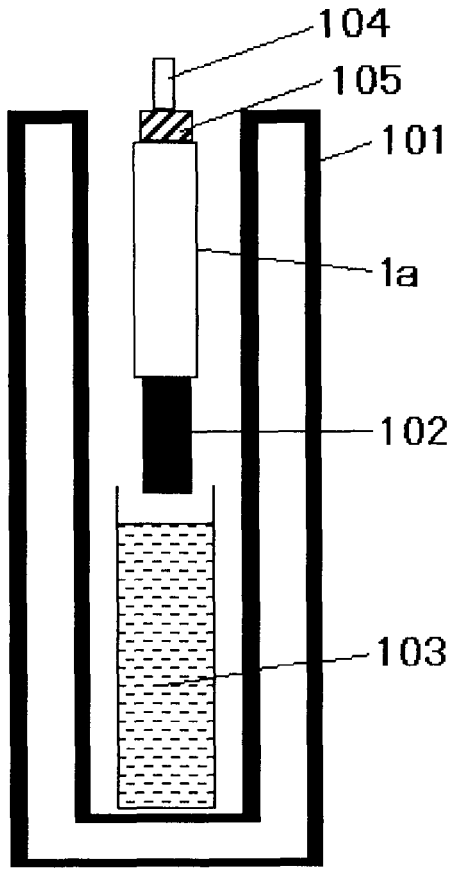
FIG. 12 shows a schematic cross-sectional view of a device for subjecting a charge transporting layer to a magnetic field orientation process used in Examples.
Figure 13:
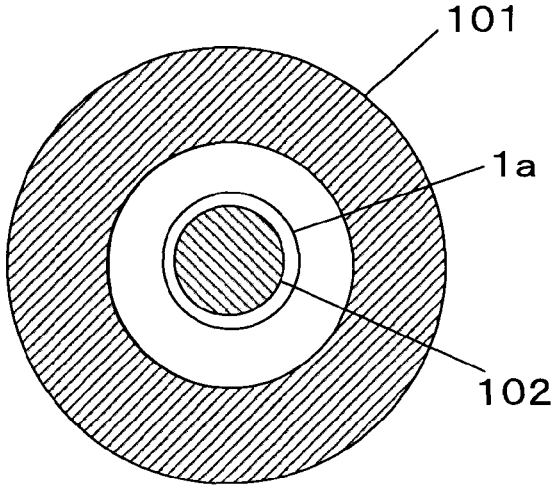
FIG. 13 shows a schematic top view of a device for subjecting a charge transporting layer to a magnetic field orientation process used in Examples.

In Example 1, the coating liquid for the charge transporting layer was coated to form the charge transporting layer by means of a magnetic field orientation apparatus shown in FIGS. 12 to 13. FIG. 12 shows a cross sectional side view of a configuration of the magnetic field orientation apparatus used in the present invention. FIG. 13 shows a top view of FIG. 12.

As shown in FIGS. 12 and 13, an aluminum cylinder 1*a*, in which the undercoat layer and the charge generating layer were coated on the surface, was immersed in a coating liquid for a charge transporting layer of the following composition 103 and lifted by an elevating machine 104 so as to coat the charge transporting layer.

After the aluminum cylinder 1*a* was lifted, as shown in FIG. 12, before the charge transporting layer was cured, magnetic field was applied to the aluminum cylinder 1*a* from the inner side to the outer side, specifically, the magnetic field was vertically applied to an aluminum substrate, by magnets 101 and 102, so that the charge transporting layer was dry to the touch. An intensity of the magnetic field was set at 8 tesla.

After dry to the touch, the aluminum cylinder 1*a* was heated from the inside of the substrate by a heater 105 to dry at 110° C. for 60 minutes, and then naturally cooled to a room temperature while the magnetic field was kept to be applied to the aluminum cylinder 1*a*. The substrate was moved up and down without rotation, while it was immersed in the coating liquid for the charge transporting layer 103 and the charge transporting layer thereon was dried. The charge transporting layer was formed to have a thickness of 27 μm to produce a photoconductor 1.

| The Composition of the coating liquid for the charge transporting layer | |
|---|---|
| Polycarbonate (Z Polyca, by Teijin Chemicals Ltd.) | 10 parts |
| Charge transporting material having the following Structural Formula | 7 parts |
| Silicone oil KF-50 by Shin-Etsu Chemical Co., Ltd. | 0.002 parts |
| Tetrahydrofuran | 40 parts |
| Xylene | 40 parts |

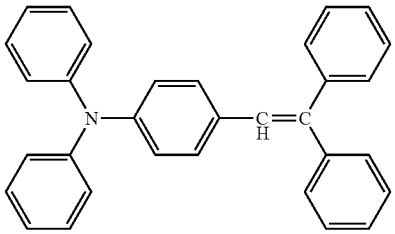

Example 2

A photoconductor 2 was produced in the same manner as Example 1, except that the charge transporting material in Example 1 was changed to the charge transporting material represented by the following Structural Formula:

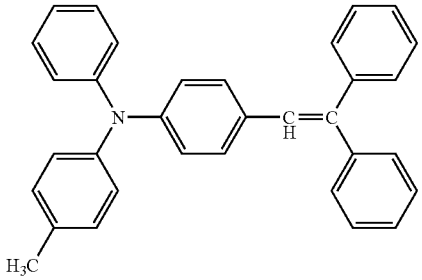

Example 3

A photoconductor 3 was produced in the same manner as Example 1, except that the charge transporting material in Example 1 was changed to the charge transporting material represented by the following Structural Formula:

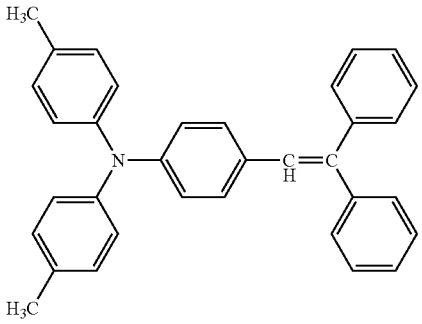

Example 4

A photoconductor 4 was produced in the same manner as Example 1, except that the charge transporting material in Example 1 was changed to the charge transporting material represented by the following Structural Formula:

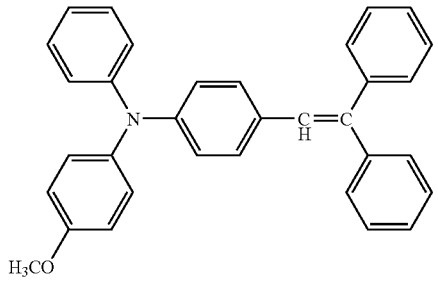

Example 5

A photoconductor 5 was produced in the same manner as Example 1, except that the charge transporting material in Example 1 was changed to the charge transporting material represented by the following Structural Formula:

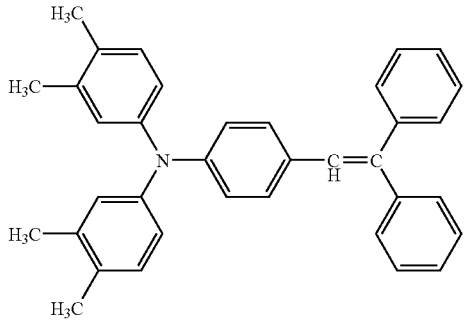

Example 6

A photoconductor 6 was produced in the same manner as Example 1, except that the charge transporting material in Example 1 was changed to the charge transporting material represented by the following Structural Formula:

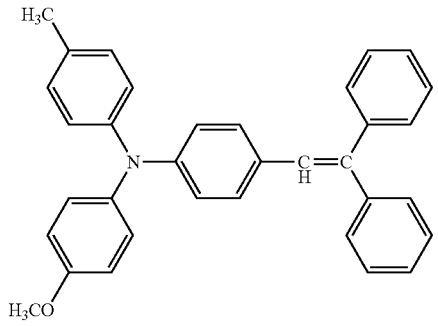

Example 7

A photoconductor 7 was produced in the same manner as Example 1, except that the charge transporting material in Example 1 was changed to the charge transporting material represented by the following Structural Formula:

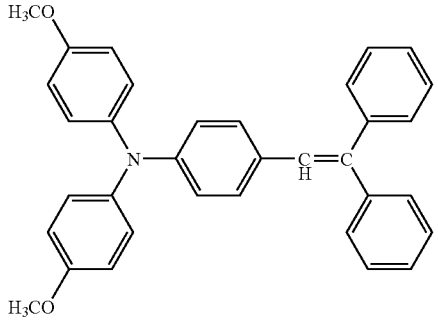

Example 8

A photoconductor 8 was produced in the same manner as Example 1, except that the charge transporting material in Example 1 was changed to the charge transporting material represented by the following Structural Formula:

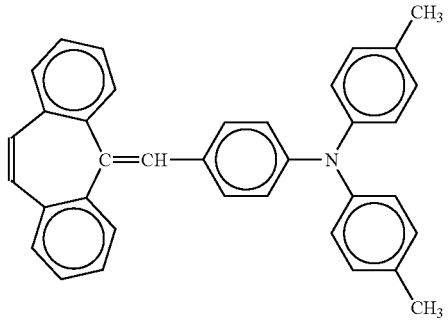

Example 9

A photoconductor 9 was produced in the same manner as Example 1, except that the charge transporting material in Example 1 was changed to the charge transporting material represented by the following Structural Formula:

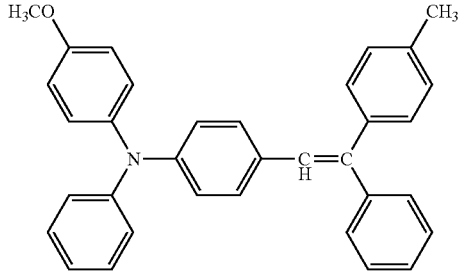

Example 10

A photoconductor 10 was produced in the same manner as Example 1, except that the charge transporting material in Example 1 was changed to the charge transporting material represented by the following Structural Formula:

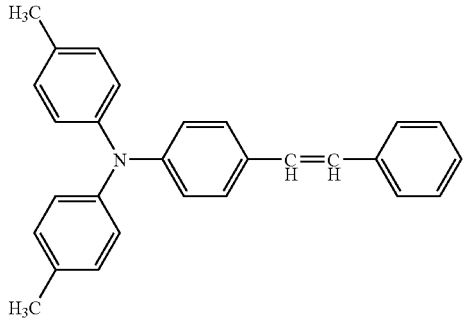

Example 11

A photoconductor 11 was produced in the same manner as Example 1, except that the charge transporting material in Example 1 was changed to the charge transporting material represented by the following Structural Formula:

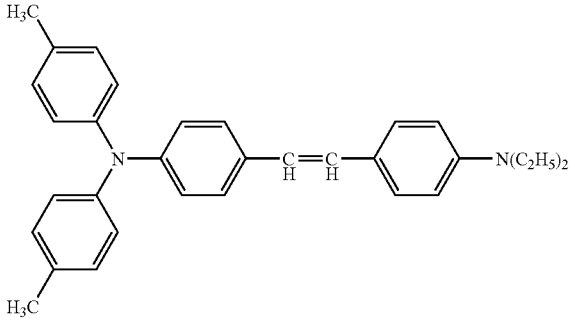

Example 12

A photoconductor 12 was produced in the same manner as Example 1, except that the charge transporting material in Example 1 was changed to the charge transporting material represented by the following Structural Formula:

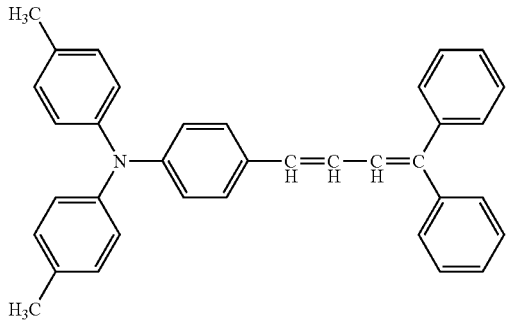

Example 13

A photoconductor 13 was produced in the same manner as Example 3, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in Example 3.

Example 14

A photoconductor 14 was produced in the same manner as Example 3, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example Example 15

A photoconductor 15 was produced in the same manner as Example 3, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 3.

Example 16

A coating liquid for a photosensitive layer of the following composition were coated to form a single photosensitive layer on an aluminum cylinder having 30 mm diameter by production apparatus shown in FIGS. 12 and 13. The aluminum cylinder was immersed in the coating liquid for the photosensitive layer and lifted so as to coat the photosensitive layer. After the aluminum cylinder was lifted, as shown in FIG. 12, before the photosensitive layer was cured, magnetic field was applied to the aluminum cylinder from the inner side to the outer side, specifically, the magnetic field was vertically applied to an aluminum substrate, so that the photosensitive layer was dry to the touch. An intensity of the magnetic field was set at 8 tesla.

After dry to the touch, the aluminum cylinder was heated from the inside of the substrate by a heater 105 to dry at 110° C. for 60 minutes, and then naturally cooled to a room temperature while the magnetic field was kept to be applied to the aluminum cylinder. The substrate was moved up and down without rotation, while it was immersed in the coating liquid for the photosensitive layer and the photosensitive layer thereon was dried. The photosensitive layer was formed to have a thickness of 20 μm to produce a photoconductor 16.

| The composition of the coating liquid for the photosensitive layer | |
|---|---|
| Polycarbonate (Z Polyca, by Teijin Chemicals Ltd.) | 10 parts |
| Charge transport material having the following Structural Formula | 7 parts |

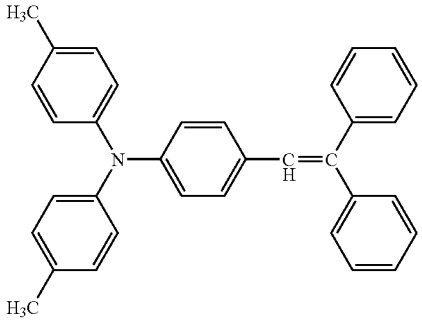

| | |
|---|---|
| Charge transport material having the following Structural Formula | 4 parts |

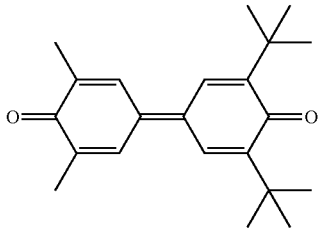

-continued

| The composition of the coating liquid for the photosensitive layer | |
|---|---|
| Silicone oil KF-50 by Shin-Etsu Chemical Co., Ltd. | 0.002 parts |
| Tetrahydrofuran | 40 parts |
| Xylene | 40 parts |
| Titanyl phthalocyanine showing an X-ray diffraction spectrum of FIG. 9 | 0.2 parts |

Example 17

Distyrylbenzene

A photoconductor 17 was produced in the same manner as Example 1, except that the charge transporting material in Example 1 was changed to the charge transporting material represented by the following Structural Formula:

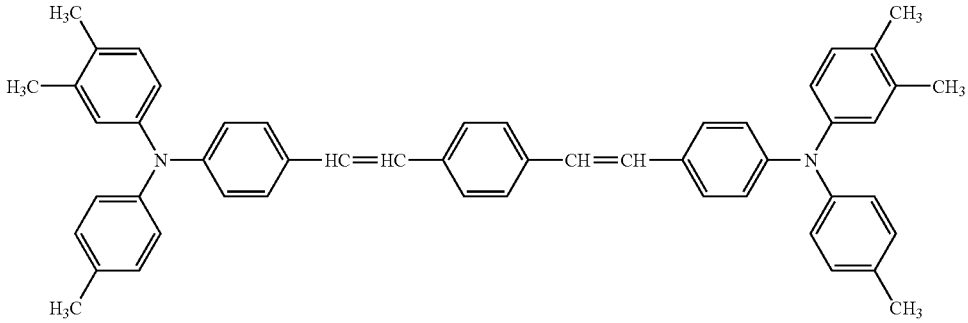

Example 18

A photoconductor 18 was produced in the same manner as Example 1, except that the charge transporting material in Example 1 was changed to the charge transporting material represented by the following Structural Formula:

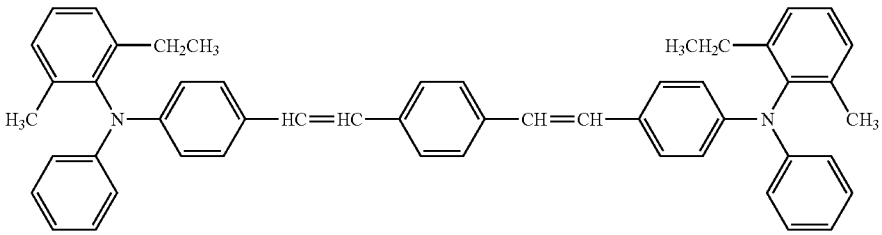

Example 19

A photoconductor 19 was produced in the same manner as Example 1, except that the charge transporting material in Example 1 was changed to the charge transporting material represented by the following Structural Formula:

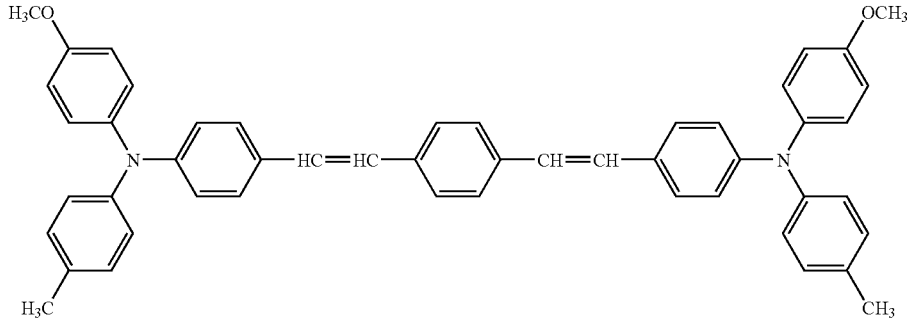

Example 20

A photoconductor 20 was produced in the same manner as Example 1, except that the charge transporting material in Example 1 was changed to the charge transporting material represented by the following Structural Formula:

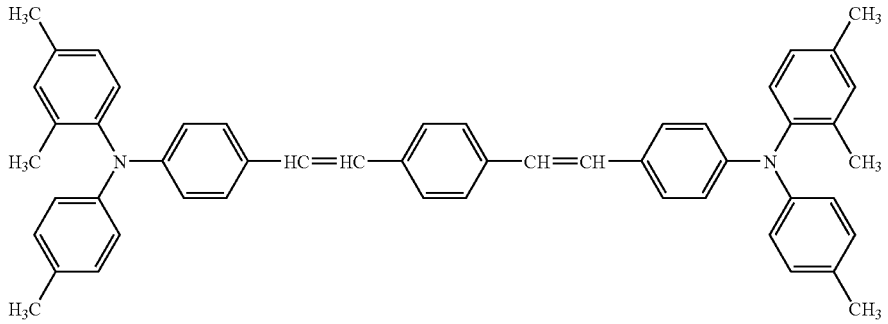

Example 21

A photoconductor 21 was produced in the same manner as Example 1, except that the charge transporting material in Example 1 was changed to the charge transporting material represented by the following Structural Formula:

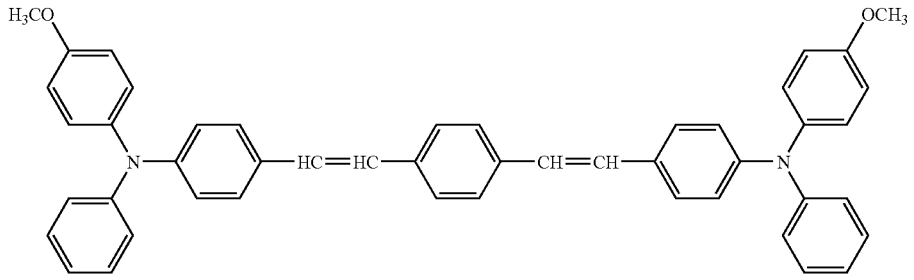

Example 22

A photoconductor 22 was produced in the same manner as Example 1, except that the charge transporting material in Example 1 was changed to the charge transporting material represented by the following Structural Formula:

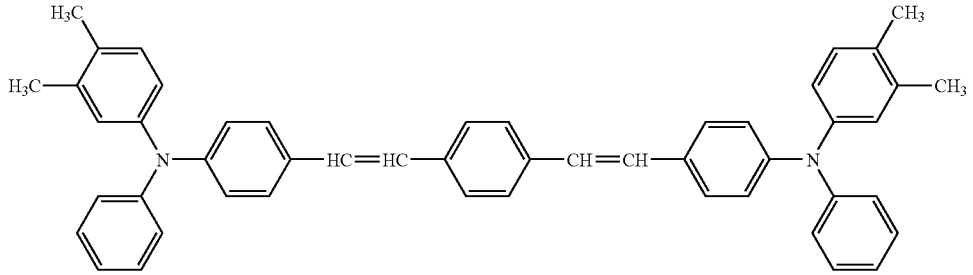

Example 23

A photoconductor 23 was produced in the same manner as Example 1, except that the charge transporting material in Example 1 was changed to the charge transporting material represented by the following Structural Formula:

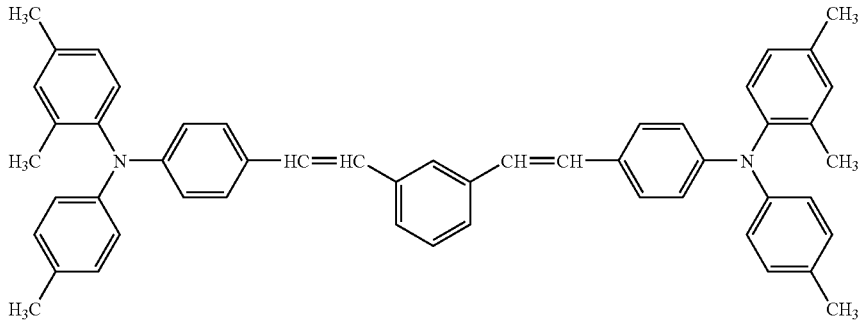

Example 24

A photoconductor 24 was produced in the same manner as Example 17, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in Example 17.

Example 25

A photoconductor 25 was produced in the same manner as Example 17, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example 17.

Example 26

A photoconductor 26 was produced in the same manner as Example 17, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 17.

Example 27

A photoconductor 27 was produced in the same manner as Example 16, except that the charge transporting material in Example 16 was changed to the charge transporting material represented by the following Structural Formula:

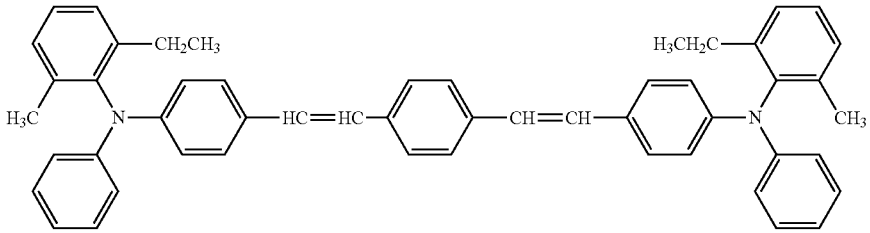

Example 28

Aminobiphenyl

A photoconductor 28 was produced in the same manner as Example 1, except that the charge transporting material in Example 1 was changed to the charge transporting material represented by the following Structural Formula:

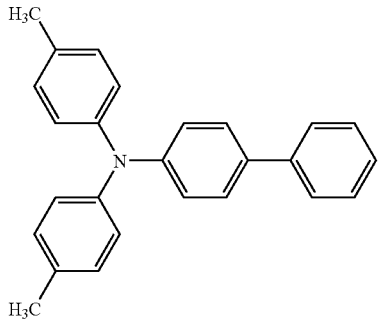

Example 29

A photoconductor 29 was produced in the same manner as Example 1, except that the charge transporting material in Example 1 was changed to the charge transporting material represented by the following Structural Formula:

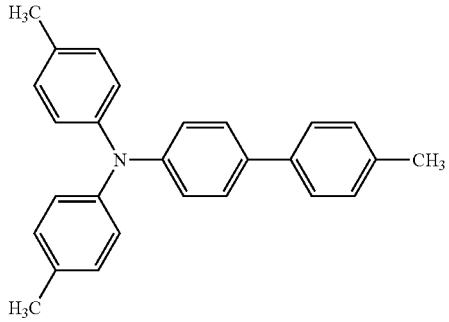

Example 30

A photoconductor 30 was produced in the same manner as Example 1, except that the charge transporting material in Example 1 was changed to the charge transporting material represented by the following Structural Formula:

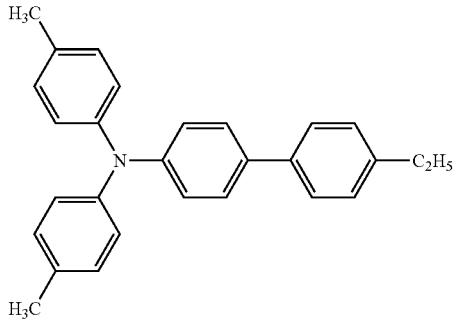

Example 31

A photoconductor 31 was produced in the same manner as Example 1, except that the charge transporting material in Example 1 was changed to the charge transporting material represented by the following Structural Formula:

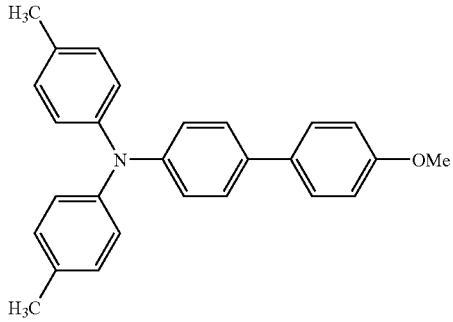

Example 32

A photoconductor 32 was produced in the same manner as Example 1, except that the charge transporting material in Example 1 was changed to the charge transporting material represented by the following Structural Formula:

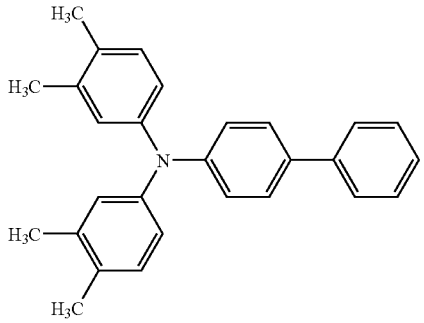

Example 33

A photoconductor 33 was produced in the same manner as Example 28, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in Example 28.

Example 34

A photoconductor 34 was produced in the same manner as Example 28, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example 28.

Example 35

A photoconductor 35 was produced in the same manner as Example 28, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 28.

Example 36

A photoconductor 36 was produced in the same manner as Example 16, except that the charge transporting material in Example 16 was changed to the charge transporting material represented by the following Structural Formula:

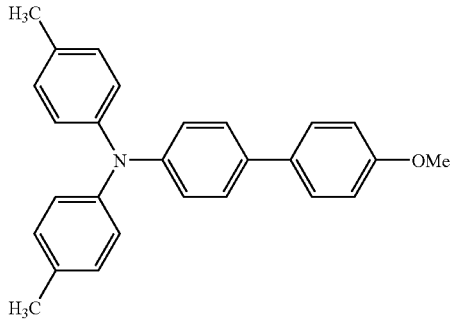

Example 37

Benzidine

A photoconductor 37 was produced in the same manner as is Example 1, except that the charge transporting material in Example 1 was changed to the charge transporting material represented by the following Structural Formula:

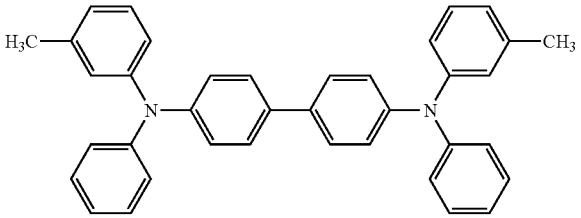

Example 38

A photoconductor 38 was produced in the same manner as Example 1, except that the charge transporting material in Example 1 was changed to the charge transporting material represented by the following Structural Formula:

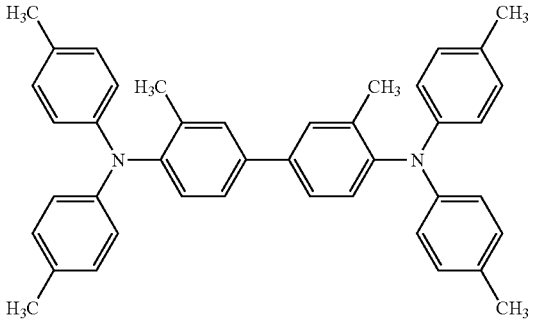

Example 39

A photoconductor 39 was produced in the same manner as Example 1, except that the charge transporting material in Example 1 was changed to the charge transporting material represented by the following Structural Formula:

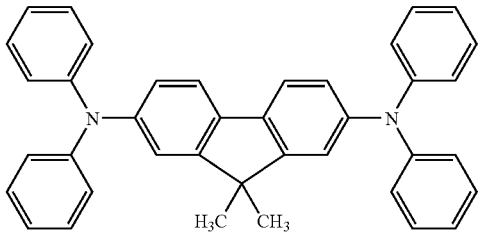

Example 40

A photoconductor 40 was produced in the same manner as Example 1, except that the charge transporting material in Example 1 was changed to the charge transporting material represented by the following Structural Formula:

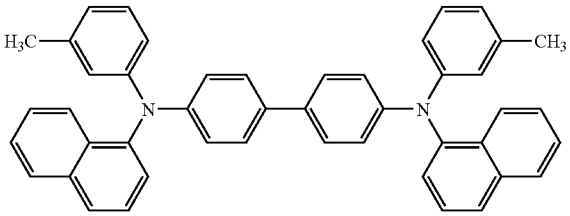

Example 41

A photoconductor 41 was produced in the same manner as Example 37, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in Example 37.

Example 42

A photoconductor 42 was produced in the same manner as Example 37, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example 37.

Example 43

A photoconductor 43 was produced in the same manner as Example 37, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 37.

Example 44

A photoconductor 44 was produced in the same manner as Example 16, except that the charge transporting material in Example 16 was changed to the charge transporting material represented by the following Structural Formula:

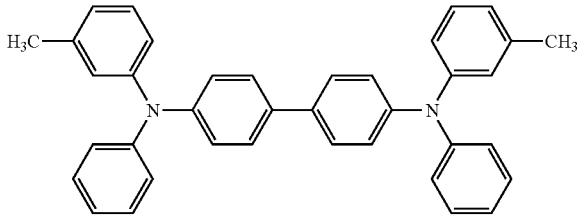

Comparative Example 1

A photoconductor 45 was produced in the same manner as Example 1, except that the charge transporting material in Example 1 was changed to the charge transporting material represented by the following Structural Formula:

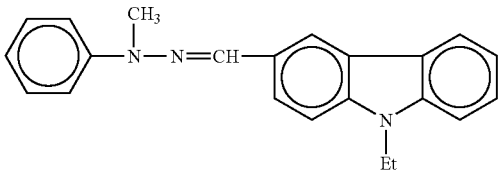

Comparative Example 2

A photoconductor 46 was produced in the same manner as Comparative Example 1, except that the magnetic field was not applied to the aluminum cylinder in Comparative Example 1.

Comparative Example 3

A photoconductor 47 was produced in the same manner as Example 1, except that the charge transporting material in Example 1 was changed to the charge transporting material represented by the following Structural Formula:

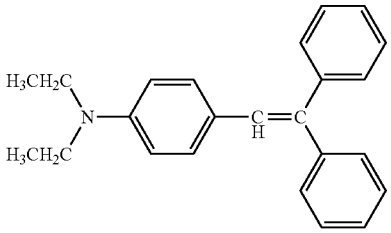

Comparative Example 4

A photoconductor 48 was produced in the same manner as Comparative Example 3, except that the magnetic field was not applied to the aluminum cylinder in Comparative Example 3.

Comparative Example 5

A photoconductor 49 was produced in the same manner as Example 1, except that the charge transporting material in Example 1 was changed to the charge transporting material represented by the following Structural Formula:

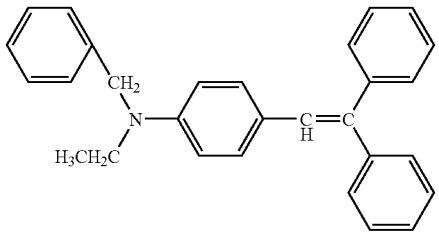

Comparative Example 6

A photoconductor 50 was produced in the same manner as Comparative Example 5, except that the magnetic field was not applied to the aluminum cylinder in Comparative Example 5.

Comparative Example 7

A photoconductor 51 was produced in the same manner as Example 1, except that the charge transporting material in Example 1 was changed to the charge transporting material represented by the following Structural Formula:

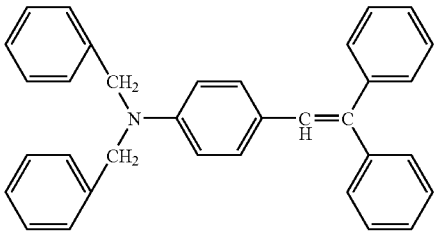

Comparative Example 8

A photoconductor 52 was produced in the same manner as Comparative Example 7, except that the magnetic field was not applied to the aluminum cylinder in Comparative Example 7.

Comparative Example 9

A photoconductor 53 was produced in the same manner as Example 1, except that the magnetic field was not applied to the aluminum cylinder in Example 1.

Comparative Example 10

A photoconductor 54 was produced in the same manner as Example 2, except that the magnetic field was not applied to the aluminum cylinder in Example 2.

Comparative Example 11

A photoconductor 55 was produced in the same manner as Example 3, except that the magnetic field was not applied to the aluminum cylinder in Example 3.

Comparative Example 12

A photoconductor 56 was produced in the same manner as Example 4, except that the magnetic field was not applied to the aluminum cylinder in Example 4.

Comparative Example 13

A photoconductor 57 was produced in the same manner as Example 5, except that the magnetic field was not applied to the aluminum cylinder in Example 5.

Comparative Example 14

A photoconductor 58 was produced in the same manner as Example 6, except that the magnetic field was not applied to the aluminum cylinder in Example 6.

Comparative Example 15

A photoconductor 59 was produced in the same manner as Example 7, except that the magnetic field was not applied to the aluminum cylinder in Example 7.

Comparative Example 16

A photoconductor 60 was produced in the same manner as Example 8, except that the magnetic field was not applied to the aluminum cylinder in Example 8.

Comparative Example 17

A photoconductor 61 was produced in the same manner as Example 9, except that the magnetic field was not applied to the aluminum cylinder in Example 9.

Comparative Example 18

A photoconductor 62 was produced in the same manner as Example 10, except that the magnetic field was not applied to the aluminum cylinder in Example 10.

Comparative Example 19

A photoconductor 63 was produced in the same manner as Example 11, except that the magnetic field was not applied to the aluminum cylinder in Example 11.

Comparative Example 20

A photoconductor 64 was produced in the same manner as Example 12, except that the magnetic field was not applied to the aluminum cylinder in Example 12.

Comparative Example 21

A photoconductor 65 was produced in the same manner as Example 16, except that the magnetic field was not applied to the aluminum cylinder in Example 16.

Comparative Example 22

A photoconductor 66 was produced in the same manner as Example 1, except that the charge transporting material in Example 1 was changed to the charge transporting material represented by the following Structural Formula:

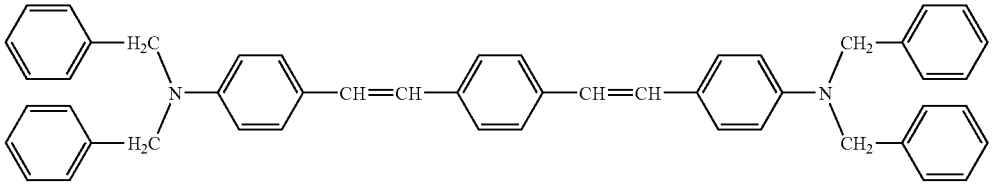

Comparative Example 23

A photoconductor 67 was produced in the same manner as Comparative Example 22, except that the magnetic field was not applied to the aluminum cylinder in Comparative Example 22.

Comparative Example 24

A photoconductor 68 was produced in the same manner as Example 1, except that the charge transporting material in Example 1 was changed to the charge transporting material represented by the following Structural Formula:

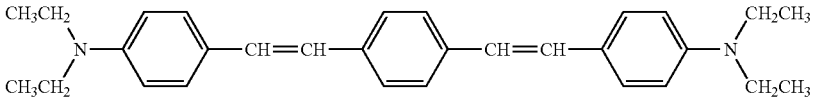

Comparative Example 25

A photoconductor 69 was produced in the same manner as Comparative Example 24, except that the magnetic field was not applied to the aluminum cylinder in Comparative Example 24.

Comparative Example 26

A photoconductor 70 was produced in the same manner as Example 1, except that the charge transporting material in Example 1 was changed to the charge transporting material represented by the following Structural Formula:

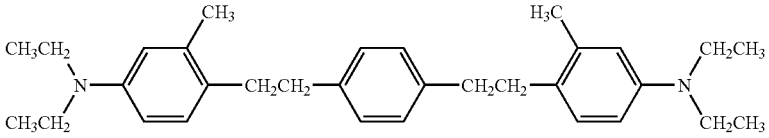

Comparative Example 27

A photoconductor 71 was produced in the same manner as Comparative Example 26, except that the magnetic field was not applied to the aluminum cylinder in Comparative Example 26.

Comparative Example 28

A photoconductor 72 was produced in the same manner as Example 17, except that the magnetic field was not applied to the aluminum cylinder in Example 17.

Comparative Example 29

A photoconductor 73 was produced in the same manner as Example 18, except that the magnetic field was not applied to the aluminum cylinder in Example 18.

Comparative Example 30

A photoconductor 74 was produced in the same manner as Example 19, except that the magnetic field was not applied to the aluminum cylinder in Example 19.

Comparative Example 31

A photoconductor 75 was produced in the same manner as Example 20, except that the magnetic field was not applied to the aluminum cylinder in Example 20.

Comparative Example 32

A photoconductor 76 was produced in the same manner as Example 21, except that the magnetic field was not applied to the aluminum cylinder in Example 21.

Comparative Example 33

A photoconductor 77 was produced in the same manner as Example 22, except that the magnetic field was not applied to the aluminum cylinder in Example 22.

Comparative Example 34

A photoconductor 78 was produced in the same manner as Example 23, except that the magnetic field was not applied to the aluminum cylinder in Example 23.

Comparative Example 35

A photoconductor 79 was produced in the same manner as Example 27, except that the magnetic field was not applied to the aluminum cylinder in Example 27.

Comparative Example 36

A photoconductor 80 was produced in the same manner as Example 1, except that the charge transporting material in Example 1 was changed to the charge transporting material represented by the following Structural Formula:

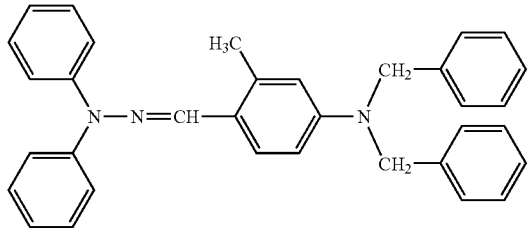

Comparative Example 37

A photoconductor 81 was produced in the same manner as Comparative Example 36, except that the magnetic field was not applied to the aluminum cylinder in Comparative Example 36.

Comparative Example 38

A photoconductor 82 was produced in the same manner as Example 1, except that the charge transporting material in Example 1 was changed to the charge transporting material represented by the following Structural Formula:

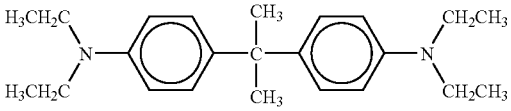

Comparative Example 39

A photoconductor 83 was produced in the same manner as Comparative Example 38, except that the magnetic field was not applied to the aluminum cylinder in Comparative Example 38.

Comparative Example 40

A photoconductor 84 was produced in the same manner as Example 28, except that the magnetic field was not applied to the aluminum cylinder in Example 28.

Comparative Example 41

A photoconductor 85 was produced in the same manner as Example 29, except that the magnetic field was not applied to the aluminum cylinder in Example 29.

Comparative Example 42

A photoconductor 86 was produced in the same manner as Example 30, except that the magnetic field was not applied to the aluminum cylinder in Example 30.

Comparative Example 43

A photoconductor 87 was produced in the same manner as Example 31, except that the magnetic field was not applied to the aluminum cylinder in Example 31.

Comparative Example 44

A photoconductor 88 was produced in the same manner as Example 32, except that the magnetic field was not applied to the aluminum cylinder in Example 32.

Comparative Example 45

A photoconductor 89 was produced in the same manner as Example 36, except that the magnetic field was not applied to the aluminum cylinder in Example 36.

Comparative Example 46

A photoconductor 90 was produced in the same manner as Example 1, except that the charge transporting material in Example 1 was changed to the charge transporting material represented by the following Structural Formula:

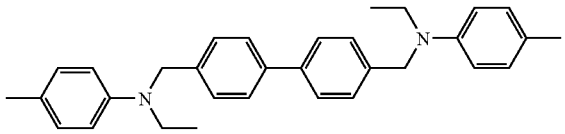

Comparative Example 47

A photoconductor 91 was produced in the same manner as Comparative Example 46, except that the magnetic field was not applied to the aluminum cylinder in Comparative Example 46.

Comparative Example 48

A photoconductor 92 was produced in the same manner as Example 1, except that the charge transporting material in Example 1 was changed to the charge transporting material represented by the following Structural Formula:

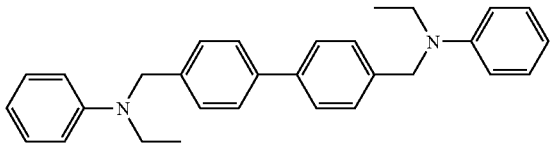

Comparative Example 49

A photoconductor 93 was produced in the same manner as Comparative Example 48, except that the magnetic field was not applied to the aluminum cylinder in Comparative Example 48.

Comparative Example 50

A photoconductor 94 was produced in the same manner as Example 37, except that the magnetic field was not applied to the aluminum cylinder in Example 37.

Comparative Example 51

A photoconductor 95 was produced in the same manner as Example 38, except that the magnetic field was not applied to the aluminum cylinder in Example 38.

Comparative Example 52

A photoconductor 96 was produced in the same manner as Example 39, except that the magnetic field was not applied to the aluminum cylinder in Example 39.

Comparative Example 53

A photoconductor 97 was produced in the same manner as Example 40, except that the magnetic field was not applied to the aluminum cylinder in Example 40.

Comparative Example 54

A photoconductor 98 was produced in the same manner as Example 44, except that the magnetic field was not applied to the aluminum cylinder in Example 44.

Measurement of Electrostatic Property

An initial electric potential after exposing (VL) was measured by a converted digital copier Neo 271 by Ricoh Company Ltd. containing a cartridge for an electrophotographic process (no pre-exposing before cleaning), in which each of the electrophotographic photoconductors produced in Examples 1 to 44 and Comparative Examples 1 to 54 was mounted, and a charging roller and using semiconductor laser at 780 nm as a light source for image exposing.

Next, after 50,000 sheets were printed in total, an electric potential after exposing (VL) after printing was measured. Evaluation was performed with positive charge in Examples 16, 27, 36 and 44 and Comparative Examples 21, 35, 45 and 54, and with negative charge in other Examples and Comparative Examples.

Evaluation of Resolution

Resolution was evaluated in such a way that after the photoconductor was charged and exposed, the copier was stopped in a developing process, specifically, in a process of a toner adhered on a latent electrostatic image, and the photoconductor was taken out from the copier, and then the toner adhered on the photoconductor was enlarged and observed by a magnifier. Dot reproducibility was evaluated by observing, for example, toner scattering on the basis of the following evaluation criteria. The results are shown in Table 1.

[Evaluation Criteria]

A: A dot had a small diameter and a high density, and the toner was developed faithfully to a latent electrostatic image.

B: A dot diameter became slightly larger, but little toner scattering, a high resolution was kept.

C: A dot diameter became much larger, toner scattering increased, and a resolution was slightly decreased.

D: A dot density was decreased, toner scattering widely increased, and a resolution was obviously decreased.

Evaluation of Orientation

An orientation of the charge transporting material was evaluated by a confocal raman spectroscopy measurement. RAMAN-11 by nanophoton corp. was used as a confocal raman spectroscopic device. A z-polarization device, Zpol by nanophoton corp. was set in the confocal raman spectroscopic device, and raman scattering light was detected by irradiating z-polarized laser light to evaluate an orientation of molecules in a direction vertical to the substrate. The laser having a light intensity of 5 mW before passing though the z-polarization device and an excitation wavelength of 532 nm, an objective lens of 100× (a numerical aperture NA of 0.9), and a spectrograph slit width of 120 μm were used for the measurement.

The orientation was measured on a surface of the photosensitive layer and inside the photosensitive layer as follows: the laser light was focused on a surface of the photosensitive layer (depth of 0 μm); and the laser light was focused on a depth of 10 μm from the surface of the photosensitive layer.

A peak height in the raman scattering spectra of triarylamine was represented as "$I_{(surface)}$", on the surface of the photosensitive layer and "$I_{(inside)}$", inside the photosensitive layer.

Here, the peak height in the raman scattering spectra was obtained by subtracting an average value of the raman scattering intensities of triarylamine at the wavenumber of 1,356±2 $cm^{-1}$ where no peak was observed from a maximum of the raman scattering intensities of triarylamine at the wavenumber of 1,324±2 $cm^{-1}$. And then, the orientation of the charge transporting material was evaluated from a ratio "ϵ" of $I_{(inside)}$ to $I_{(surface)}$, $\epsilon = I_{(inside)}/I_{(surface)}$, where $I_{(inside)}$ represented a peak height in the raman scattering spectra inside the photosensitive layer effectively affected by the orientation process and $I_{(surface)}$ represented a peak height in the raman scattering spectra on the surface of the photosensitive layer difficultly affected by the orientation process. The results are shown in Tables 1 and 2.

Figure 10:
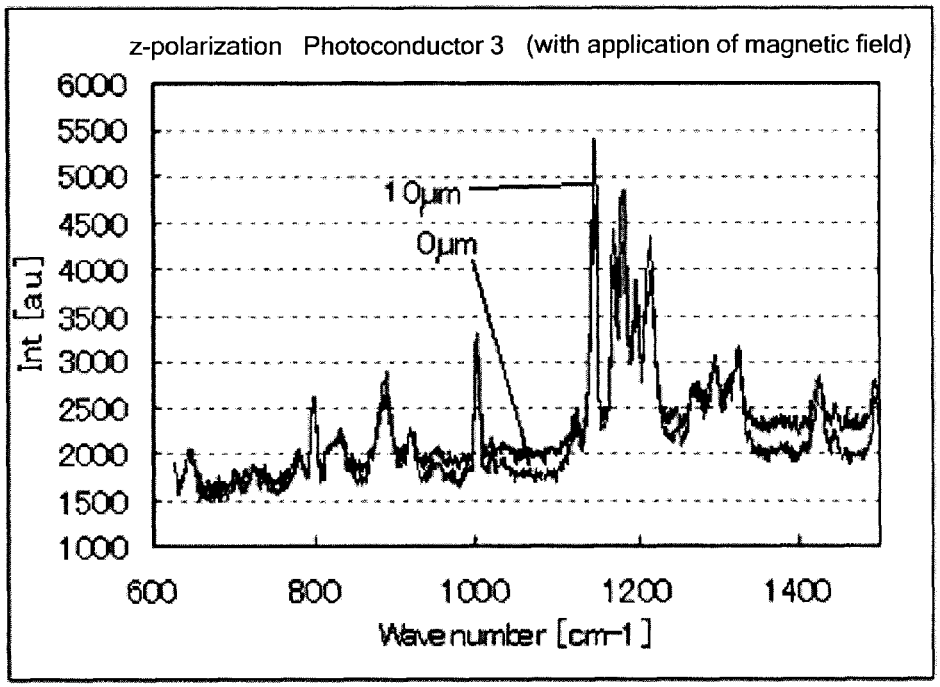
FIG. 10 shows a chart of a relation of a wavenumber and raman scattering intensities on a surface of and inside the electrophotographic photoconductor produced in Example 3.
Figure 11:
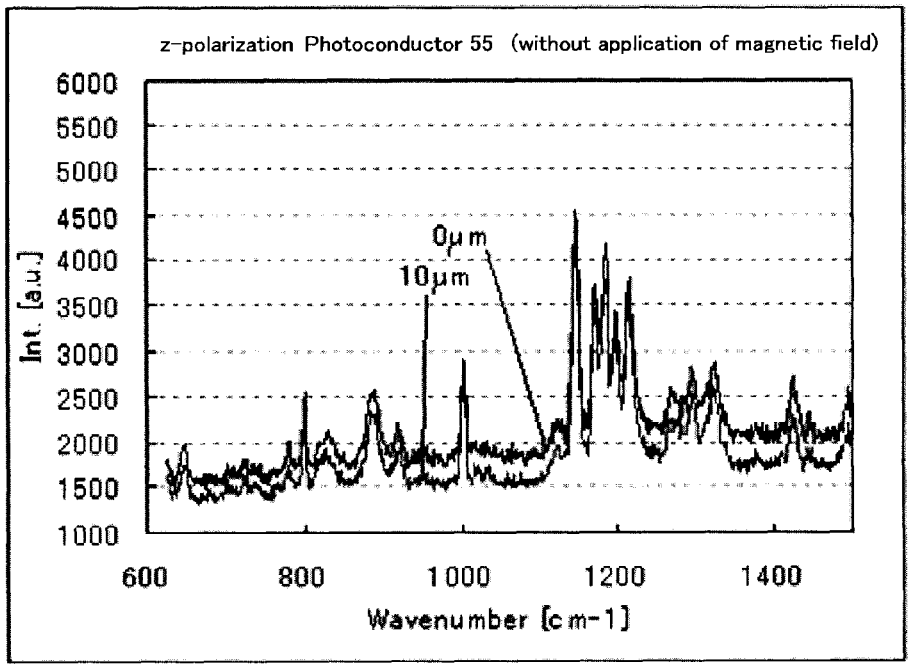
FIG. 11 shows a chart of a relation of a wavenumber and raman scattering intensities on a surface of and inside the electrophotographic photoconductor produced in Comparative Example 11.

For example, a relation between the wavenumber and the raman scattering intensitites on the surface and inside of each of the photoconductor produced in Example 3 and Comparative Example 11 is respectively shown in FIGS. 10 and 11.

TABLE 1

| | Photoconductor | Initial VL (V) | VL after printing (V) | Dot reproducibility | ϵ |
|---|---|---|---|---|---|
| Example 1 | Photoconductor 1 | −100 | −130 | B | 1.4 |
| Example 2 | Photoconductor 2 | −95 | −120 | B | 1.4 |
| Example 3 | Photoconductor 3 | −80 | −105 | A | 1.5 |
| Example 4 | Photoconductor 4 | −80 | −100 | A | 1.5 |
| Example 5 | Photoconductor 5 | −75 | −95 | A | 1.4 |
| Example 6 | Photoconductor 6 | −75 | −90 | A | 1.4 |
| Example 7 | Photoconductor 7 | −60 | −70 | A | 1.3 |
| Example 8 | Photoconductor 8 | −95 | −125 | B | 1.4 |
| Example 9 | Photoconductor 9 | −80 | −100 | B | 1.4 |
| Example 10 | Photoconductor 10 | −95 | −140 | B | 1.4 |
| Example 11 | Photoconductor 11 | −70 | −105 | B | 1.4 |
| Example 12 | Photoconductor 12 | −80 | −105 | B | 1.5 |
| Example 13 | Photoconductor 13 | −95 | −120 | A | 1.5 |
| Example 14 | Photoconductor 14 | −105 | −150 | B-C | 1.1 |
| Example 15 | Photoconductor 15 | −105 | −130 | B | 1.4 |
| Example 16 | Photoconductor 16 | 55 | 120 | B | — |
| Example 17 | Photoconductor 17 | −50 | −65 | A | 2.2 |
| Example 18 | Photoconductor 18 | −60 | −85 | A | 2.1 |
| Example 19 | Photoconductor 19 | −35 | −45 | A | 2.1 |
| Example 20 | Photoconductor 20 | −45 | −60 | A | 2.0 |
| Example 21 | Photoconductor 21 | −40 | −55 | A | 2.1 |
| Example 22 | Photoconductor 22 | −60 | −75 | A | 2.1 |
| Example 23 | Photoconductor 23 | −65 | −85 | A | 2.0 |
| Example 24 | Photoconductor 24 | −45 | −60 | A | 2.3 |
| Example 25 | Photoconductor 25 | −55 | −80 | B | 1.8 |
| Example 26 | Photoconductor 26 | −55 | −70 | B | 2.0 |
| Example 27 | Photoconductor 27 | 40 | 120 | B | — |
| Example 28 | Photoconductor 28 | −85 | −120 | A | 1.4 |
| Example 29 | Photoconductor 29 | −95 | −135 | B | 1.5 |
| Example 30 | Photoconductor 30 | −90 | −130 | A | 1.5 |

TABLE 1-continued

| | Photoconductor | Initial VL (V) | VL after printing (V) | Dot reproduc-ibility | ϵ |
|---|---|---|---|---|---|
| Example 31 | Photoconductor 31 | −80 | −115 | A | 1.3 |
| Example 32 | Photoconductor 32 | −85 | −115 | A | 1.5 |
| Example 33 | Photoconductor 33 | −80 | −115 | B | 1.5 |
| Example 34 | Photoconductor 34 | −90 | −140 | B | 1.1 |
| Example 35 | Photoconductor 35 | −95 | −130 | B | 1.1 |
| Example 36 | Photoconductor 36 | 105 | 150 | B | — |
| Example 37 | Photoconductor 37 | −80 | −100 | A | 1.9 |
| Example 38 | Photoconductor 38 | −75 | −95 | A | 1.8 |
| Example 39 | Photoconductor 39 | −85 | −100 | A | 1.8 |
| Example 40 | Photoconductor 40 | −90 | −105 | A | 1.9 |
| Example 41 | Photoconductor 41 | −80 | −95 | A | 2.1 |
| Example 42 | Photoconductor 42 | −90 | −120 | B | 1.1 |
| Example 43 | Photoconductor 43 | −85 | −110 | B | 1.2 |
| Example 44 | Photoconductor 44 | 55 | 120 | B | — |

TABLE 2

| | Photoconductor | Initial VL (V) | VL after printing (V) | Dot reproduc-ibility | ϵ |
|---|---|---|---|---|---|
| Comparative Example 1 | Photoconductor 45 | −110 | −160 | D | 1.0 |
| Comparative Example 2 | Photoconductor 46 | −110 | −165 | D | 1.0 |
| Comparative Example 3 | Photoconductor 47 | −120 | −180 | D | 1.0 |
| Comparative Example 4 | Photoconductor 48 | −125 | −180 | D | 1.0 |
| Comparative Example 5 | Photoconductor 49 | −95 | −150 | D | 1.0 |
| Comparative Example 6 | Photoconductor 50 | −95 | −150 | D | 1.0 |
| Comparative Example 7 | Photoconductor 51 | −100 | −155 | D | 1.0 |
| Comparative Example 8 | Photoconductor 52 | −100 | −150 | D | 1.0 |
| Comparative Example 9 | Photoconductor 53 | −105 | −150 | C-D | 1.0 |
| Comparative Example 10 | Photoconductor 54 | −100 | −140 | C | 1.0 |
| Comparative Example 11 | Photoconductor 55 | −95 | −130 | C | 1.0 |
| Comparative Example 12 | Photoconductor 56 | −85 | −120 | C | 0.9 |
| Comparative Example 13 | Photoconductor 57 | −80 | −105 | C | 1.0 |
| Comparative Example 14 | Photoconductor 58 | −75 | −100 | C | 1.0 |
| Comparative Example 15 | Photoconductor 59 | −70 | −85 | C | 1.0 |
| Comparative Example 16 | Photoconductor 60 | −100 | −140 | C-D | 1.0 |
| Comparative Example 17 | Photoconductor 61 | −90 | −125 | C | 1.0 |
| Comparative Example 18 | Photoconductor 62 | −105 | −170 | D | 1.0 |
| Comparative Example 19 | Photoconductor 63 | −75 | −115 | D | 1.0 |
| Comparative Example 20 | Photoconductor 64 | −85 | −130 | D | 1.0 |
| Comparative Example 21 | Photoconductor 65 | 70 | 150 | D | — |
| Comparative Example 22 | Photoconductor 66 | −75 | −110 | D | 1.0 |
| Comparative Example 23 | Photoconductor 67 | −70 | −110 | D | 1.0 |
| Comparative Example 24 | Photoconductor 68 | −40 | −80 | D | 1.0 |
| Comparative Example 25 | Photoconductor 69 | −40 | −85 | D | 1.0 |
| Comparative Example 26 | Photoconductor 70 | −60 | −95 | D | 1.0 |

TABLE 2-continued

| | Photoconductor | Initial VL (V) | VL after printing (V) | Dot reproduc-ibility | ϵ |
|---|---|---|---|---|---|
| Comparative Example 27 | Photoconductor 71 | −55 | −95 | D | 0.9 |
| Comparative Example 28 | Photoconductor 72 | −55 | −85 | C | 1.0 |
| Comparative Example 29 | Photoconductor 73 | −70 | −110 | C-D | 1.0 |
| Comparative Example 30 | Photoconductor 74 | −45 | −75 | C | 1.0 |
| Comparative Example 31 | Photoconductor 75 | −60 | −100 | C | 1.0 |
| Comparative Example 32 | Photoconductor 76 | −55 | −90 | C | 1.0 |
| Comparative Example 33 | Photoconductor 77 | −65 | −95 | C | 1.0 |
| Comparative Example 34 | Photoconductor 78 | −75 | −105 | C | 1.0 |
| Comparative Example 35 | Photoconductor 79 | 55 | 155 | C | — |
| Comparative Example 36 | Photoconductor 80 | −95 | −120 | D | 1.0 |
| Comparative Example 37 | Photoconductor 81 | −90 | −120 | D | 1.0 |
| Comparative Example 38 | Photoconductor 82 | −90 | −150 | D | 1.0 |
| Comparative Example 39 | Photoconductor 83 | −95 | −155 | D | 1.0 |
| Comparative Example 40 | Photoconductor 84 | −95 | −145 | D | 1.0 |
| Comparative Example 41 | Photoconductor 85 | −105 | −160 | D | 1.0 |
| Comparative Example 42 | Photoconductor 86 | −100 | −145 | D | 1.0 |
| Comparative Example 43 | Photoconductor 87 | −95 | −145 | D | 1.0 |
| Comparative Example 44 | Photoconductor 88 | −95 | −135 | D | 1.0 |
| Comparative Example 45 | Photoconductor 89 | 115 | 170 | D | — |
| Comparative Example 46 | Photoconductor 90 | −100 | −150 | D | 0.9 |
| Comparative Example 47 | Photoconductor 91 | −100 | −155 | D | 1.0 |
| Comparative Example 48 | Photoconductor 92 | −110 | −155 | D | 1.0 |
| Comparative Example 49 | Photoconductor 93 | −105 | −155 | D | 0.9 |
| Comparative Example 50 | Photoconductor 94 | −95 | −130 | C | 1.0 |
| Comparative Example 51 | Photoconductor 95 | −95 | −125 | C | 1.0 |
| Comparative Example 52 | Photoconductor 96 | −100 | −140 | C-D | 1.0 |
| Comparative Example 53 | Photoconductor 97 | −105 | −145 | C-D | 1.0 |
| Comparative Example 54 | Photoconductor 98 | 70 | 155 | D | — |

Evaluation of Charge Mobility

Example 45

Stilbene

A drift mobility was measured by a time-of-fright method. A translucent PET film on which Al electrode was vapor-deposited in a part thereon was wrapped around an aluminum cylinder, and a charge transporting layer of the following composition was coated thereon by immersion coating by means of the production device shown in FIGS. 12 and 13 to prepare a sample. Specifically, the PET film-wrapped aluminum cylinder was immersed in the coating liquid for the charge transporting layer, and lifted so as to coat the charge transporting layer.

After the aluminum cylinder was lifted, as shown in FIG. 12, before the charge transporting layer was cured, magnetic field was applied to the aluminum cylinder from the inner side to the outer side, specifically, the magnetic field was vertically applied to the aluminum substrate, so that the charge transporting layer was dry to the touch. An intensity of the magnetic field was set at 8 tesla.

After dry to the touch, the aluminum cylinder was heated and dried from the inside of the substrate by a heater 105 at 110° C. for 60 minutes, and then naturally cooled to a room temperature while the magnetic field was kept to be applied to the aluminum cylinder. The substrate was moved up and down without rotation, while it was immersed in the coating liquid for the charge transporting layer and the charge transporting layer thereon was dried. The charge transporting layer was formed to have a thickness of 15 μm.

The composition of the coating liquid for the charge transporting layer

| | |
|---|---|
| Polycarbonate (Z Polyca, by Teijin Chemicals Ltd.) | 10 parts |
| Charge transporting material having the following Structural Formula | 7 parts |
| Silicone oil KF-50 by Shin-Etsu Chemical Co., Ltd. | 0.002 parts |
| Tetrahydrofuran | 40 parts |
| Xylene | 40 parts |

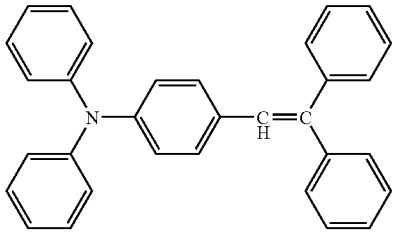

Example 46

A sample was prepared in the same manner as Example 45, except that the charge transporting material in Example 45 was changed to the charge transporting material represented by the following Structural Formula:

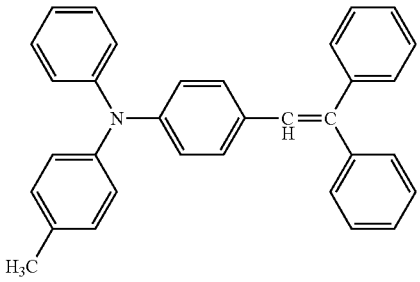

Example 47

A sample was prepared in the same manner as Example 45, except that the charge transporting material in Example 45 was changed to the charge transporting material represented by the following Structural Formula:

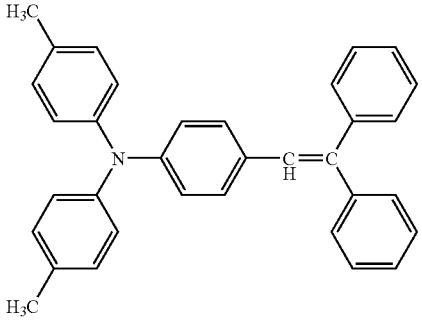

Example 48

A sample was prepared in the same manner as Example 45, except that the charge transporting material in Example 45 was changed to the charge transporting material represented by the following Structural Formula:

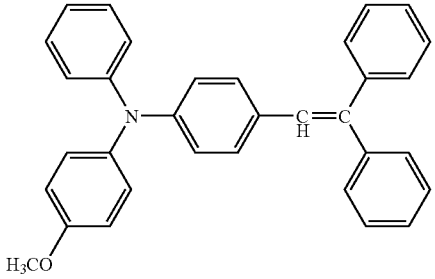

Example 49

A sample was prepared in the same manner as Example 45, except that the charge transporting material in Example 45 was changed to the charge transporting material represented by the following Structural Formula:

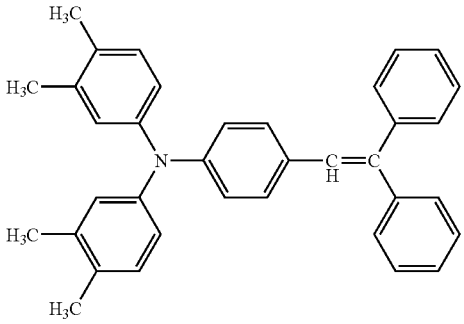

Example 50

A sample was prepared in the same manner as Example 45, except that the charge transporting material in Example 45 was changed to the charge transporting material represented by the following Structural Formula:

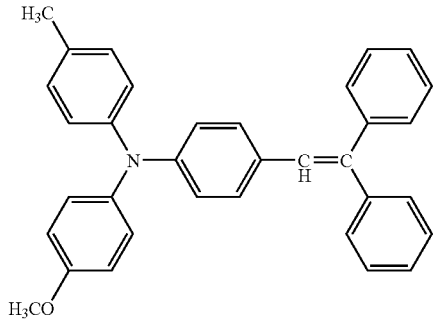

Example 51

A sample was prepared in the same manner as Example 45, except that the charge transporting material in Example 45 was changed to the charge transporting material represented by the following Structural Formula:

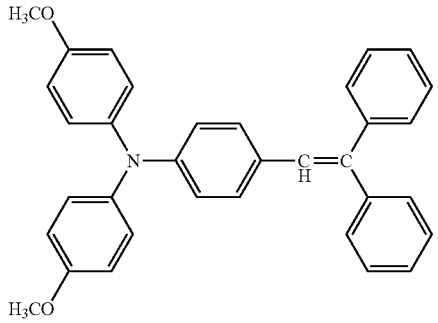

Example 52

A sample was prepared in the same manner as Example 45, except that the charge transporting material in Example 45 was changed to the charge transporting material represented by the following Structural Formula:

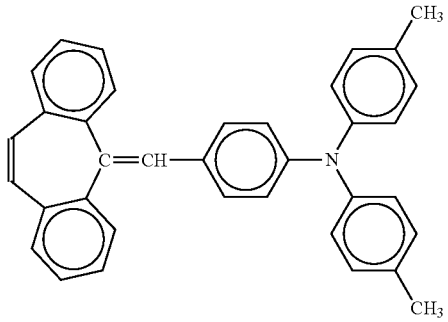

Example 53

A sample was prepared in the same manner as Example 45, except that the charge transporting material in Example 45 was changed to the charge transporting material represented by the following Structural Formula:

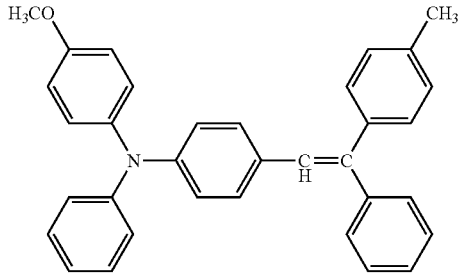

Example 54

A sample was prepared in the same manner as Example 45, except that the charge transporting material in Example 45 was changed to the charge transporting material represented by the following Structural Formula:

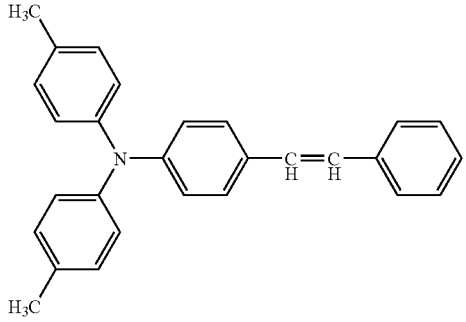

Example 55

A sample was prepared in the same manner as Example 45, except that the charge transporting material in Example 45 was changed to the charge transporting material represented by the following Structural Formula:

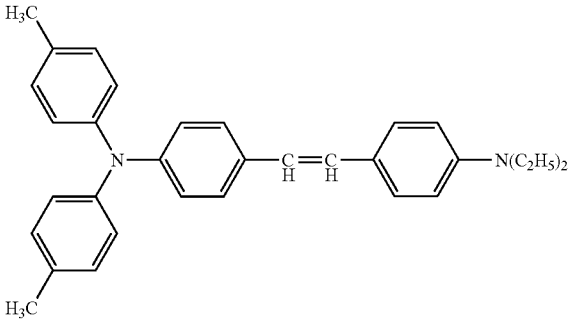

Example 56

A sample was prepared in the same manner as Example 45, except that the charge transporting material in Example 45 was changed to the charge transporting material represented by the following Structural Formula:

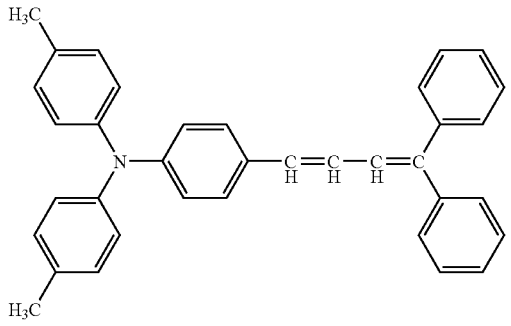

Example 57

A sample was prepare in the same manner as Example 45, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in Example 45.

Example 58

A sample was prepared in the same manner as Example 45, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example 45.

Example 59

A sample was prepared in the same manner as Example 45, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 45.

Example 60

Distyrylbenzene

A sample was prepared in the same manner as Example 45, except that the charge transporting material in Example 45 was changed to the charge transporting material represented by the following Structural Formula:

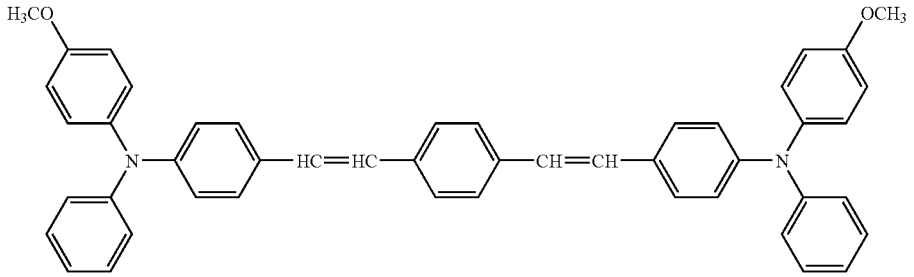

Example 61

A sample was prepared in the same manner as Example 45, except that the charge transporting material in Example 45 was changed to the charge transporting material represented by the following Structural Formula:

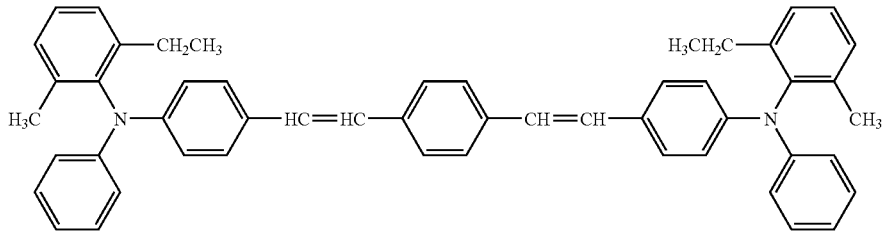

Example 62

A sample was prepared in the same manner as Example 45, except that the charge transporting material in Example 45 was changed to the charge transporting material represented by the following Structural Formula:

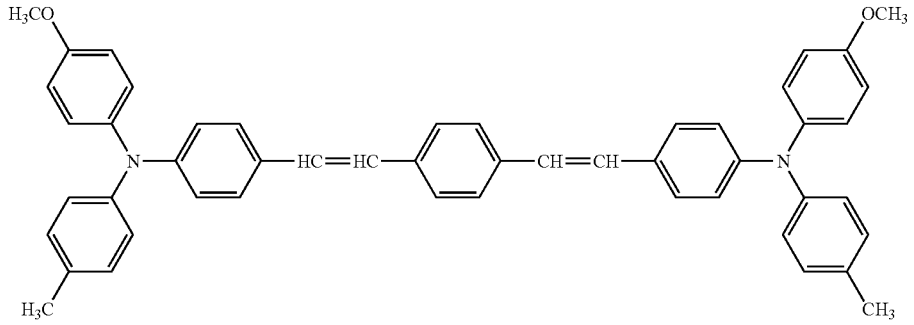

Example 63

A sample was prepared in the same manner as Example 45, except that the charge transporting material in Example 45 was changed to the charge transporting material represented by the following Structural Formula:

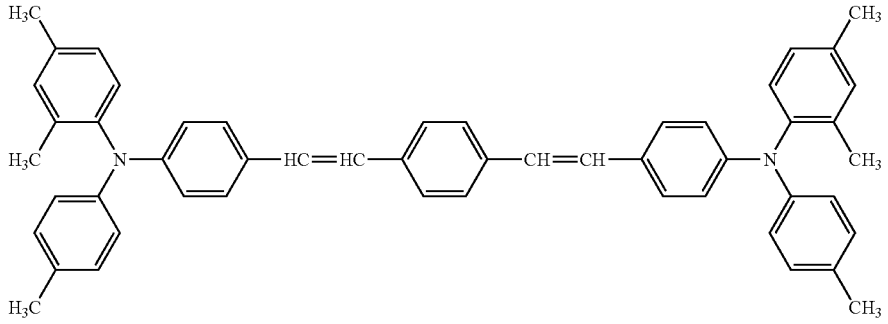

Example 64

A sample was prepared in the same manner as Example 45, except that the charge transporting material in Example 45 was changed to the charge transporting material represented by the following Structural Formula:

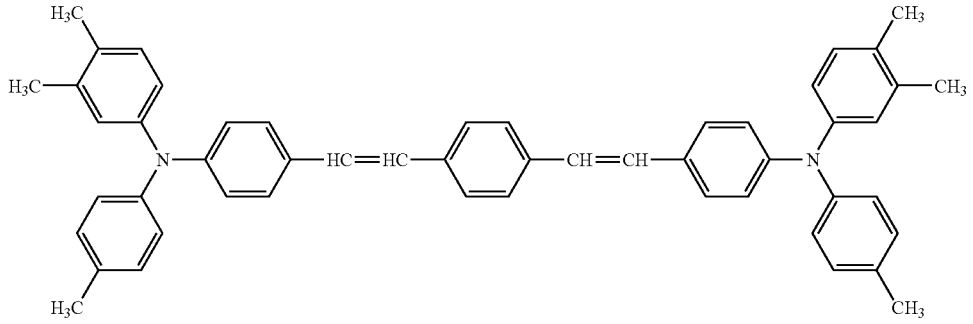

Example 65

A sample was prepared in the same manner as Example 45, except that the charge transporting material in Example 45 was changed to the charge transporting material represented by the following Structural Formula:

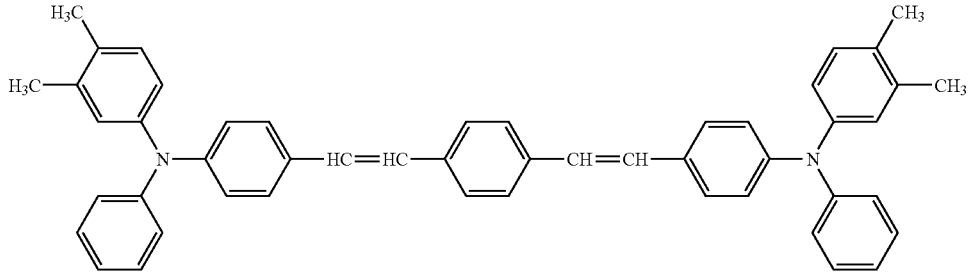

Example 66

A sample was prepared in the same manner as Example 45, except that the charge transporting material in Example 45 was changed to the charge transporting material represented by the following Structural Formula:

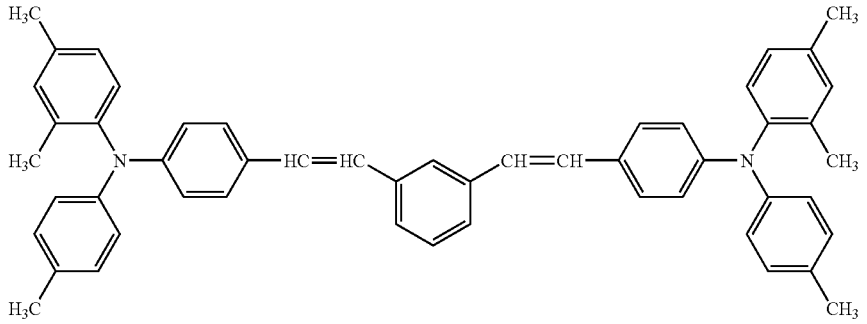

Example 67

A sample was prepared in the same manner as Example 60, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in Example 60.

Example 68

A sample was prepared in the same manner as Example 60, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example 60.

Example 69

A sample was prepared in the same manner as Example 60, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 60.

Example 70

Aminobiphenyl

A sample was prepared in the same manner as Example 45, except that the charge transporting material in Example 45 was changed to the charge transporting material represented by the following Structural Formula:

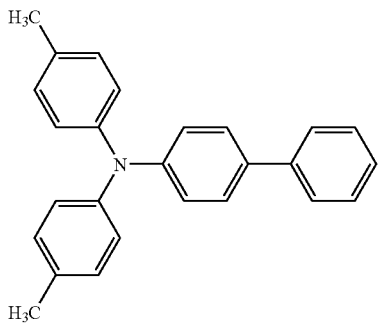

Example 71

A sample was prepared in the same manner as Example 45, except that the charge transporting material in Example 45 was changed to the charge transporting material represented by the following Structural Formula:

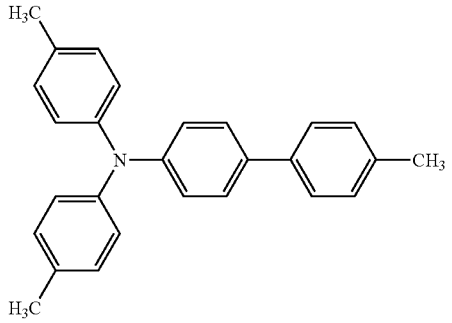

Example 72

A sample was prepared in the same manner as Example 45, except that the charge transporting material in Example 45 was changed to the charge transporting material represented by the following Structural Formula:

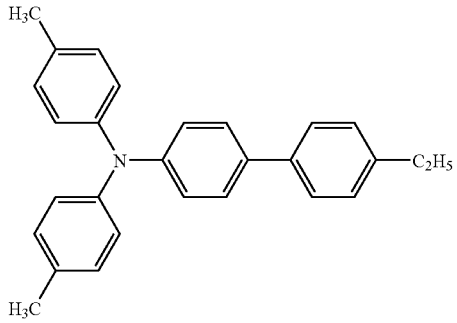

Example 73

A sample was prepared in the same manner as Example 45, except that the charge transporting material in Example 45 was changed to the charge transporting material represented by the following Structural Formula:

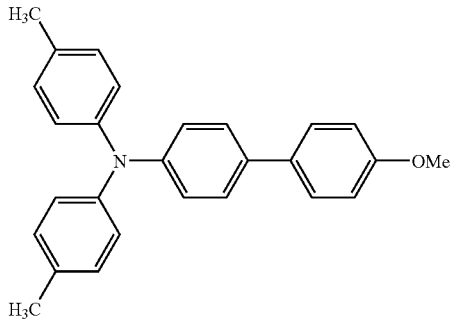

Example 74

A sample was prepared in the same manner as Example 45, except that the charge transporting material in Example 45 was changed to the charge transporting material represented by the following Structural Formula:

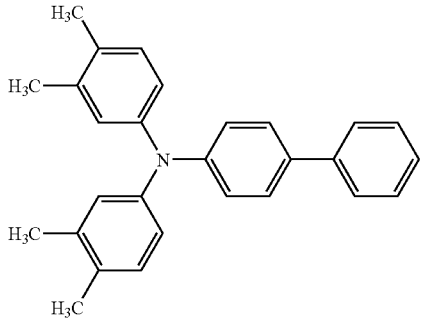

Example 75

A sample was prepared in the same manner as Example 70, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in is Example 70.

Example 76

A sample was prepared in the same manner as Example 70, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example 70.

Example 77

A sample was prepared in the same manner as Example 70, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 70.

Example 78

Benzidine

A sample was prepared in the same manner as Example 45, except that the charge transporting material in Example 45 was changed to the charge transporting material represented by the following Structural Formula:

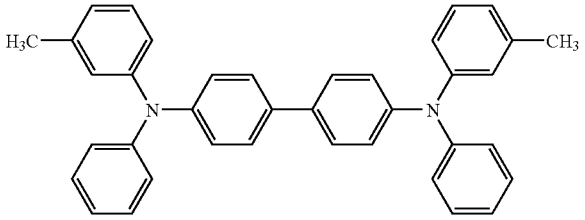

Example 79

A sample was prepared in the same manner as Example 45, except that the charge transporting material in Example 45 was changed to the charge transporting material represented by the following Structural Formula:

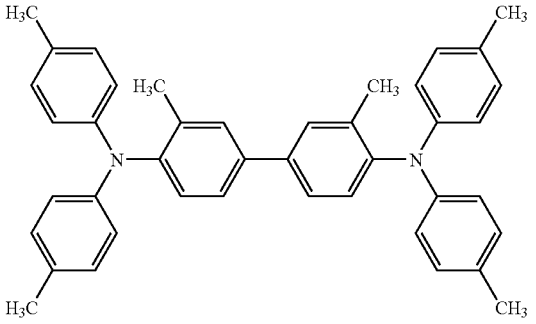

Example 80

A sample was prepared in the same manner as Example 45, except that the charge transporting material in Example 45 was changed to the charge transporting material represented by the following Structural Formula:

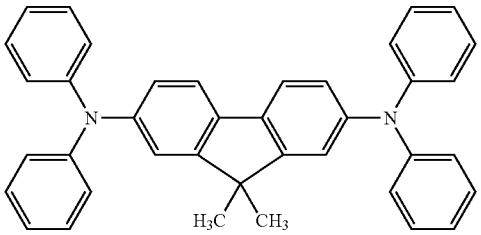

Example 81

A sample was prepared in the same manner as Example 45, except that the charge transporting material in Example 45 was changed to the charge transporting material represented by the following Structural Formula:

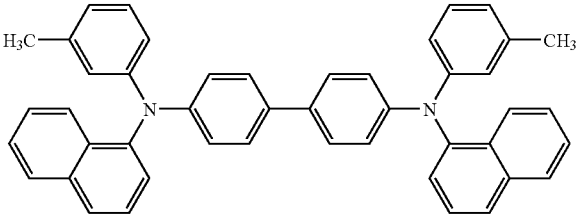

Example 82

A sample was prepared in the same manner as Example 78, except that the condition of the application of the magnetic field was changed to such that the magnetic field was started to be applied to the aluminum cylinder while the coating liquid for the charge transporting layer was coated, and then the magnetic field was kept to be applied to the aluminum cylinder while the charge transporting layer was heated, dried, and naturally cooled to a room temperature in Example 78.

Example 83

A sample was prepared in the same manner as Example 78, except that the condition of the application of the magnetic field was changed to such that the magnetic field was started to be applied to the aluminum cylinder immediately after the coating liquid for the charge transporting layer was coated and before cured, terminated in 20 minutes and never applied thereto subsequently while the charge transporting layer was heated and dried in Example 78.

Example 84

A sample was prepared in the same manner as Example 78, except that the condition of the application of the magnetic field was changed to such that the magnetic field was started to be applied to the aluminum cylinder for 20 minutes after the charge transporting layer was cured, and then the magnetic field was kept to be applied to the aluminum cylinder while the charge transporting layer was heated, dried, and naturally cooled to a room temperature in Example 78.

Comparative Example 55

A sample was prepared in the same manner as Example 45, except that the charge transporting material in Example 45 was changed to the charge transporting material represented by the following Structural Formula:

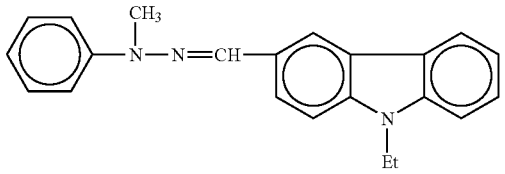

Comparative Example 56

A sample was prepared in the same manner as Comparative Example 55, except that the magnetic field was not applied to the aluminum cylinder in Comparative Example 55.

Comparative Example 57

A sample was prepared in the same manner as Example 45, except that the charge transporting material in Example 45 was changed to the charge transporting material represented by the following Structural Formula:

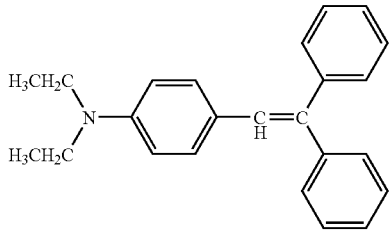

Comparative Example 58

A sample was prepared in the same manner as Comparative Example 57, except that the magnetic field was not applied to the aluminum cylinder in Comparative Example 57.

Comparative Example 59

A sample was prepared in the same manner as Example 45, except that the charge transporting material in Example 45 was changed to the charge transporting material represented by the following Structural Formula:

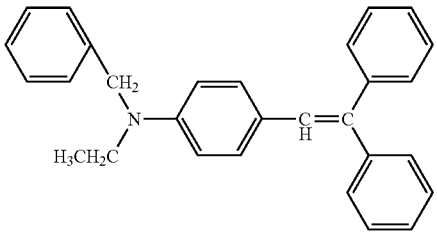

Comparative Example 60

A sample was prepared in the same manner as Comparative Example 59, except that the magnetic field was not applied to the aluminum cylinder in Comparative Example 59.

Comparative Example 61

A sample was prepared in the same manner as Example 45, except that the charge transporting material in Example 45 was changed to the charge transporting material represented by the following Structural Formula:

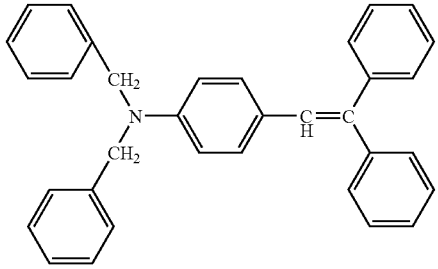

Comparative Example 62

A sample was prepared in the same manner as Comparative Example 61, except that the magnetic field was not applied to the aluminum cylinder in Comparative Example 61.

Comparative Example 63

A sample was prepared in the same manner as Comparative Example 45, except that the magnetic field was not applied to the aluminum cylinder in Comparative Example 45.

Comparative Example 64

A sample was prepared in the same manner as Example 46, except that the magnetic field was not applied to the aluminum cylinder in Example 46.

Comparative Example 65

A sample was prepared in the same manner as Example 47, except that the magnetic field was not applied to the aluminum cylinder in Example 47.

Comparative Example 66

A sample was prepared in the same manner as Example 48, except that the magnetic field was not applied to the aluminum cylinder in Example 48.

Comparative Example 67

A sample was prepared in the same manner as Example 49, except that the magnetic field was not applied to the aluminum cylinder in Example 49.

Comparative Example 68

A sample was prepared in the same manner as Example 50, except that the magnetic field was not applied to the aluminum cylinder in Example 50.

Comparative Example 69

A sample was prepared in the same manner as Example 51, except that the magnetic field was not applied to the aluminum cylinder in Example 51.

Comparative Example 70

A sample was prepared in the same manner as Example 52, except that the magnetic field was not applied to the aluminum cylinder in Example 52.

Comparative Example 71

A sample was prepared in the same manner as Example 53, except that the magnetic field was not applied to the aluminum cylinder in Example 53.

Comparative Example 72

A sample was prepared in the same manner as Example 54, except that the magnetic field was not applied to the aluminum cylinder in Example 54.

Comparative Example 73

A sample was prepared in the same manner as Example 55, except that the magnetic field was not applied to the aluminum cylinder in Example 55.

Comparative Example 74

A sample was prepared in the same manner as Example 56, except that the magnetic field was not applied to the aluminum cylinder in Example 56.

Comparative Example 75

A sample was prepared in the same manner as Example 45, except that the charge transporting material in Example 45 was changed to the charge transporting material represented by the following Structural Formula:

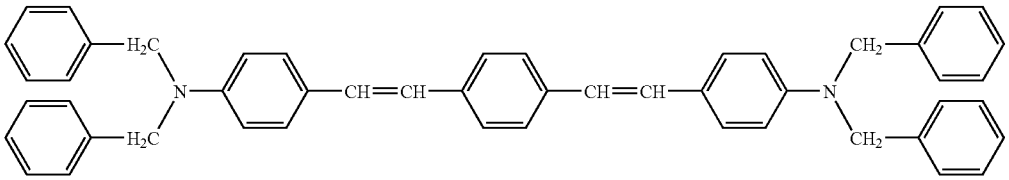

Comparative Example 76

A sample was prepared in the same manner as Comparative Example 75, except that the magnetic field was not applied to the aluminum cylinder in Comparative Example 75.

Comparative Example 77

A sample was prepared in the same manner as Example 45, except that the charge transporting material in Example 45 was changed to the charge transporting material represented by the following Structural Formula:

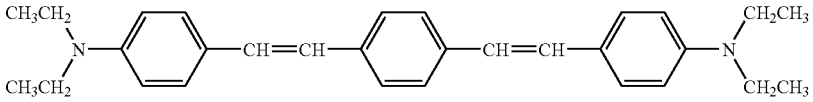

Comparative Example 78

A sample was prepared in the same manner as Comparative Example 77, except that the magnetic field was not applied to the aluminum cylinder in Comparative Example 77.

Comparative Example 79

A sample was prepared in the same manner as Example 12, except that the charge transporting material in Example 12 was changed to the charge transporting material represented by the following Structural Formula:

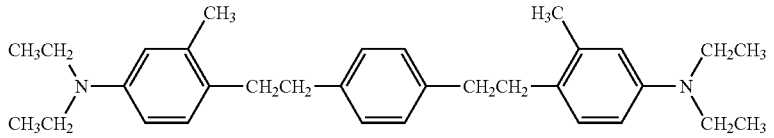

Comparative Example 80

A sample was prepared in the same manner as Comparative Example 79, except that the magnetic field was not applied to the aluminum cylinder in Comparative Example 79.

Comparative Example 81

A sample was prepared in the same manner as Example 60, except that the magnetic field was not applied to the aluminum cylinder in Example 60.

Comparative Example 82

A sample was prepared in the same manner as Example 61, except that the magnetic field was not applied to the aluminum cylinder in Example 61.

Comparative Example 83

A sample was prepared in the same manner as Example 62, except that the magnetic field was not applied to the aluminum cylinder in Example 62.

Comparative Example 84

A sample was prepared in the same manner as Example 63, except that the magnetic field was not applied to the aluminum cylinder in Example 63.

Comparative Example 85

A sample was prepared in the same manner as Example 64, except that the magnetic field was not applied to the aluminum cylinder in Example 64.

Comparative Example 86

A sample was prepared in the same manner as Example 65, except that the magnetic field was not applied to the aluminum cylinder in Example 65.

Comparative Example 87

A sample was prepared in the same manner as Example 66, except that the magnetic field was not applied to the aluminum cylinder in Example 66.

Comparative Example 88

A sample was prepared in the same manner as Example 45, except that the charge transporting material in Example 45 was changed to the charge transporting material represented by the following Structural Formula:

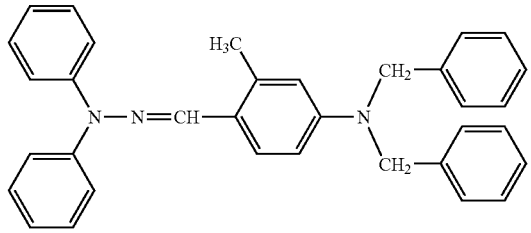

Comparative Example 89

A sample was prepared in the same manner as Comparative Example 88, except that the magnetic field was not applied to the aluminum cylinder in Comparative Example 88.

Comparative Example 90

A sample was prepared in the same manner as Example 45, except that the charge transporting material in Example 45 was changed to the charge transporting material represented by the following Structural Formula:

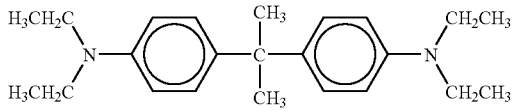

Comparative Example 91

A sample was prepared in the same manner as Comparative Example 90, except that the magnetic field was not applied to the aluminum cylinder in Comparative Example 90.

Comparative Example 92

A sample was prepared in the same manner as Example 70, except that the magnetic field was not applied to the aluminum cylinder in Example 70.

Comparative Example 93

A sample was prepared in the same manner as Example 71, except that the magnetic field was not applied to the aluminum cylinder in Example 71.

Comparative Example 94

A sample was prepared in the same manner as Example 72, except that the magnetic field was not applied to the aluminum cylinder in Example 72.

Comparative Example 95

A sample was prepared in the same manner as Example 73, except that the magnetic field was not applied to the aluminum cylinder in Example 73.

Comparative Example 96

A sample was prepared in the same manner as Example 74, except that the magnetic field was not applied to the aluminum cylinder in Example 74.

Comparative Example 97

A sample was prepared in the same manner as Example 45, except that the charge transporting material in Example 45 was changed to the charge transporting material represented by the following Structural Formula:

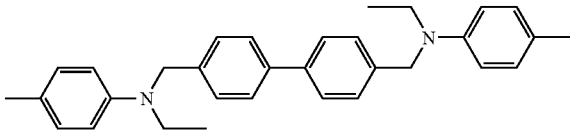

Comparative Example 98

A sample was prepared in the same manner as Comparative Example 97, except that the magnetic field was not applied to the aluminum cylinder in Comparative Example 97.

Comparative Example 99

A sample was prepared in the same manner as Example 45, except that the charge transporting material in Example 45 was changed to the charge transporting material represented by the following Structural Formula:

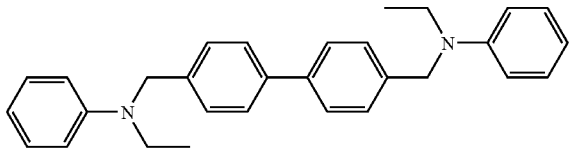

Comparative Example 100

A sample was prepared in the same manner as Comparative Example 99, except that the magnetic field was not applied to the aluminum cylinder in Comparative Example 99.

Comparative Example 101

A sample was prepared in the same manner as Example 78, except that the magnetic field was not applied to the aluminum cylinder in Example 78.

Comparative Example 102

A sample was prepared in the same manner as Example 79, except that the magnetic field was not applied to the aluminum cylinder in Example 79.

Comparative Example 103

A sample was prepared in the same manner as Example 80, except that the magnetic field was not applied to the aluminum cylinder in Example 80.

Comparative Example 104

A sample was prepared in the same manner as Example 81, except that the magnetic field was not applied to the aluminum cylinder in Example 81.

Figure 14:
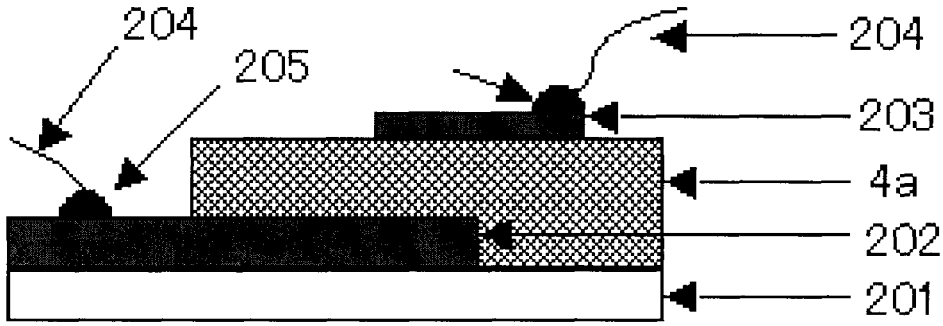
FIG. 14 shows a cross-sectional view of a sample for measuring a mobility used in Examples.

A part of the sample obtained by the above method was cut out as a sample 4a for measuring the mobility and then sandwiched by an Al electrode 202 vapor deposited on a PET film 201 and an Au electrode 203 as shown in FIG. 14. A lead wires 204 was connected to the Al electrode 202 and the Au electrode 203.

Figure 15:
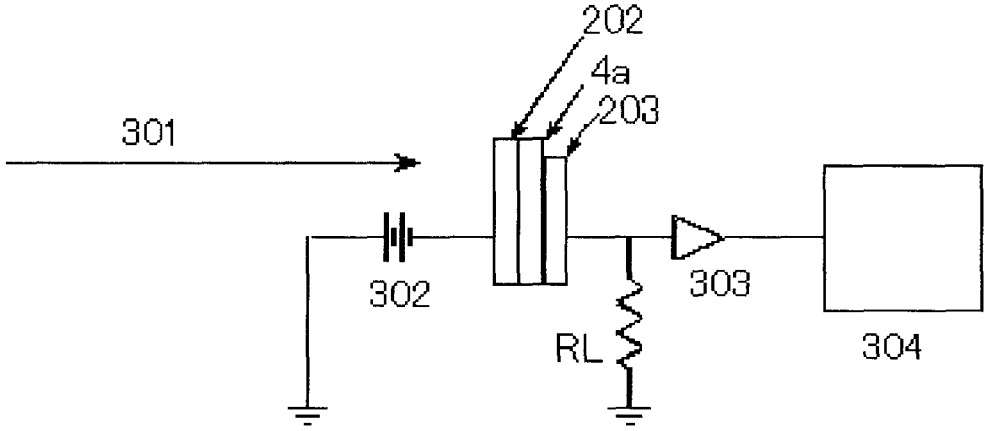
FIG. 15 shows an apparatus used in Examples for measuring a mobility.

With reference to FIG. 15, the mobility measuring device contained a high-voltage power supply 302 connected to the Al electrode 202 for applying a voltage to the sample 4a and a digital oscilloscope 304 connected to the Au electrode 203 via a differential amplifier 303 (NF ELECTRONIC INSTRUMENTS 5305, by NF Corporation).

The mobility was measured by applying a voltage to the sample 4a, and irradiating a nitrogen laser pulse beam to the sample 4a from the side of the Al electrode 202 for applying the voltage by means of a nitrogen laser generating device JS-1000L by NDC. A time variation of an electric potential generated by the flow of the electrical current through an insertion resistance RL, which is disposed between the electrode facing the Al electrode 202 (Au electrode 203) and an earth, was recorded via the differential amplifier 303 (NF ELECTRONIC INSTRUMENTS 5305, by NF Corporation) by the digital oscilloscope 304 (DS-8812 by Iwatsu Test Instruments Corporation). The measurement temperature was 23° C.

Figure 16:
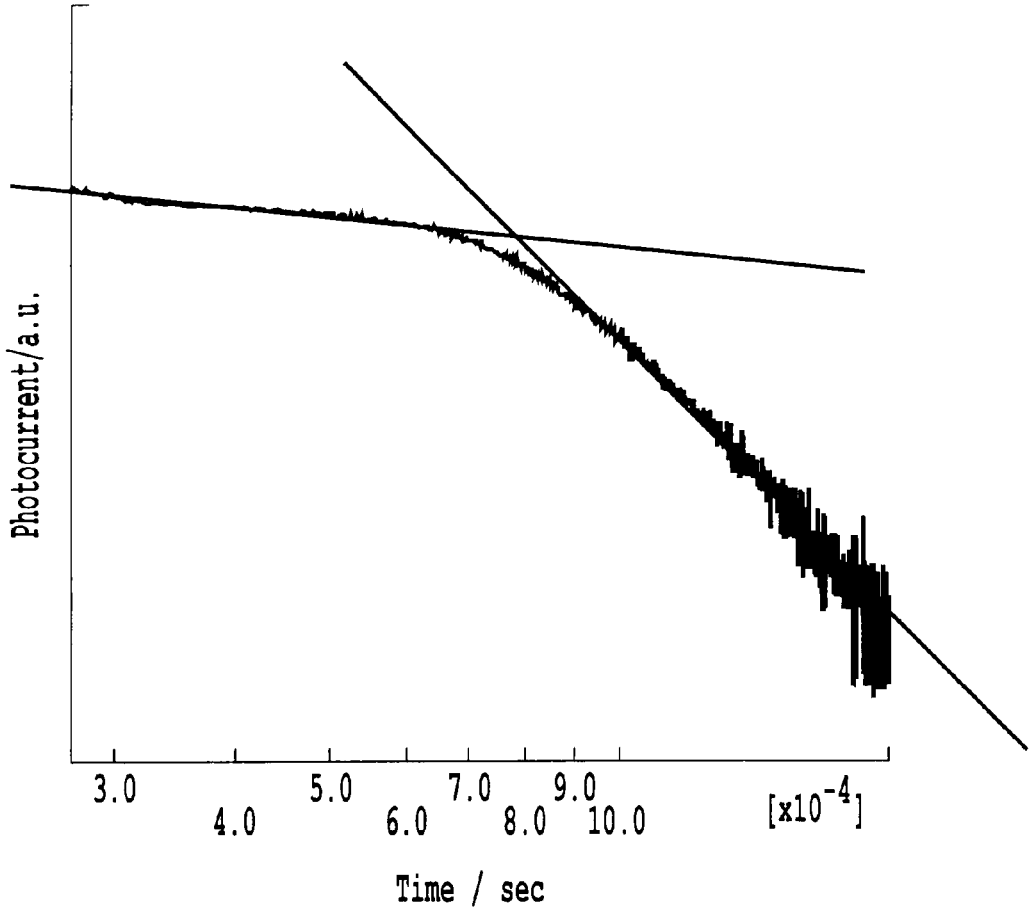
FIG. 16 shows an example of a photocurrent waveform obtained by measuring a mobility in Examples.

A transit-time (t) was obtained from an intersection of the tangents formed by drawing tangents on shoulders of a photocurrent waveform as shown in FIG. 16. Here, the photocurrent waveform was assumed to be waveform variance, and the transit-time was obtained by plotting a double logarithmic plot on all of the output waveform to be obtained, and then drawing tangents on shoulders of the photocurrent waveform so as to form an intersection of the tangent.

The charge mobility (μ) was obtained by the following equation:

$$\mu = L^2/(V \cdot t)[\text{unit:cm}^2 \cdot \text{V}^{-1} \cdot \text{sec}^{-1}]$$

where L is a layer thickness, and V is an applied voltage.

The layer thickness was measured by an electron micrometer by Anritsu Corporation.

The transit-time (t) was obtained with the applied voltage of 100V and 500V, an electric field intensity dependence of the mobility τ [−] was obtained by the following equation. The results are shown in Tables 3 to 4.

τ[−]=a mobility with an applied voltage of 500V / a mobility with an applied voltage of 100V $\mu_{500V}/\mu_{100V}$

TABLE 3

| | Eectric field intensity dependence of the mobility τ[−] |
|---|---|
| Example 45 | 1.4 |
| Example 46 | 1.4 |
| Example 47 | 1.2 |
| Example 48 | 1.3 |
| Example 49 | 1.1 |
| Example 50 | 1.2 |
| Example 51 | 1.1 |
| Example 52 | 1.4 |
| Example 53 | 1.5 |
| Example 54 | 1.7 |
| Example 55 | 1.6 |
| Example 56 | 1.7 |
| Example 57 | 1.4 |
| Example 58 | 1.6 |
| Example 59 | 1.6 |
| Example 60 | 1.4 |
| Example 61 | 1.4 |
| Example 62 | 1.2 |
| Example 63 | 1.3 |
| Example 64 | 1.1 |
| Example 65 | 1.2 |
| Example 66 | 1.1 |
| Example 67 | 1.4 |
| Example 68 | 1.6 |
| Example 69 | 1.6 |
| Example 70 | 1.4 |
| Example 71 | 1.4 |
| Example 72 | 1.2 |
| Example 73 | 1.3 |
| Example 74 | 1.2 |
| Example 75 | 1.2 |
| Example 76 | 1.6 |
| Example 77 | 1.6 |
| Example 78 | 1.3 |
| Example 79 | 1.3 |
| Example 80 | 1.2 |
| Example 81 | 1.3 |
| Example 82 | 1.3 |
| Example 83 | 1.7 |
| Example 84 | 1.6 |

TABLE 4

| | Eectric field intensity dependence of the mobility τ[−] |
|---|---|
| Comparative Example 55 | 2.6 |
| Comparative Example 56 | 2.6 |
| Comparative Example 57 | 2.3 |
| Comparative Example 58 | 2.3 |
| Comparative Example 59 | 2.6 |
| Comparative Example 60 | 2.6 |
| Comparative Example 61 | 2.4 |
| Comparative Example 62 | 2.4 |
| Comparative Example 63 | 2.3 |
| Comparative Example 64 | 2.3 |
| Comparative Example 65 | 2.0 |
| Comparative Example 66 | 2.3 |
| Comparative Example 67 | 1.9 |
| Comparative Example 68 | 2.2 |
| Comparative Example 69 | 1.9 |
| Comparative Example 70 | 2.3 |
| Comparative Example 71 | 2.3 |
| Comparative Example 72 | 2.5 |
| Comparative Example 73 | 2.4 |
| Comparative Example 74 | 2.6 |
| Comparative Example 75 | 2.5 |
| Comparative Example 76 | 2.5 |
| Comparative Example 77 | 2.6 |
| Comparative Example 78 | 2.6 |

TABLE 4-continued

| | Eectric field intensity dependence of the mobility τ[−] |
|---|---|
| Comparative Example 79 | 2.6 |
| Comparative Example 80 | 2.6 |
| Comparative Example 81 | 2.2 |
| Comparative Example 82 | 2.3 |
| Comparative Example 83 | 2.2 |
| Comparative Example 84 | 2.1 |
| Comparative Example 85 | 2.0 |
| Comparative Example 86 | 2.2 |
| Comparative Example 87 | 2.3 |
| Comparative Example 88 | 2.4 |
| Comparative Example 89 | 2.4 |
| Comparative Example 90 | 2.5 |
| Comparative Example 91 | 2.5 |
| Comparative Example 92 | 2.3 |
| Comparative Example 93 | 2.4 |
| Comparative Example 94 | 2.1 |
| Comparative Example 95 | 2.3 |
| Comparative Example 96 | 1.9 |
| Comparative Example 97 | 2.7 |
| Comparative Example 98 | 2.7 |
| Comparative Example 99 | 2.8 |
| Comparative Example 100 | 2.8 |
| Comparative Example 101 | 2.3 |
| Comparative Example 102 | 2.4 |
| Comparative Example 103 | 2.3 |
| Comparative Example 104 | 2.5 |

The electrophotographic photoconductor of the present invention is an electrophotographic photoconductor having the photosensitive layer containing the charge transporting material having a triarylamine structure, in which the charge transporting material having a triarylamine structure is vertically oriented to the substrate, capable of improving the resolution and mobility, and reducing the residual potential, thus is suitably used for an image forming apparatus and process cartridge.

What is claimed is:

1. An electrophotographic photoconductor comprising:

a conductive substrate, and a photosensitive layer, wherein the photosensitive layer is disposed on the conductive substrate and comprises a charge transporting material having a triarylamine structure represented by General Formula 1, and when peak heights in raman scattering spectra of the triarylamine structure are measured at a wavenumber of 1,324±2 $cm^{-1}$ by a confocal raman spectroscopy using z-polarized light, the photosensitive layer satisfies Mathematical Formula 1:

General Formula 1

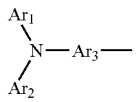

where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1$$ Mathematical Formula 1 where $I_{(inside)}$ represents the peak height in the raman scattering spectrum obtained by measuring at a depth of 5 μm or more from a surface of the photosensitive layer and $I_{(surface)}$ represents the peak height in the raman scattering spectrum obtained by measuring at a depth of less than 5 μm from the surface of the photosensitive layer, wherein the charge transporting material is vertically oriented to the substrate.

2. The electrophotographic photoconductor according to claim 1, wherein the charge transporting material comprises a stilbene compound represented by General Formula 2:

General Formula 2

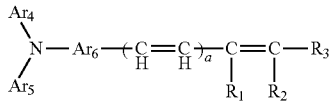

where "a" is an integer of 0 or 1; $Ar_4$, $Ar_5$ and $Ar_6$ are substituted or unsubstituted aromatic hydrocarbon groups; $Ar_4$ and $Ar_5$, $Ar_5$ and $Ar_6$, and $Ar_6$ and $Ar_4$ are optionally combined to form heterocyclic rings, respectively; $R_1$, $R_2$ and $R_3$ are hydrogen atoms, substituted or unsubstituted alkyl groups having 1 to 4 carbon atoms, or substituted or unsubstituted aromatic hydrocarbon groups; and $R_1$, $R_2$ and $R_3$ are either directly bonded to a carbon atom, or bonded via an alkylene group or hetero atom to a carbon atom.

3. The electrophotographic photoconductor according to claim 2, wherein the compound represented by General Formula 2 is a compound represented by General Formula 3:

General Formula 3

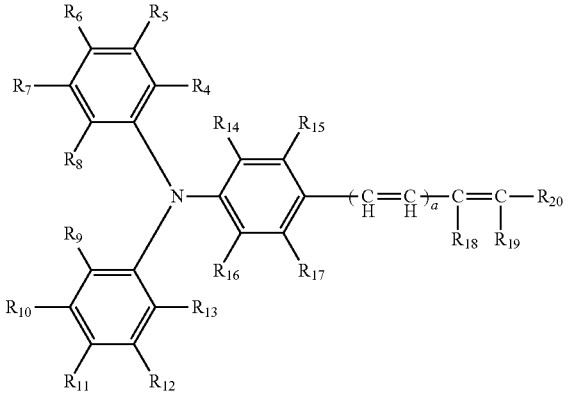

where, "a" is an integer of 0 or 1; $R_4$ to $R_{20}$ are hydrogen atoms, substituted or unsubstituted alkyl groups having 1 to 4 carbon atoms, or substituted or unsubstituted aromatic hydrocarbon groups; $R_4$ to $R_{17}$, $R_{19}$ and $R_{20}$ are optionally bonded with an adjacent substituent to form heterocyclic rings; and $R_4$ to $R_{20}$ are either directly bonded to a carbon atom, or bonded via an alkylene group or hetero atom to a carbon atom.

4. The electrophotographic photoconductor according to claim 3, wherein the compound represented by General Formula 3 is a compound represented by General Formula 4:

General Formula 4

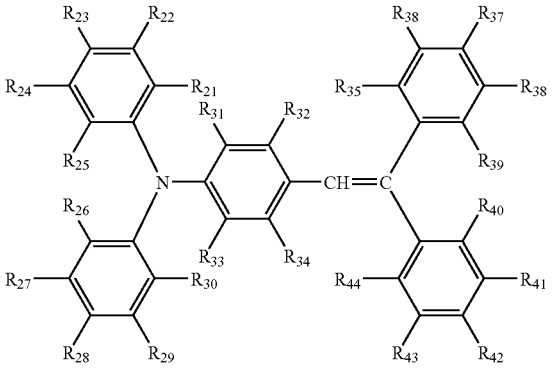

where $R_{21}$ to $R_{44}$ are hydrogen atoms, substituted or unsubstituted alkyl groups having 1 to 4 carbon atoms, or substituted or unsubstituted aromatic hydrocarbon groups; $R_{21}$ to $R_{44}$ are optionally bonded with an adjacent substituent to form heterocyclic rings; and $R_{21}$ to $R_{44}$ are either directly bonded to a carbon atom, or bonded via an alkylene group or hetero atom to a carbon atom.

5. The electrophotographic photoconductor according to claim 1, wherein the charge transporting material having a triarylamine structure comprises a distyrylbenzene compound represented by General Formula 5:

General Formula 5

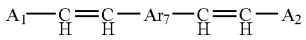

where $Ar_7$ is a substituted or unsubstituted aromatic hydrocarbon group; and $A_1$ and $A_2$ are represented by General Formula 6, and are either identical or different:

General Formula 6

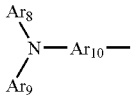

where $Ar_8$, $Ar_9$ and $Ar_{10}$ are substituted or unsubstituted aromatic hydrocarbon groups; and $Ar_8$ and $Ar_9$, $Ar_9$ and $Ar_{10}$, and $Ar_{10}$ and $Ar_8$ are optionally combined to form heterocyclic rings, respectively.

6. The electrophotographic photoconductor according to claim 5, wherein the compound represented by General Formula 5 comprises a compound represented by General Formula 7:

General Formula 7

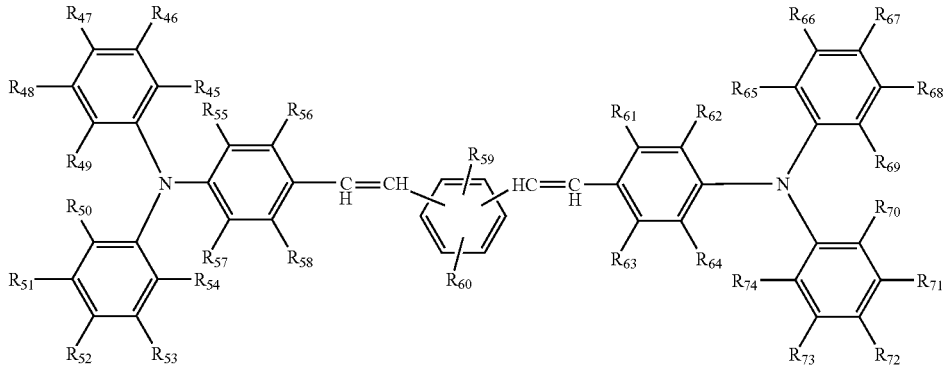

where $R_{45}$ to $R_{74}$ are hydrogen atoms, substituted or unsubstituted alkyl groups having 1 to 4 carbon atoms, or substituted or unsubstituted aromatic hydrocarbon groups, and $R_{45}$ to $R_{74}$ are optionally bonded with an adjacent substituent to form heterocyclic rings, and $R_{45}$ to $R_{74}$ are optionally directly bonded to a carbon atom, or bonded via an alkylene group or hetero atom to a carbon atom.

7. The electrophotographic photoconductor according to claim 1, wherein the charge transporting material having a triarylamine structure comprises an aminobiphenyl compound represented by General Formula 8:

General Formula 8

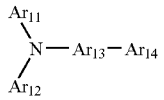

where $Ar_{11}$, $Ar_{12}$, $Ar_{13}$ and $Ar_{14}$ are substituted or unsubstituted aromatic hydrocarbon groups, and $Ar_{11}$ to $Ar_{14}$ are optionally bonded with an adjacent substituent to form heterocyclic rings.

8. The electrophotographic photoconductor according to claim 7, wherein the compound represented by General Formula 8 comprises a compound represented by General Formula 9:

General Formula 9

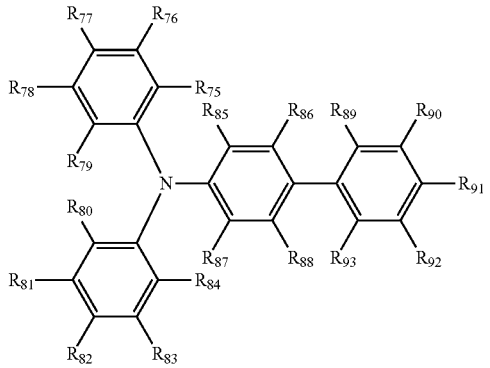

where $R_{75}$ to $R_{93}$ are hydrogen atoms, substituted or unsubstituted alkyl groups having 1 to 4 carbon atoms, or substituted or unsubstituted aromatic hydrocarbon groups, $R_{75}$ to $R_{93}$ are optionally bonded with an adjacent substituent to form heterocyclic rings, and $R_{75}$ to $R_{93}$ are optionally directly bonded to a carbon atom, or bonded via an alkylene group or hetero atom to a carbon atom.

9. The electrophotographic photoconductor according to claim 1, wherein the charge transporting material having a triarylamine structure comprises a benzidine compound represented by General Formula 10:

General Formula 10

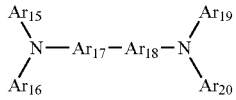

where $Ar_{15}$ to $Ar_{20}$ are substituted or unsubstituted aromatic hydrocarbon groups, and $Ar_{15}$ to $Ar_{20}$ are optionally bonded with an adjacent substituent to form heterocyclic rings.

10. The electrophotographic photoconductor according to claim 9, wherein the compound represented by General Formula 10 comprises a compound represented by General Formula 11:

General Formula 11

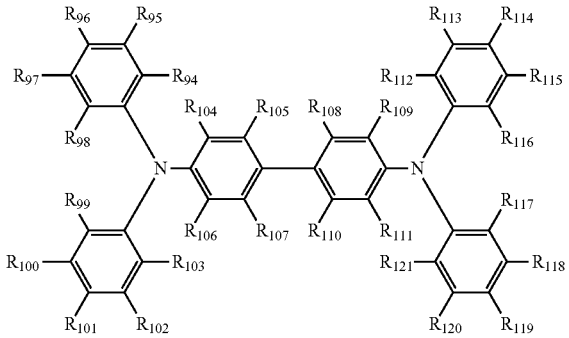

$R_{94}$ to $R_{121}$ are hydrogen atoms, substituted or unsubstituted alkyl groups having 1 to 4 carbon atoms, or substituted or unsubstituted aromatic hydrocarbon groups, $R_{94}$ to $R_{121}$ are optionally bonded with an adjacent substituent to form heterocyclic rings, and $R_{94}$ to $R_{121}$ are optionally directly bonded to a carbon atom, or bonded via an alkylene group or hetero atom to a carbon atom.

11. A method for producing an electrophotographic photoconductor comprising:

applying magnetic field to the electrophotographic photoconductor, while a coating liquid for a photosensitive layer is coated, or after the photosensitive layer is cured, wherein the electrophotographic photoconductor comprising:

a conductive substrate, and the photosensitive layer, wherein the photosensitive layer is disposed on the conductive substrate and comprises a charge transporting material having a triarylamine structure represented by General Formula 1, and when peak heights in raman scattering spectra of the triarylamine structure are measured at a wavenumber of 1,324±2 $cm^{-1}$ by a confocal raman spectroscopy using z-polarized light, the photosensitive layer satisfies Mathematical Formula 1:

General Formula 1

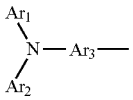

where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1$$ Mathematical Formula 1 where $I_{(inside)}$ represents the peak height in the raman scattering spectrum obtained by measuring at a depth of 5 μm or more from a surface of the photosensitive layer and $I_{(surface)}$ represents the peak height in the raman scattering spectrum obtained by measuring at a depth of less than 5 μm from the surface of the photosensitive layer, wherein the charge transporting material is vertically oriented to the substrate.

12. The method for producing the electrophotographic photoconductor according to claim 11, wherein applying the magnetic field to the electrophotographic photoconductor while the coating liquid for the photosensitive layer is coated and before the photosensitive layer is cured.

13. The method for producing the electrophotographic photoconductor according to claim 11, wherein applying the magnetic field to the electrophotographic photoconductor while the coating liquid for the photosensitive layer is coated and then heated and dried.

14. An image forming apparatus comprising:

an electrophotographic photoconductor, a charging unit, an image exposing unit, a developing unit, and a transferring unit, wherein the electrophotographic photoconductor comprises:

a conductive substrate, and a photosensitive layer, wherein the photosensitive layer is disposed on the conductive substrate and comprises a charge transporting material having a triarylamine structure represented by General Formula 1, and when peak heights in raman scattering spectra of the triarylamine structure are measured at a wavenumber of 1,324±2 $cm^{-1}$ by a confocal raman spectroscopy using z-polarized light, the photosensitive layer satisfies Mathematical Formula 1:

General Formula 1

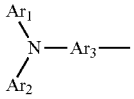

where $Ar_1$, $Ar_2$, and $Ar_3$ are substituted or unsubstituted aromatic hydrocarbon groups, and $Ar_1$ and $Ar_2$, $Ar_2$ and $Ar_3$, and $Ar_3$ and $Ar_1$ are optionally combined to form heterocyclic rings, respectively, $$\epsilon = I_{(inside)}/I_{(surface)} \geqq 1.1$$ Mathematical Formula 1 where $I_{(inside)}$ represents the peak height in the raman scattering spectrum obtained by measuring at a depth of 5 μm or more from a surface of the photosensitive layer and $I_{(surface)}$ represents the peak height in the raman scattering spectrum obtained by measuring at a depth of less than 5 μm from the surface of the photosensitive layer, wherein the electrophotographic photoconductor is produced by applying magnetic field to the electrophotographic photoconductor, while a coating liquid for a photosensitive layer is coated, or after the photosensitive layer is cured, wherein the charge transporting material is vertically oriented to the substrate.

15. The electrophotographic photoconductor according to claim 1, wherein said photosensitive layer satisfies:

$$\epsilon = I_{(inside)}/I_{(surface)} \geqq 1.3.$$

16. The electrophotographic photoconductor according to claim 1, wherein:

$$1.1 \leqq \epsilon \leqq 2.3.$$

17. The electrophotographic photoconductor according to claim 1, wherein said charge transporting material having a triarylamine structure is:

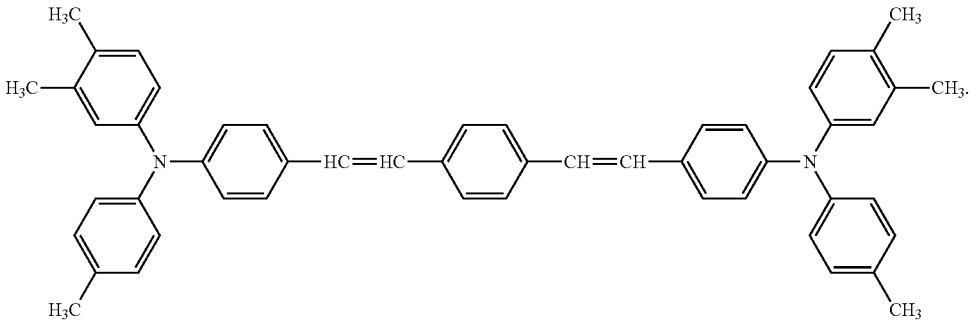

* * * * *